US010252784B2

(12) United States Patent
Restea

(10) Patent No.: US 10,252,784 B2
(45) Date of Patent: Apr. 9, 2019

(54) APPARATUS FOR PROPELLING FLUID, ESPECIALLY FOR PROPULSION OF A FLOATING VEHICLE

(71) Applicant: John Ioan Restea, Ridgewood, NY (US)

(72) Inventor: John Ioan Restea, Ridgewood, NY (US)

( * ) Notice: Subject to any disclaimer, the term of this patent is extended or adjusted under 35 U.S.C. 154(b) by 835 days.

(21) Appl. No.: 13/844,071

(22) Filed: Mar. 15, 2013

(65) Prior Publication Data

US 2014/0271196 A1 Sep. 18, 2014

(51) Int. Cl.
*B63H 1/12* (2006.01)

(52) U.S. Cl.
CPC ..... *B63H 1/12* (2013.01); *B63H 2001/122* (2013.01)

(58) Field of Classification Search
CPC ... B63H 1/00; B63H 1/12; B63H 1/02; B63H 2001/122; B63H 2001/125
See application file for complete search history.

(56) References Cited

U.S. PATENT DOCUMENTS

| | | | | |
|---|---|---|---|---|
| 30,360 A | | 10/1860 | Stanley | |
| 941,923 A | | 11/1909 | Hoffman | |
| 1,498,783 A | * | 6/1924 | Clark | B63H 1/12 416/176 |
| 1,805,359 A | | 5/1931 | De Polo | |
| 2,087,243 A | * | 7/1937 | Caldwell | B64C 11/005 416/176 |
| 2,388,711 A | | 11/1945 | Sawyer | |
| 2,764,117 A | | 9/1956 | De Persia | |
| 3,070,061 A | | 12/1962 | Rightmyer | |
| 3,229,658 A | | 1/1966 | Schrader | |
| 3,333,563 A | | 8/1967 | de Bakker | |
| 3,426,721 A | | 2/1969 | Justinien | |
| 3,682,127 A | | 8/1972 | Waquet | |
| 3,977,353 A | | 8/1976 | Toyama | |
| 4,370,096 A | | 1/1983 | Church | |

(Continued)

FOREIGN PATENT DOCUMENTS

GB 8568 A 4/1910

OTHER PUBLICATIONS

Angelo Sinisi, The Marine Propeller, Part 1, Nautica Superyacht, No. 20, Spring 2009, pp. 136-140.

(Continued)

*Primary Examiner* — Bryan M Lettman
(74) *Attorney, Agent, or Firm* — Tiajoloff & Kelly LLP

(57) ABSTRACT

A propeller has a number of blade surfaces or winglets extending helically around its rotational axis in the most streamlined manner. The winglets gradually project at an increasing distance outward with an arcuate shape, each defining a rearwardly concave channel that increases in volume and degree of encirclement rearward on the propeller. In the front of the propeller, the winglets are shaped so that they have edges angled obliquely and diagonally that conformingly and without cavitation cut into the water and cause it to flow smoothly in the channels. In the middle of the propeller, the winglet edges extend rearward so that water entrained in the channel is directed rearward without centrifugal loss. In the rear portion of the propeller, the channels narrow and reduce in volume so as to expel the water from the concavity.

7 Claims, 50 Drawing Sheets

(56) References Cited

U.S. PATENT DOCUMENTS

| | | | |
|---|---|---|---|
| 4,459,117 | A | 7/1984 | Jordan |
| 4,688,987 | A | 8/1987 | Ericson et al. |
| 4,734,067 | A | 3/1988 | Elias-Reyes |
| 4,838,819 | A | 6/1989 | Todorovic |
| 4,867,716 | A | 9/1989 | McFarland |
| 5,203,729 | A | 4/1993 | Beller et al. |
| 5,269,714 | A | 12/1993 | Wilshusen |
| 5,383,802 | A | 1/1995 | Nicholson |
| 5,934,877 | A | 8/1999 | Harman |
| 6,213,042 | B1 | 4/2001 | Delfosse |
| 6,431,926 | B1 | 4/2002 | Rosefsky |
| 6,702,552 | B1 | 3/2004 | Harman |
| 7,001,229 | B2 | 2/2006 | Kettelson |
| 7,255,618 | B2 | 8/2007 | Leonov et al. |
| 7,287,580 | B2 | 10/2007 | Harman |
| 8,328,522 | B2 | 12/2012 | Harman et al. |
| 2004/0244853 | A1 | 12/2004 | Harman |
| 2005/0269458 | A1 | 12/2005 | Harman |
| 2006/0102239 | A1 | 5/2006 | Harman |
| 2006/0255194 | A1 | 11/2006 | Doering et al. |
| 2006/0263201 | A1 | 11/2006 | Harman |
| 2007/0003414 | A1 | 1/2007 | Harman |
| 2007/0025846 | A1 | 2/2007 | Harman |

OTHER PUBLICATIONS

Angelo Sinisi, The Marine Propeller, Part 2, Nautica Superyacht, No. 21, Summer 2009, pp. 116-120.
Steve D'Antonio, The Nuts & Bolts, Propellers, Part One, Passagemaker, Jul./Aug. 2005.
Propeller. (Oct. 26, 2008). In Wikipedia, The Free Encyclopedia. Retrieved 14:04, Oct. 30, 2008, from http://en.wikipedia.org/wiki/Boat_Propeller.
Volvo Penta Advertisement, Volvo Penta of the Americas, Inc., 2006.
David Marsh, "Driving Forces", Motor Boat & Yachting, Mar. 2005, pp. 108-114.
Chuck Husick, "Perfecting Propulsion", BoatU.S. Magazine, Jul. 2006, pp. 38-39.
Mercury Mercruiser Sterndrives Inboards Tow Sports, Catalog, Feb. 2008, Mercury Marine.
Mercury Racing, Power and Propulsion Catalog, Nov. 2008, Mercury Marine.
Propeller Guide 2005/2006, Catalog, Volvo Penta, 2005.
Product Guide Powerboat, Catalog, Volvo Penta, 2008.
Dave Gerr, Introduction, Propeller Handbook, McGraw Hill Professional, Jun. 11, 2001.
Dave Gerr, Chapter 1, Propeller Handbook, McGraw Hill Professional, Jun. 11, 2001.
Dave Gerr, Chapter 2, Propeller Handbook, McGraw Hill Professional, Jun. 11, 2001.
Dave Gerr, Chapter 3, Propeller Handbook, McGraw Hill Professional, Jun. 11, 2001.
Dave Gerr, Chapter 4, Propeller Handbook, McGraw Hill Professional, Jun. 11, 2001.
Dave Gerr, Chapter 5, Propeller Handbook, McGraw Hill Professional, Jun. 11, 2001.
Dave Gerr, Chapter 6, Propeller Handbook, McGraw Hill Professional, Jun. 11, 2001.
Dave Gerr, Chapter 7, Propeller Handbook, McGraw Hill Professional, Jun. 11, 2001.
Dave Gerr, Chapter 8, Propeller Handbook, McGraw Hill Professional, Jun. 11, 2001.
Pax Water Technologies sales brochure, (undated).

* cited by examiner

APPARATUS FOR PROPELLING FLUID, ESPECIALLY FOR PROPULSION OF A FLOATING VEHICLE

FIELD OF THE INVENTION

The present invention relates to the field of fluid propulsion, and, more particularly, to devices that propel water or other fluids, or floating vehicles that are propelled by such devices.

BACKGROUND OF THE INVENTION

A variety of devices are known for moving fluids such as water, including a variety of pumps and propeller designs. In the field of fluid propulsion, motor-driven propellers often used to move a marine vehicle, such as a ship or a submarine, through water. These propellers typically consist of a twisted airfoil shape, similar to those used as aircraft propellers, and are often only partially submerged in water when operated.

An example of a propeller having a twisted airfoil shape is described in U.S. Pat. No. 4,767,278. One problem associated with the twisted airfoil shape of this type is that fluid is expelled laterally away from the axis of rotation as the propeller is rotated. The kinetic energy of this centrifugal loss does not serve to propel the vehicle forward, because the fluid is not impelled rearward to any degree, but mainly radially away from the axis of rotation. Therefore, propellers of this type are not efficient and result in wasted energy and resources used to drive the propeller.

Another problem associated with the twisted airfoil shape is cavitation, which often occurs at various points over the length of the propeller as it is rotated at different speeds. Cavitation stems from formation of vapor bubbles in a region where the pressure of the liquid falls below its vapor pressure, and can cause a great deal of noise, damage to the propeller, and vibration, as well as a loss of efficiency.

Generally, prior art propellers in various forms have used the same basic shape and design for over a hundred years, and these designs are still affected by serious problems, e.g., cavitation at different points at certain speeds, with a consequent erosion and vibration of its blades, centrifugal loss of fluid, general inefficiency due to drag or other factors, and configurations that limit the speed of the vessel.

As an alternate design approach, various screw propellers have been proposed that provide a greater surface contacting the water. For example, U.S. Pat. No. 941,923 to Hoffman discloses a boat with a screw-shaped propeller. Generally these screw propellers suffer from surface area drag, as well as suffering from the same problem of lateral centrifugal fluid loss and large swirling or vortices that squander the kinetic energy imparted to the water.

SUMMARY OF THE INVENTION

It is accordingly an object of the present invention to provide a propeller that does not have the drawbacks of the prior art. An object of the present invention is to maximize the efficiency of the propeller by minimizing centrifugal or lateral loss of fluid from the propeller body.

Another object of the invention is to prevent cavitation on surfaces of the propeller.

Still another object of the propeller of the present invention is to provide a more streamlined design of propeller that reduces drag and efficiently thrusts fluid primarily in a rearward direction.

In accordance with an aspect of the present invention, a propeller is supported on a floating body so as to be substantially completely submerged in water and rotatable about an axis of rotation to propel the floating body in said water in a forward direction of movement. The propeller comprises a plurality of winglets or blade surfaces supported on the floating body for rotation about the axis of rotation. Each of the winglets extends in a generally spiral path about the axis of rotation and has a first surface facing generally rearwardly and a second surface facing generally forwardly. The first surface of each winglet and the second surface of a respective next adjacent one of the winglets define therebetween a fluid passage space extending generally spirally around the axis of rotation. The fluid passage space having a varying volume defined as a space radially inward of the winglet. In a forward portion of the winglet, the volume of the fluid passage space continuously increases rearwardly, and, in a rearward portion of the winglet, the volume of the fluid passage space reduces continuously rearwardly.

According to another aspect of the invention, a propeller is supported on a floating body so as to be completely submerged in water and rotatable about a longitudinal axis of rotation for propelling the floating body in said water. The propeller comprises a shaft rotatably supported on the floating body. The shaft has a forward front end and a rearward back end, and the shaft is driven so as to rotate about the longitudinal axis. Three propulsion structures are supported on and extend in a generally spiral path about the shaft, and are rotationally staggered with respect to one another. Each of the propulsion structures has a fluid contact surface with a surface width measured along the fluid contact surface from a radially inward end portion to an outward edge portion. The fluid contact surface has a forward engaging portion, an intermediate fluid entraining portion, and a rearward exhaust portion. The surface width of the fluid contact surface increases from the engaging portion to the intermediate fluid entraining portion, and decreases from the intermediate fluid entraining portion to the exhaust portion. The fluid contact surface in the intermediate fluid entraining portion is concave and inwardly and rearwardly disposed so as to radially inwardly enclose a spiral fluid flow volume, with the fluid contact surface being shaped such that cross-sections thereof in a plane perpendicular to the longitudinal axis extend curvingly rearward a distance at least as great as a radially outward extension distance of the fluid contact surface.

According to still another aspect of the invention, a propeller is supported on a floating body in water so as to impel said floating body in a forward direction of movement. The propeller comprises a plurality of winglets supported fixedly with respect to each other so as to rotate together about a longitudinally extending axis of rotation. Each of said winglets comprises a winglet body portion extending generally spirally about the axis of rotation and having a generally forwardly-disposed forward surface and a generally rearwardly-disposed rearward surface. The forward and rearward surfaces meet in an acute-angle winglet edge that also extends generally spirally about said axis of rotation. The rearward surface is concave over at least a longitudinal portion of a longitudinal length of the winglet so as to define a generally rearward facing channel rearward of the winglet body portion such that the rearwardly concave rearward surface has a forwardmost channel surface portion at a forwardmost part of the channel. The longitudinal portion includes a forward intake portion, a retention portion rearward thereof, and an expelling portion rearward of the retention portion. In the intake portion, the winglet edge is oriented such that, as the propeller is rotated, the winglet edge passes into the water with a conforming flow from the winglet edge over the forward and rearward surfaces, and a portion of the water flows into the channel. From the intake portion to the retaining portion, the forwardmost channel surface portion of the rearward surface and the winglet edge extend continuously obliquely rearward, and the winglet edge extends continuously obliquely rearwardly more steeply than the forwardmost channel surface portion, and the rearward surface widens and defines the channel to as to be wider in the retaining portion. In the retaining portion, the winglet edge is oriented such that the rearward surface contiguous thereto extends rearward in a direction that differs from the longitudinal direction by no more than the acute angle. In the expelling portion, the channel becomes narrower than in the retention portion. According to another aspect of the invention, a propeller has a plurality of winglets extending generally spirally about its rotational axis. Each winglet defines a fluid flow space that extends generally spirally around the rotational axis. The length of the winglet to its outward edge increases continuously rearwardly from a minimum extension at the front end of the winglet to a maximum extension in a rearward portion of the propeller, and then continuously decreases rearwardly therefrom to the rearward end of the winglet.

The fluid flow space has a cross-section relative to its spiral path that is generally circular in a forward portion and in an intermediate portion of the propeller, and this cross-section increases in diameter rearwardly.

The winglet has a rearward facing curved surface ending in its edge. The curved surface in the forward portion of the propeller extends along an increasing arc of the circumference of circular cross-section of the fluid flow space, and reaches at least approximately 180 degrees of the arc in the intermediate portion, where the surface provides a trailing surface leading to the edge that is substantially parallel to the rotational axis of the propeller.

The winglet preferably increases in extension beyond the 180 degrees of arc but extends rearwardly outwardly of the circular cross-section. In a rearward portion rearward of a position where the maximum extension of the winglet is reached, the winglet is radially inwardly compressed so that the cross-section of the fluid flow space becomes generally an oval shape that continues to reduce in size as the winglet extension decreases rearwardly, with the longer axis of the oval extending longitudinally of the propeller, with the winglet maintaining the trailing edge portion of the curved surface generally extending longitudinally rearwardly.

Other objects and advantages of the invention herein will become apparent in the specification below.

DETAILED DESCRIPTION

Figure 1:
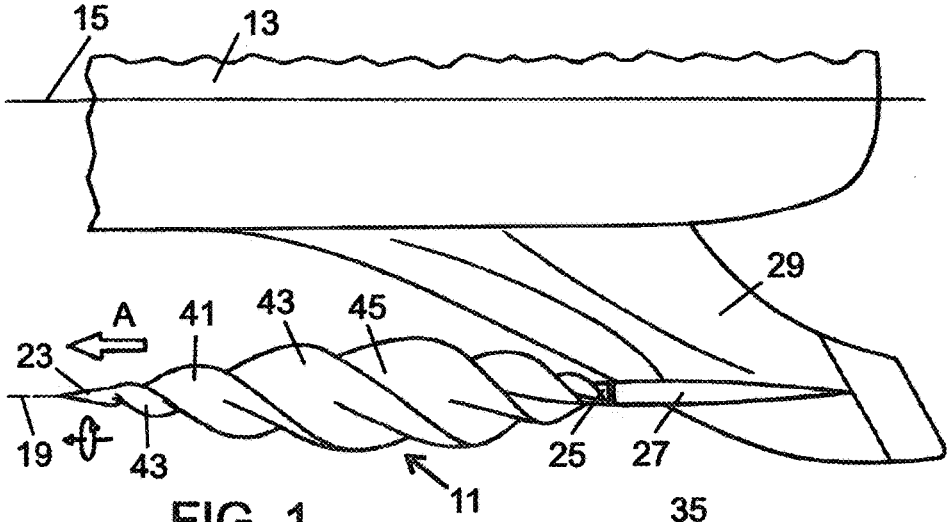
FIG. 1 is a side view of a boat employing a propeller according to an embodiment of the present invention.

As best seen in FIG. 1, at least one propeller or propeller 11 is supported under a vessel 13 floating in water 15. The propeller 11 is completely submerged, and is driven by a motor (not shown) of the vessel 13, which causes the propeller 11 to rotate in a clockwise direction 17 when viewed looking forward along an axis of rotation 19, so as to propel the vessel 13 in a forward direction A. A pointed front end 23 of the propeller 11 extends in the forward direction.

Figure 2:
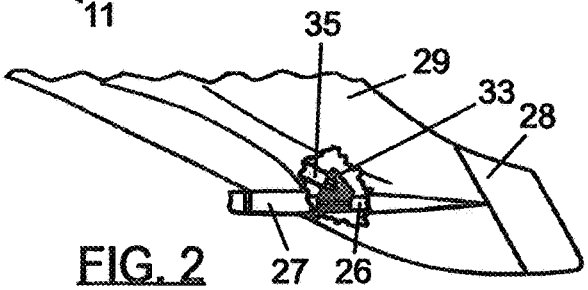
FIG. 2 is a side view of a propeller-supporting structure on a boat, with some of the housing cut away to show its inner workings.
Figure 3:
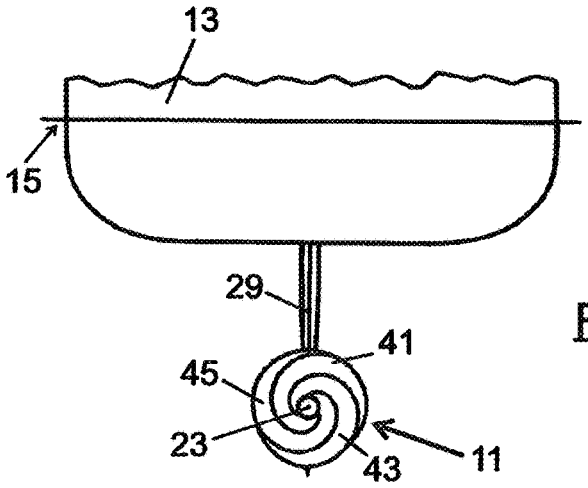
FIG. 3 is a front view of the boat as seen in FIG. 1.

Referring to FIGS. 2 and 3, rudder structure 29 of the vessel 13 receives and rotatably supports a shaft portion 26 extending from the rearward end 25 of the propeller 11 into sealed receiving sleeve 27 of the rudder 29. Shaft 26 has fixed thereon a toothed cylindrical gear 31 that meshes with a worm gear 33 on a shaft 35 from the motor (not shown), or the shaft 26 may be driven by any other system for turning propeller shafts known in the art. Pivoting rudder vane 28 is controlled by the user of the vessel to direct the movement of the vessel, as is also well known in the art.

Overview of Propellar Design

Figure 4:
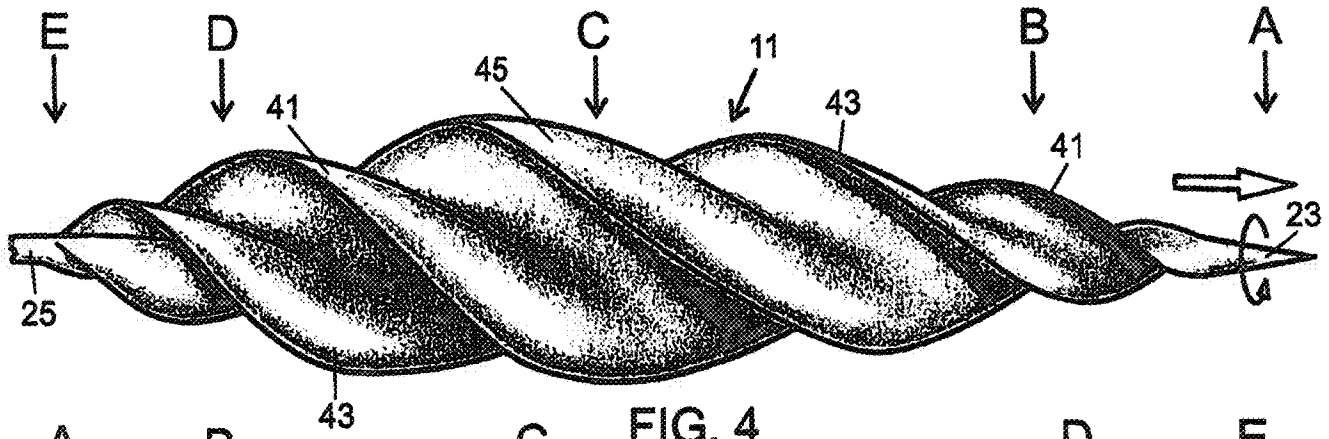
FIG. 4 is a left view of the propeller of FIG. 1.
Figure 5A:
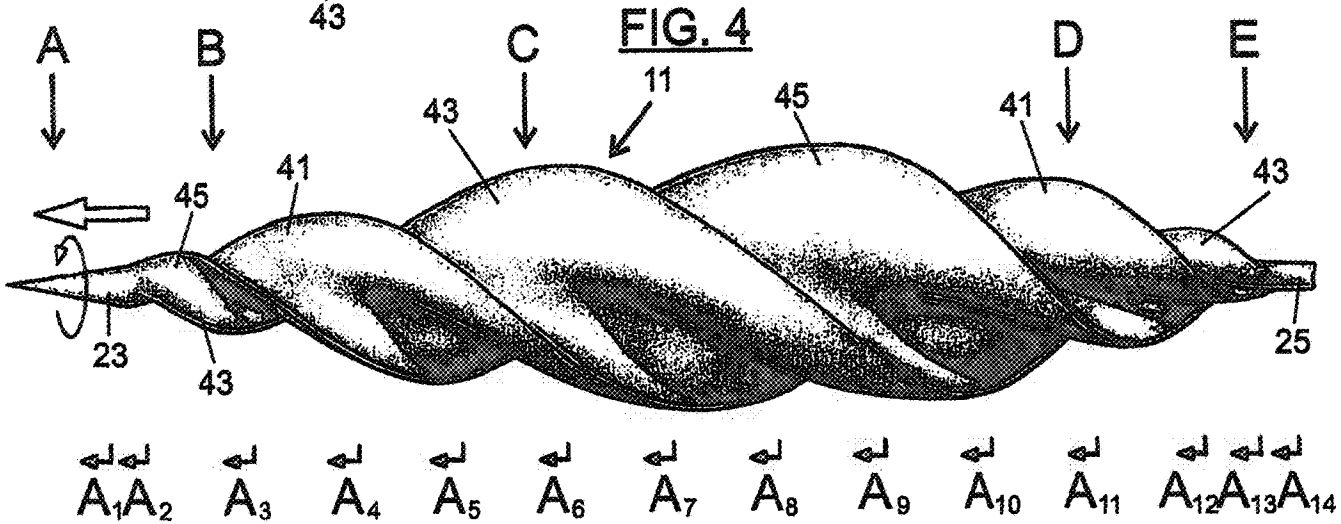
FIG. 5A is a detailed right-side view of the propeller of FIG. 1.
Figure 5B:
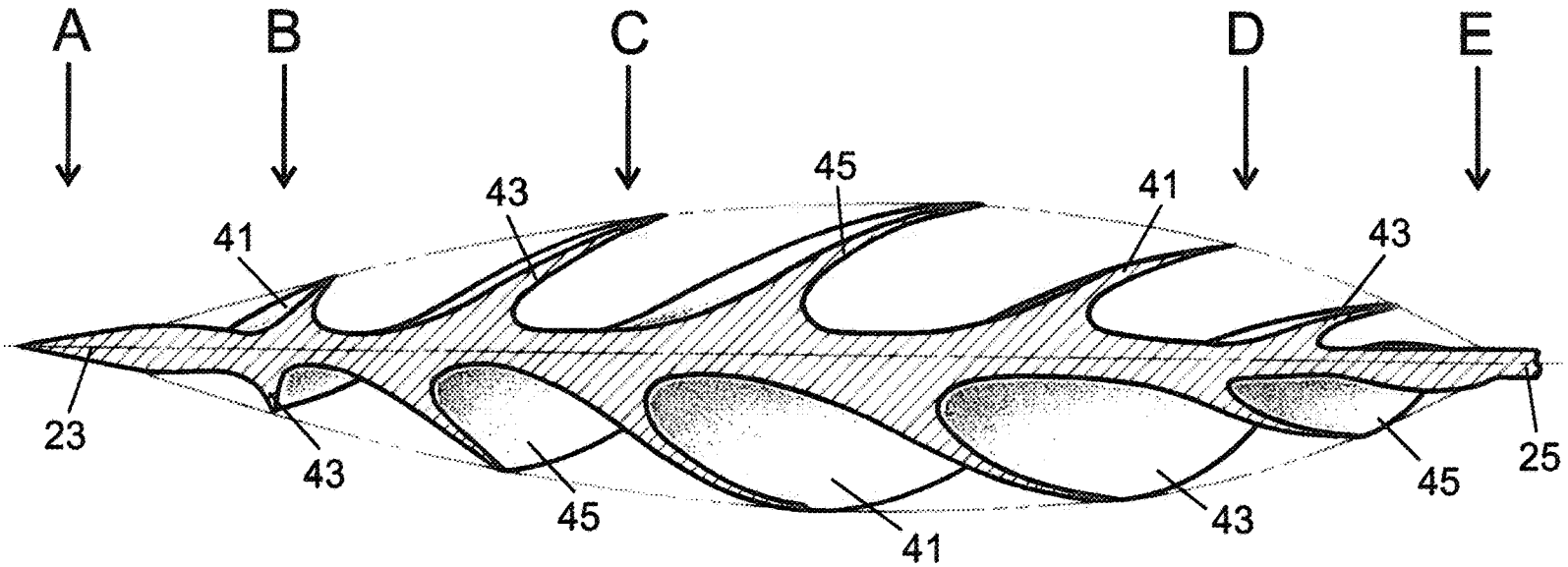
FIG. 5B is a cross-sectional view as in FIG. 5A taken at a vertical plane through a longitudinal centerline of the propeller.

Referring to FIGS. 4, 5A and 5B, the propeller 11 comprises central shaft 25 supporting thereon a plurality, in this embodiment three, propulsion elements 41, 43 and 45, herein referred to as winglets or blade surfaces, which extend generally helically around the shaft 25. In the preferred embodiment, the propeller 11, including the winglets 41, 43 and 45, is an integral or composite-material unibody device, meaning that it is formed of one piece of relatively rigid material, e.g., composite materials, metal and/or plastic, and has no internal moving parts, except for its being supported for rotation in the rudder structure 29.

Each winglet 41, 43 and 45 defines an associated respective spiraling fluid flow space in a concave, generally rearwardly-disposed, channel face of the winglet.

In a forward part of the propeller, generally described as an intake portion, the propeller rotates and advances in the water, causing each winglet edge to meet the water so as to gradually cut into and entrain the water in the associated channel, where the water is directed rearward, with conforming non-cavitating flow over the front and rear surfaces of the winglets. In the intake portion, the winglets increase in length, and the volume of the channels subtended by the winglets increase gradually and continuously to accommodate the increasing amount of water being brought in to the channels by the cutting of the winglet edges.

At the front tip of the propeller, the fluid flow space or channel is small or nonexistent and the small winglet surfaces end in edges that initially start straight or slightly spiral around the longitudinal axis and then gradually increase their helix to about a 45 degree angle, and remain at that angle for most of the length of the active/propelling segment. The channels increase in cross-section (the cross-section being either taken in a plane normal to a respective spiral path of each channel behind the respective winglet, or taken in a plane extending through the longitudinal axis) with consequently increasing volume rearward. The winglets have a generally curved cross-sectional shape, and the concave faces of the winglets are tilted at an angle in the direction of rotation of the propeller. The edges act as cutting edges that cut into the stationary water and cut from the surrounding water a portion of the water that is then entrained in the fluid flow space and accelerated in a spiral flow therein to the rear.

The curved shape of the winglets in this embodiment subtends, or is approximately a portion of, an arc of a circle. As the winglets grow longer rearward, the surfaces of the winglets extend further along the arc of the generally circular shape of the fluid flow space, and the radius of the arc increases as well, with the channel subtending or constituting a flow space that can be described as a generally conical space that is wrapped spirally about the axis of rotation of the propeller.

In a middle portion of the propeller, generally described as a retention portion, the winglets are shaped so that the channels reach their maximum radial width.

In this retention portion, the outer surface of the edges of the winglets extend approximately straight rearward parallel to the longitudinal direction, or, expressed more geometrically, the outer surfaces are tangent to a theoretical cylinder around the axis of propeller rotation. Here water is not taken into the channels, but the water already inside the channels is enclosed and guided so as to flow spirally in the channels. Water outside the winglets flows over the outer surfaces of the rotating winglets conformingly, without cavitation, and without being drawn in to the channel.

The water inside the channel is substantially prevented from centrifugal outward flow from the channel by the extension of the winglet to surround a substantial portion of the volume of the channel, with the longitudinal distance from the front of the flow space to the rear tip of the winglet being at least half the radial width of the flow space as bounded by the winglet, with the curve of the winglets being an arc of approaching 180 degrees or more. Also in the retention portion, the inward surfaces of the edges of the winglets cease to be a cutting edge, and rather become a trailing edge surface of the winglet channels that is oriented so that it deflects or directs flow of water being pushed centrifugally outward in the channel to pass along the inside surface of the winglet, and to flow off the winglet rearwardly, and not laterally outward, which would squander energy conferred to the water by the propeller.

The rear part of the propeller, which is rearward of the retention portion, is here generally described as the exhaust portion. The diameter of the cross-section increases rearwardly to a maximum point, and then the fluid flow space channel narrows radially so that it becomes longitudinally oblate and generally oval in shape, with the pitch of the spiral path increasing so that fluid leaves the propeller at an accelerated rate. The winglets' curvature pinches gradually radially inward so that the channel narrows radially and lengthens longitudinally, incrementally reducing the volume of the channel through which the water is flowing, with the result that the water passing through it is expelled substantially directly rearwardly at high speed from the channel at the rearward edge of the winglet, which is oriented to extend generally directly longitudinally rearward. The spiral path of the channel also here increases in pitch so that the rearward movement of water flowing through the channel is accelerated.

The propeller and all its surfaces are designed to preserve continuity of flow of the fluid passing over it, and to minimize disturbance of the state of the fluid. This is achieved by eliminating abrupt changes or uneven surfaces, which would tend to create turbulence in the water flow or stagnation, and a resulting loss of efficiency. The propeller 11 of the invention provides the following functions and advantages:

- it efficiently pierces and hydrodynamically displaces fluid;
- it cuts and collects fluid gradually and efficiently without creating turbulence or stagnation, etc.;
- it propels the fluid substantially directly rearwardly, accelerating it gradually, smoothly, efficiently and forcefully;
- it contains the fluid laterally and reduces loss of the fluid centrifugally;
- it discharges the fluid rearwardly from the propeller in a clean and uniform flow;
- it provides a contour or external envelope of the propeller that reduces turbulence and drag of the device while it travels through the fluid; and
- it performs the above functions seamlessly using one compound/composite unibody propeller design and device in the most streamlined manner possible.

The three main portions described above, i.e., intake, retention and exhaust portions, are primary features of the propeller or propeller 11, but in more detail, referring to FIGS. 4 and 5, the propeller or impelpropeller 11 conceptually can be divided into five longitudinal sections or segments A to E, each focused on respective specific functions. The transition between the sections is smooth and continuous, with the smooth shape of the winglets, and there may be some overlap of the functions of the segments.

The first segment is a penetrating section A, i.e., the pointed tip 23, which helps to make the entry into the fluid as efficient and non-turbulent as possible. It is an object of the present design to minimize any turbulence or any differences of pressure or flow speed anywhere on the propeller that result in cavitation, noise, drag or other inefficiency of flow of the fluid as well as of propulsion of the vessel. The sharp nose of the propeller 11 does this, and the initial outward extension of the winglets is in a path that minimizes turbulence around the rotating front tip 23.

The second segment is the intake section B. In the intake section B, a leading edge of each of the winglets initially extends longitudinally and projects radially outwardly, and then smoothly transitions to become obliquely disposed front and/or lateral winglet edges, with a surface that gradually becomes laterally wider and rearwardly concave, so as to collect the fluid and take it inside the volume of a channel passage defined by the inward and rearward concave surface of the winglet of the propeller, as described above. The subtended volume in the channel in this area continuously and monotonically increases rearwardly of the propeller.

The third segment is the retention or intermediate compressing/propelling section C that follows intake section B, as described above. Compressing/propelling retention section C propeller starts at about where the lateral extension starts, and encapsulates or encloses the fluid in the spiraling channel volume that is formed between two adjacent blades/winglets. The channel flow space in this section is diagonal in a spiral or helical path in which the water flows and is accelerated further. Section C is also described as the retention section, because the channel volume is largely bounded radially outwardly by the rearward extension of the winglets, which block the radial outward flow of water in the channel due to centrifugal force created by rotation of the propeller. Here the increase of the volume of the channel slows or stops altogether.

The fourth segment is the exhaust section D, where the edge of the blades/winglets pinch inward form a rearward directed opening in the channel directed substantially straight to the back of propeller 11, causing the water in the winglet channel to flow rearward from the propeller 11. The channel narrows and the spiral pitch increases in this section, accelerating the expulsion of water rearward.

The fifth section is a trailing section E, in which the winglets end by extending at a sharp angle relative to the longitudinal axis so as to relinquish the fluid flow to run along the cylindrical shaft 25. The winglets in this segment extend longitudinally straight rearwardly, and they have a smaller concavity or cupping than the forward sections so as to cause the trailing edge of each winglet to release the fluid. The last segment guides the flow as much as possible to the radial center, thus smoothing the flow. Any rotating device forms a vortex, and thus some turbulence, which uses energy and creates inefficiency, but this propeller design reduces or eliminates the turbulence formed at the rear end of the propeller. In embodiments where the drive is not connected to the shaft at the rear of the propeller, the rear end of the propeller 11 preferably tapers down to a sharp point, not present in the embodiment of FIG. 5A or 5B.

The intake and retention segments B and C are somewhat integrated in function, as are all the segments with the adjacent sections, as all share the channels that spiral around the propeller and the sections smoothly transform each into the next without a sudden turbulence-provoking change. Variants of the propeller 11 can be made in which the segments are integrated fully among themselves, or they may be defined and more clearly compartmentalized. Because of the seamless construction of the propeller 11 and its winglets, it can be considered to not have segments, but just one continuous construction, which fulfills all five or the middle three of the segment functions. Also, a propeller or propellers may make use of only one or two of the above-described functional segment structures advantageously.

Because of the integration of these segments the propeller presented here can be described as a continuous propeller in contrast to the "fragmented" or "flat" propeller in common current use.

Because of its shape and mode of operation, and because it includes in its design an impeller as well as a propeller component, the propeller 11 can be technically and more precisely described as an axial, gradual impelpropeller, with variable helically-pitched gradual and continuous-edge blades or wins lets at both ends at sharp angles to its axis, of a specific shape.

The design of the exterior envelope shape of the propeller 11 is to a degree determined by the speed at which it is expected to move forward in the water. When the propeller is a very fast or super-fast variant, (as used especially in high performance vessels), it is slim and long, with the purpose being reaching the highest speed attainable, especially at high rotational speeds, which gives the fastest volume of fluid expelled for the smallest cross-section and therefore results in the least resistance. As shown in FIG. 5B, the outer envelope of the rotating propeller 11 resembles a sharp, aerodynamic generally "football" shape of rotation, wherein the forward end of the propeller is helicoidal and defined within a substantially conical envelope with an acute peak angle. The conical forward end shape serves to avoid a stagnation point ahead of the propeller. In addition, the envelope circumscribing the propeller at the rear end tapers inwardly in a rear conical envelope with an acute apex angle, preferably slightly less acute, i.e., a greater angle of taper relative to the longitudinal axis, than the apex angle of the front conical envelope, all these parameters being variable and dependent on the specific needs or the requirement of its particular design.

In different variants for slower movement or for greater volume of fluid, the propeller can take different forms that are still similar to the concept and design of FIGS. 4 and 5 but with different proportions or ratios of the exterior envelope, as will be discussed further below. In other variants, the first and last segments A and F may be eliminated in the propeller, especially in variants where the front or rear ends, or both, of the propeller are shafts driven by a motor of the vessel.

Configuration of Winglets

Figure 6:
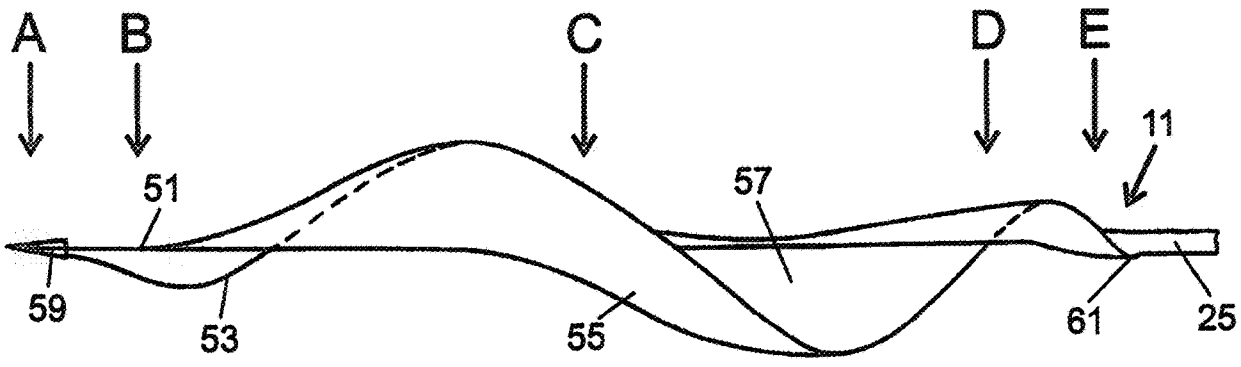
FIG. 6 is a side view of a single winglet of the propeller view as in FIG. 5.
Figure 12:
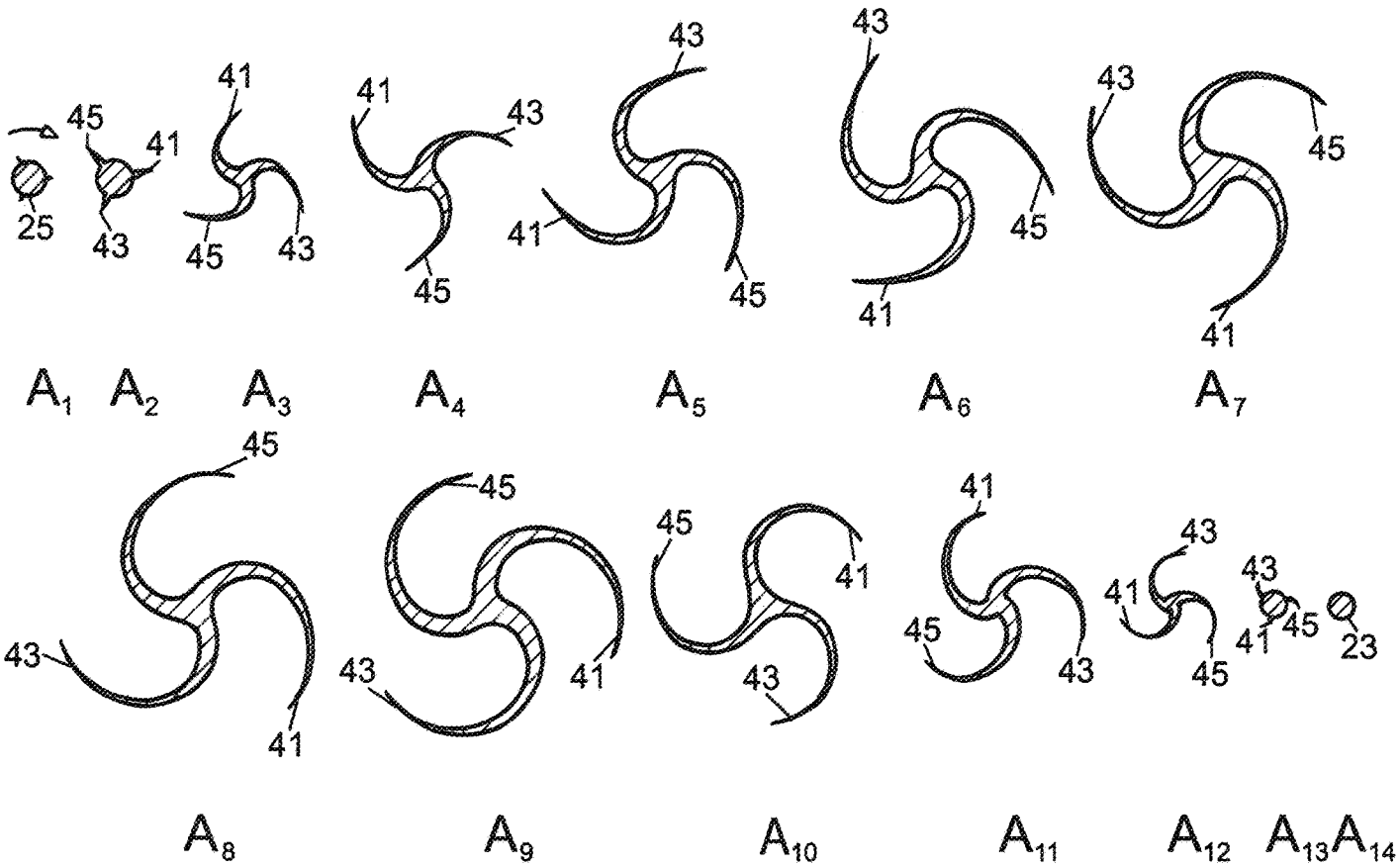
FIG. 12 shows a series of cross-sections $A_1$-$A_{14}$ of the propeller of FIGS. 4 and 5A.
Figure 13:
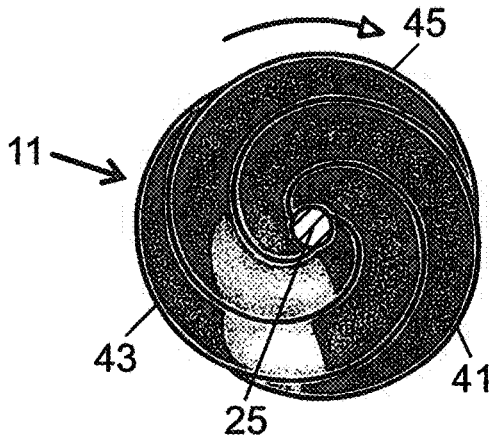
FIG. 13 is a rear cross-sectional view of the propeller of FIG. 1 through the supporting shaft looking forward.

Referring to FIG. 6, the diagram shows a single exemplary winglet 41 without the other winglets attached to the central shaft 25. It will be understood that in the first embodiment three winglets of this configuration are on the shaft 25, and that each of the winglets 41, 43, and 45 in the embodiment shown in FIG. 5 has the same structure and configuration as the winglet 41 shown in FIG. 6, except rotated 120 degrees relative to each other so as to each have a separate spiral path around the longitudinal axis around the propeller 11. The relative positions of the different winglets 41, 43 and 45 in the complete propeller may be seen in the various section views of FIG. 12, and also in the rear view of the propeller 11 shown in FIG. 13. The single winglet structure shown is exemplary, but could also function as a propeller to some degree, although it is not rotationally balanced.

As seen in FIG. 6, each winglet 41 comprises essentially a structure having a radially-inward proximal portion 51 attached to the central shaft 25. Alternatively, the winglet 41 may be located simply at the longitudinal axis and fixedly connected with the other winglets 43 and 45 so as to form a unified structure propeller 11 that does not have a central shaft.

The winglet 41 extends outwardly radially from inward proximal portion 41 to an outward edge 53 that extends spirally about the longitudinal axis of the propeller 11. The winglet body itself has two surfaces, a generally forward and outwardly disposed surface 55 and a generally rearwardly and inwardly disposed surface 57 that extends essentially continuously from the forward end 59 of the winglet all the way to the rearward end 61 of the winglet. The winglet 41 extends in a generally spiral path about the axis of the propeller, but with certain variations to aid in the flow of fluid around the propeller.

Figure 7:
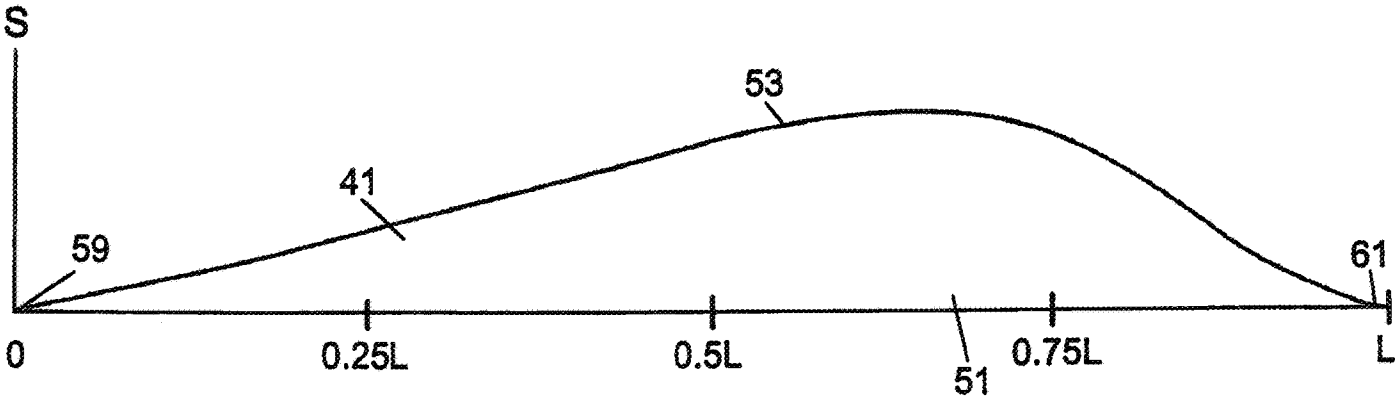
FIG. 7 is a graph illustrating variation of the surface width of the winglet over the length of the propeller.

Referring to FIG. 7, the winglet has a lateral surface width S as measured radially outward along its inside surface 57 from the radially-inward proximal end 51 or from the axis of the propeller 11 to the outward edge of the winglet. The variation in this dimension S as measured along the curved surface of the rearward surface 57 of the winglet is illustrated in the graph of FIG. 7, which shows the winglet essentially uncoiled and flat for measurement. This surface width dimension S increases gradually from front end 59 where the winglet 41 initially emerges from the sharp front point 23 of the propeller to gradually and approximately linearly increase rearward of the propeller 11. The dimension S increases rearward to a point approximately 0.6-0.75 in this embodiment L, where L is the length of the winglet from front end 59 to rear end 61 measured rearwardly. Rearward of this, the winglet surface dimension S curves and tapers inward much more sharply than the angle of linear increase, reducing to essentially zero within the last 0.25 L of the propeller.

Figure 9:
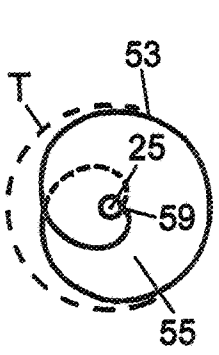
FIG. 9 is a front end view of the winglet of FIG. 8.

Referring to FIG. 9, viewed longitudinally, the front end 59 of the winglet is attached to the central shaft 25, and the winglet extends spirally outwardly with an increasing radial width to an outer edge 53 until it reaches a maximum circumscribable by an outer, generally circular envelope T of the dimension of the propeller 11, and then the propeller 11 grows narrower again at the end of the propeller 11.

Figure 8:
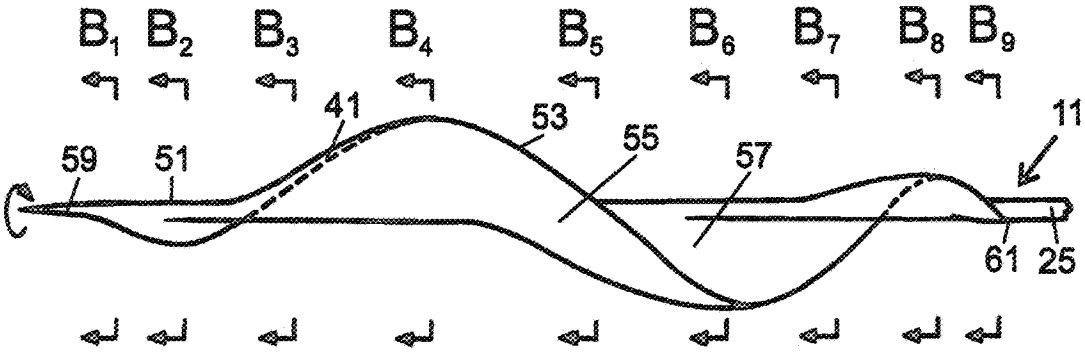
FIG. 8 is a side view of the single winglet of FIG. 6, with various cross-sectional planes perpendicular to the axis of rotation identified.

As the winglet 41 increases in lateral length, it also develops a concavity that increases with the length of the lateral dimension S of the winglet 41. This curvature is illustrated in the cross-sectional winglet diagrams of FIG. 10, taken at progressive longitudinal locations $B_1$-$B_9$ as set out in FIG. 8, and also in enlarged detail in FIG. 11. Cross-sections similar to those are seen in the progressive cross-sections taken normal to the longitudinal axis shown in FIG. 12, which shows the actual propeller cross-sections with all three of the winglets.

Figure 11:
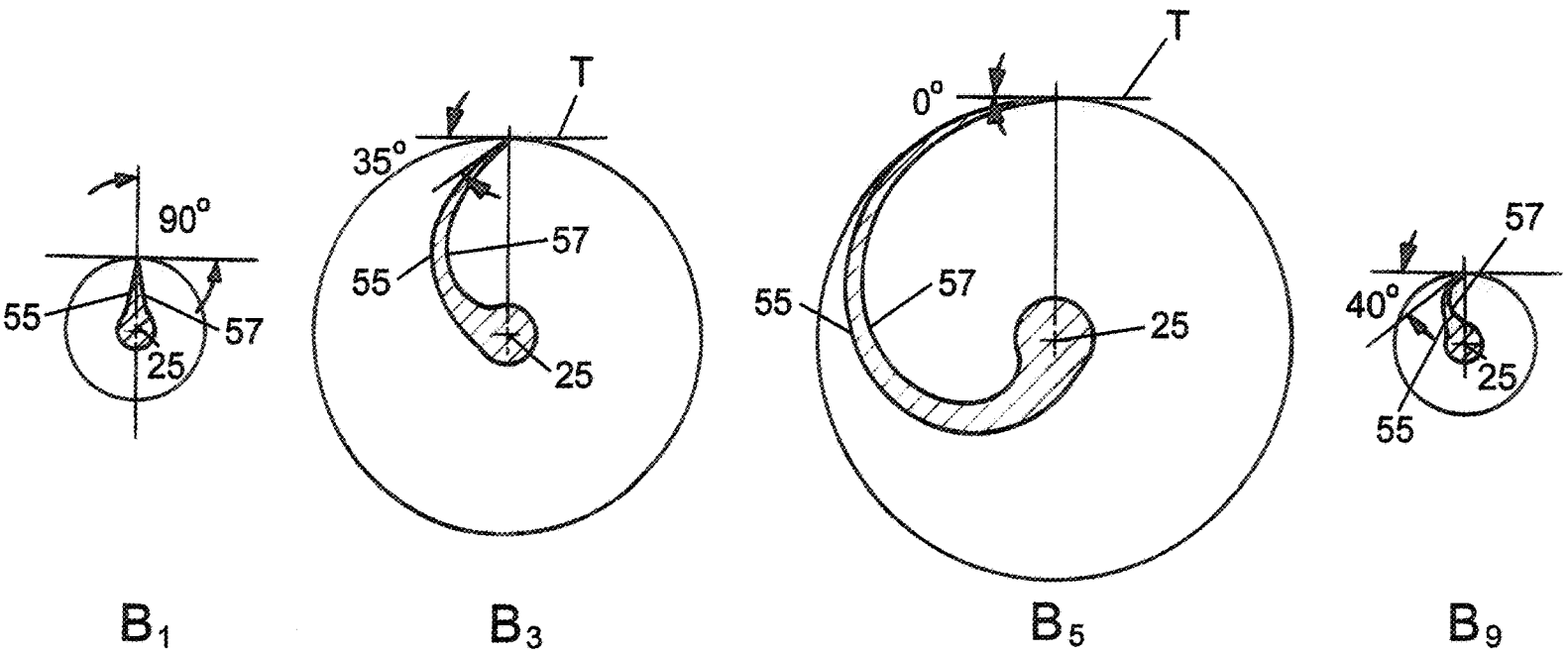
FIG. 11 is a series of detailed cross-sections of the winglet of FIG. 10 taken through a vertical plane perpendicular to its axis of rotation.

In segment $B_1$, it may be seen that the winglet projects slightly from the central shaft 25 but has no concavity between the inward proximal end 51 and its outward end 53 with both sides 55 and 57 of the winglet being essentially planar in this section. At the beginning portion of the propeller, at front end 59 of the winglet, the winglet 41 has a narrow lateral or radial dimension between the proximal portion 51 on the shaft or the axis and the outer edge 53. In this initial portion A of the winglet through section B, the function of the winglet is to cut into the fluid or water as the vehicle advances into essentially undisturbed water, and the rotation of the propeller has limited effect. As best seen in the detail of FIG. 11, in this initial portion, the winglet extends at an angle of attack, defined as the direction of the plane bisecting the angle between surfaces 55 and 57, relative to a circle or cylinder around the longitudinal axis that is in a range of approximately 85 to 90 degrees. In terms of the spiral around the longitudinal axis, the winglet fairly immediately curves from parallel to the axis to a spiraling angle of about 45 degrees, or, most preferably, at a spiraling/diagonal angle that is the parallel angle to the incoming flow of water in this portion. This allows for a less turbulent engagement of the initial part of the propeller 11 with the water as the sharp edge 53 of the winglet extends into it. Slightly further rearward at plane $B_2$, the rearward-facing surface 57 becomes slightly concave, and the curvature is such that the sharp leading edge 53 of the winglet 41 begins to extend circumferentially forward relative to the rotational direction of the propeller, cutting slightly into the fluid and beginning to draw a limited amount of fluid in this area into conforming flow along inside surface in inward and rearward facing surface 57. At the same time the curvature of the helical spiral pitch of the surface increases from the initial cutting angle adjacent to front end 59 which is zero or a very low angle relative to the axis to a generally diagonal cutting angle of attack as will be discussed below.

Figure 10:
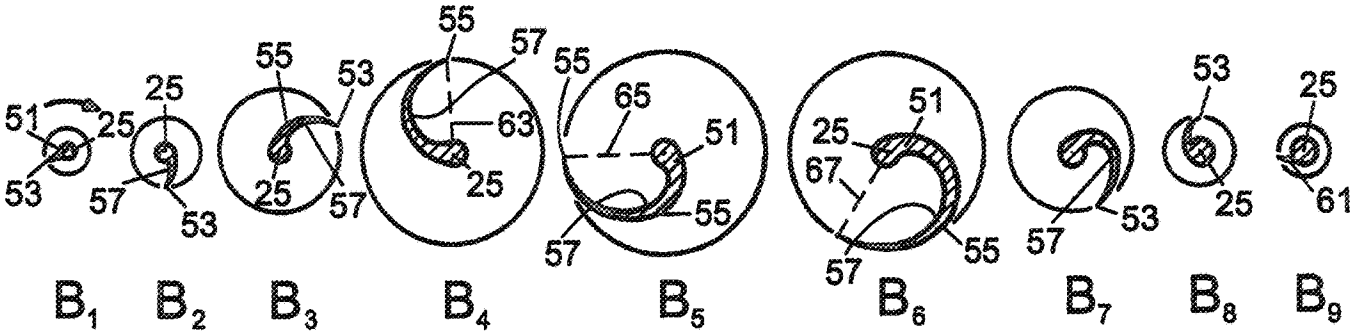
FIG. 10 is a series of forward looking cross-sectional views of the winglet of FIG. 8 taken along lines $B_1$ to $B_9$.

Referring to cross-section $B_3$ of FIG. 10, the surface length from the central shaft 25 to the outward edge 53 increases as does the concavity of the rearward and inward facing surface 57. This cross-section area is increasing the amount of fluid that is being entrained by the leading edge 53 and brought into the surface 57 to flow therein in a volume or channel defined generally between the shaft 25 and the outward edge 53 of the winglet 41. Initially, the cutting of the edge 53 is to draw water into this volume or channel space, but it also prevents to some degree a great deal of laterally outward flow from the propeller 11 due to centrifugal force and the rotation of propeller 11. As seen in FIG. 11, at $B_3$ the angle of attack of the front surface 55 to a tangent T to the subtending circle is 35 degrees, or within the range of 30 to 40 degrees.

Figure 16:
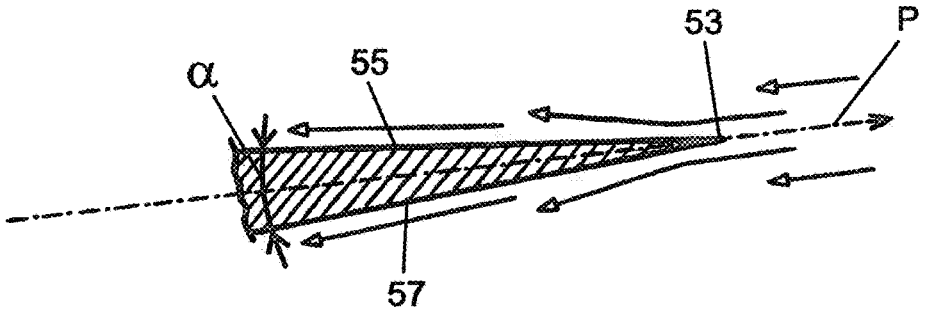
FIG. 16 is a diagram showing conforming flow over a portion of a winglet according to the invention.

The forward and rearward surfaces extending up to the edge of the winglet are at an angle in this portion (the intake portion) that causes the winglet, as the propeller is rotated, to intake water into the channel behind it smoothly and substantially without cavitation. This is accomplished by selecting the varying angle of these surface edge portions such that the edge in the intake portion cuts the water as indicated in FIG. 16. The surfaces 55 and 57 are almost planar in the area near the edge 53, and are angled relative to each other by an angle $\alpha$. Line P extends through the edge and bisects the angle $\alpha$. The winglet edge is positioned so that, as the propeller is rotated, the flow of water, as indicated by the arrows, is parallel to the bisecting line P, so that flow is split roughly equally over the front and rear surfaces 55 and 57. The surfaces 55 and 57 curve very gradually as they extend away from the edge, and there is consequently little if any turbulence in this portion of the propeller. In cross-section $B_4$, the distance S along the surface from inner shaft 25 to the outward end 53 has increased further, as has the concavity of the rearward and inward facing surface 57. An entrained volume of water generally illustrated by the chord 63, which extends from the longitudinal axis to the edge 55 of winglet 41, defines the volume inside the winglet 41 which is prevented from outward centrifugal lateral radially-outward movement by the shape of the winglet and the inner surface 57. In addition, the angle formed between the outward surface 57 adjacent outward edge 55 and tangent to a circle subtending the winglet cross-section at that point now becomes closer to zero degrees, and the inside surface 55 being a few degrees from the tangent. The edge, however, is angles such that the edge continues to cut into the water, and brings it into the channel, which continues to increase in cross-section and volume. Due to this angle of the edge of the inside surface 57, the fluid in the channel behind the winglet flows along the surface 57 only in a rearward direction oblique to the longitudinal axis of the propeller, and any radially outward component is deflected by the almost tangentially rearward extending inside surface 55 at the edge 53, eliminating or reducing greatly the centrifugal loss of fluid the movement of which would be lost kinetic energy.

Referring to cross section $B_5$, best seen in FIG. 11, the winglet increases in the length along the surface of surface 57 to the outward end 53, with the outer surface 55 at the edge being at this point approximately zero (0) degrees to the tangent T to the circle subtending the winglet cross-section. At this point, the winglet is at its longest lateral surface width. Rotation of the propeller (clockwise in this view) causes water to conformingly flow into the channel and diagonally rearward therein, and also to conformingly flow generally circumferentially over the outer surface 55. The forward facing surface 55 generally is convex over its entire surface, except where it conformingly connects near the central shaft 25 and in the initial portions A and B adjacent the front end point of propeller 11. In addition, forward surface 55 extends generally obliquely rearwardly at all points The longitudinal cross-sectional or differential volume of the channel is here at its maximum. As used herein, the cross-sectional area is intended to mean the area of the channel behind the winglet taken in a plane normal to the oblique path of the spiral of the channel. That plane may be defined as the plane perpendicular to the rear surface of the winglet and extending through the forwardmost point on that surface. Similar to that cross-section is the cross-sectional area of the channel between a forwardmost point on the rear surface and the winglet in a longitudinal plane through those points, as seen in, e.g., FIG. 5B. That area is analogous to the flow-path area described above. The volume here referred to is the differential or instantaneous volume, i.e., the relevant cross-sectional area times a short or differential distance in the spiral path, and is basically the same as the cross-sectional area described here.

Figure 14:
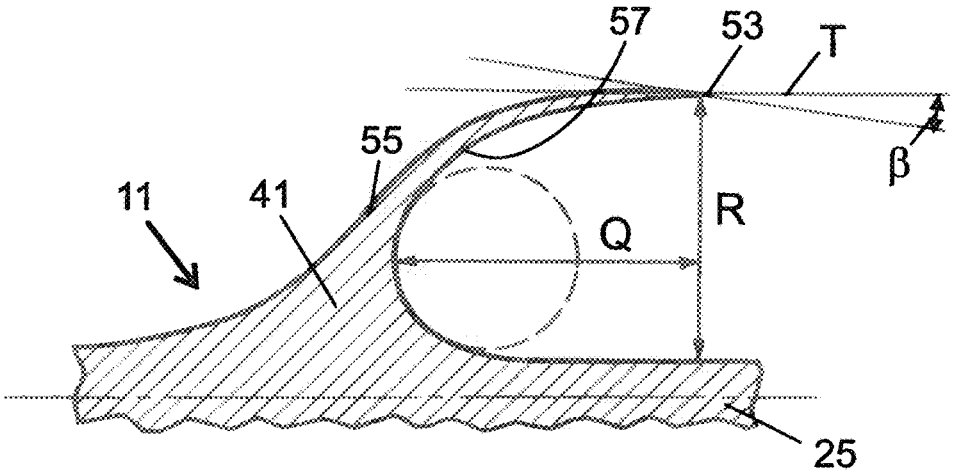
FIG. 14 is a detail view of an exemplary cross-section of a winglet of a propeller of the invention.

Referring to FIG. 14, the inward surface 57 adjacent the edge 53 is at a very thin angle β, which is made as thin as possible while maintaining structural integrity of the propeller, this angle being preferably 10 degrees or less, and most preferably 5 degrees or less.

The curvature of the winglet is such that in this, the retention portion, the distance R from the shaft 25 to edge 53 is at least 50% of the longitudinal distance Q from the edge 53 to a longitudinally forwardmost point of the surface 57 defining the channel, and Q is preferably equal to or greater than R, still relative to the design chosen (or to the thickness of the winglet wall at that point, the thickness of the axle and the kind of curvature/radius) as well as to the number of winglets chosen and the rotational speed.

Figure 17A:
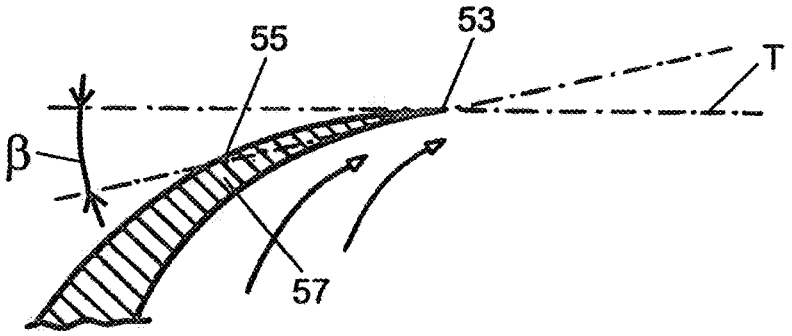
FIG. 17A is a diagram showing retention of water by the winglet in the retention portion of the propeller.

Rearward of this section $X_5$, the volume subtended and enclosed by the inner surface 57 as defined as the space between the chord 65 and surface 57 begins to decrease in size, and water flowing through the channel is gradual propelled out of the channel rearwardly. This is caused by winglet curvature being flattened radially inward, making the channel squeeze the water to accelerate. The spiral pitch around the longitudinal axis also steepens in this area, creating a more rearward angular direction in the flow. In addition, as shown in FIG. 17A, a longitudinal cross-section of the winglet has water being forced against the surface 57 by the centrifugal force of rotation and by the pinching of the channel. The water is driven outward by the centrifugal forces created by rotation of the propeller 11, and it passes along the surface 57, where it is deflected along surface 57 to flow conformingly thereon and then to flow mainly directed straight rearward from the edge 53 of the winglet, which has ceased to be a cutting edge, and has become more a trailing edge, with water flowing out of the channel over it. Due to the narrowness of angle β, the surface directs the water rearward with a minimal radially outward component.

Referring to the cross-section of plane $B_6$, after reaching its widest surface extent at $B_5$, the channel narrows, but the forward surface 55 still extends to edge 53 roughly tangent to the maximal outer circle size of the envelope, and has a volume defined at a maximal point between the surface 55 and the chord 67 which is entrained so as not to be able to pass radially outward of the propeller 11 despite any centrifugal force that is generated by the flow of fluid through this helical passage. The shape of the concave channel remains generally arcuate, although reducing in radius, in the transverse cross-section shown. In longitudinal cross-section, best seen in FIG. 5A, however, the channel becomes oblate or oval-shaped, with the shorter axis of the oval oriented radially of the propeller. The surface length of the rearward surface 57 also diminishes rearward of this maximal point more rapidly than it developed at the front part of the propeller. The surface retains its concavity but this is greatly reduced, as is the subtended space or volume that is entrained against outward movement by the surface 57. Similarly, the radial outward end 53 at this point no longer is near tangent to the circle of the subtending circle of the cross-section but is becoming more angled relative thereto. By the point of cross-section $B_6$ the concavity is reduced and the inward dimension is reduced so as to more readily release all the water that was retained in the helical channel of the winglet 41.

Further rearward, the volume reduces rapidly, and also, the winglet reduces in length as well as its arcuate extension, changing the angle of orientation of the edge of the narrowing bladelet. At $B_6$ the lateral/diagonal cutting angle of attack of the edge remains at about 0 degrees to the tangent. Then, at $B_7$ the lateral/diagonal edge angle of attack is 20 degrees to the tangent circle. At $B_3$ it is 37 degrees to the tangent, and at $B_9$ it is about 40 degrees to the tangent or at the most convenient/efficient angle to still retain the fluid from being lost laterally.

Finally, at cross-section $B_9$ the trailing edge of the winglet 61 should be at the proper angle in order to keep the fluid in here also but it may just as well diminish to approximately zero at the very end and release the last bit of water in the volume that was subtended, although there was some concavity, there is simply a release of this fluid slightly rearward, and the pitch is at approximately zero degrees relative to the shaft 25 and the longitudinal axis of the propeller.

Figure 15:
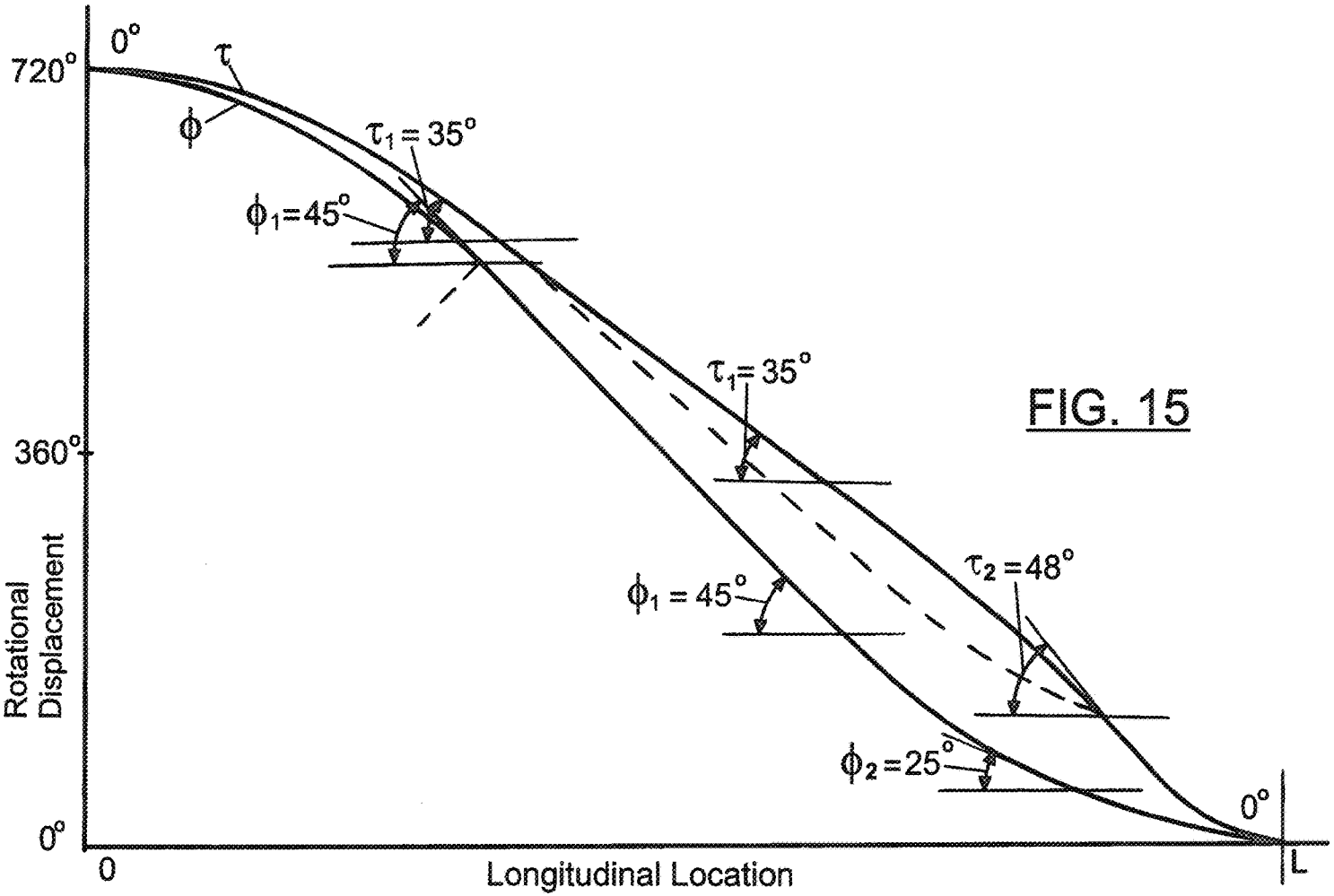
FIG. 15 is a diagram of the rotational angle location of the midpoint of the winglet base and the trailing edge of the propeller.

FIG. 15 graphically illustrates the geometry of the winglets, all three of which are, as has been stated previously, identical, just rotationally spaced 120 degrees around the axis from each other. The front end of the propeller is at the origin. The graph shows two parameters of each winglet varying over its length from 0 to L. The curve φ represents the rotational position around the longitudinal axis of the propeller of the midpoint of the base of the winglet where it is connected to the shaft 25, and the curve τ represents the rotational position for the edge 53 of the winglet. The dimensions and proportions set out in this graph are exemplary, and may vary substantially from the example here shown while still providing benefits of the invention.

At the front tip, the midpoint and the edge start aligned and extending generally in a longitudinal direction. Slightly rearward of this, both φ and τ gradually curve spirally around the shaft, with a slight angular separation of about 5 to 15 degrees as the intake portion begins.

The midpoint curve φ only soon extends into a spiraling path defined by a spiral angle $\varphi_1$, which is in the embodiment shown 45 degrees, and the midpoint spirals around the axis at this constant angle $\varphi_1$ for most of the length, until the rearward end, where the spiral pitch of the curve φ increases and the curve φ changes to a steeper angle, e.g., $\varphi_2$, which is approximately 25 degrees to the longitudinal direction. Finally at the rear end of the propeller, the curve φ gradually bends to align parallel with the longitudinal axis at the terminal exhaust portion of the propeller.

The edge curve τ curves similarly to the φ curve, but is slightly forward thereof at first, and curves to reach a spiral angle of $\tau_1$, which is about 35 degrees in this embodiment. The edge curve τ continues at this spiral angle for most of its length, with an extended portion or elongation indicated by the distance of the curve τ to the dotted line corresponding to the spiral of the base portion midpoint. Near the rear end of the propeller, the winglet edge cuts back at an angle in a range of e.g., 40 to 50 degrees, here 48 degrees. At the end of the propeller, the curve τ finally bends to parallel with the longitudinal direction and the winglet reduces to a radial length of zero.

The reduction of the spiral angles at the end of the propeller to 0 degree or parallel to the longitudinal axis is always desired in order to correct the vortex as much as possible. However, in variants where maximum output or maximum performance in terms of speed, etc. is sought, or when there is no concern about the vortex, the angle may remain the same as it was for the active/propelling segment, for instance at 45 degrees, such as in the embodiment seen in FIG. 80.

The shape of the winglet between the midpoint of the base and the edge is generally arcuate, preferably an arc centered on a spiral line going diagonally around the axis parallel to curve φ, with the arc increasing gradually to the maximum at the retention portion. The arc after that deforms laterally to be oval, preferably an oval with a longitudinal length 1.5 to 2 times its lateral width.

The structure, the shape and the curvature and the angles of the cutting edge of the axial impelpropeller at the intake openings all concur and are synchronized (with each other)—they are all configured so that at any distance from the center the angle of attack of the cutting edge is oriented at the most beneficial and efficient angle for the incoming flows, straight and diagonal, all based on and relative to at least the rotational speed, the advancing speed and the other needs and purposes of the design.

Figures 83A, 83B, 83C:
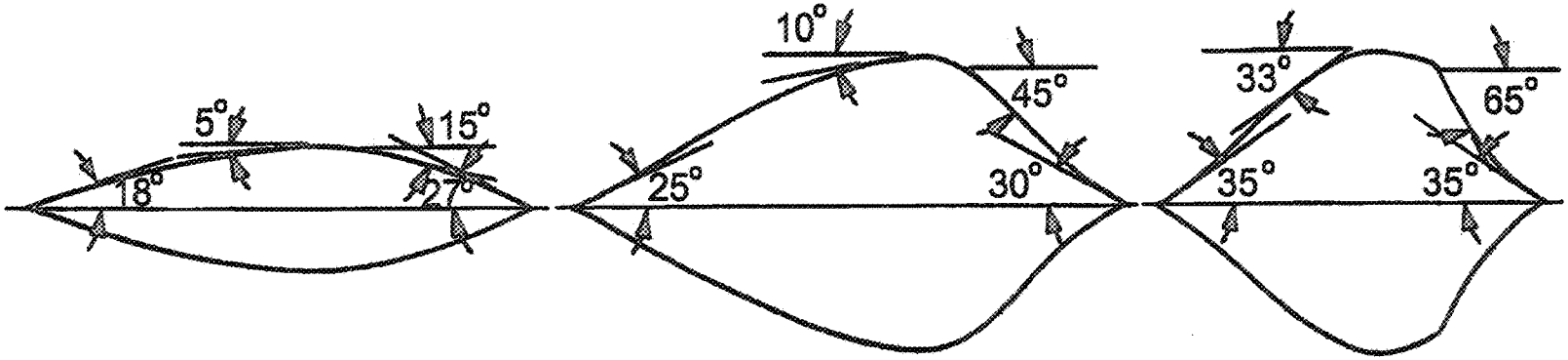
FIG. 83A is an outline view of the propeller shown in FIG. 1.
FIG. 83B is an outline view of the propeller shown in FIG. 19 (20).
FIG. 83C is an outline view of the propeller shown in FIG. 30.

As the propeller rotates it forms a certain three dimensional shape which, when sectioned through the longitudinal centerline renders a 2-D side view of its envelope, profile, contour or outline of the propeller, as shown in FIGS. 83A, 83B and 83C.

FIG. 83A shows a general outline view of the envelope of rotating propeller 11 of FIGS. 1, 4, and 5A. FIG. 83B shows a general outline view of the envelope of rotating propeller 85 of FIGS. 19 and 20, and it is also similar to the outline of the envelope of the rotating propeller of FIG. 26. FIG. 83C is a general outline view of the envelope of the rotating propeller of FIG. 30.

The penetration/piercing angle of attack alpha of the front part of the profile of the propeller is half of the angle of attack at which the propeller pierces and cuts into the fluid at its beginning and center. Unless there is a driveshaft at the front side, it is preferred that the front point or tip and the alpha angle would be as sharp as possible for the best penetration. The angles in the illustrations are examples for these variants.

Generally, it is preferred that in the case of the propeller the penetration angle starts gradually at 0 degree at the center and then it increases gradually (as measured at the end of the shoulder or before end of the elongation but it is also relative or based on design, needs, requirements, etc.) to 20 to 35 degrees for very fast speed versions; to 35 to 50 degrees for fast speed and general purpose, medium speed versions, and so on; with the extreme limits of 10 degrees to 70 degrees for alpha and a maximum of 80 degrees for the angle beta. In extreme high speed versions, the alpha angle can be as low as 5 degrees.

For simpler and for fast versions, of streamlined outline, the angles alpha and beta at the front, and then at the back, gamma and delta angles may be equal respectively and undistinguishable (that is, alpha can be same as beta and gamma can be same as delta). But for some applications for wider propellers or of larger volume the outline is more complex and the two pairs of angles will be more distinct from each other.

Figure 23:
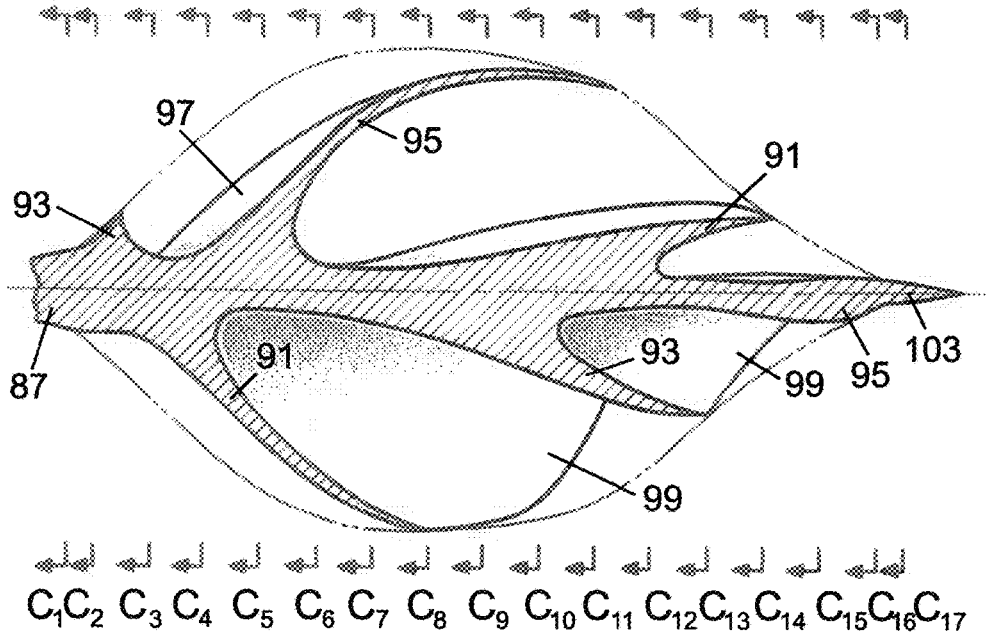
FIG. 23 is a cross-sectional side view of the propeller of FIG. 19 taken through a vertical plane extending through its axis of rotation.

The particular outline view for propeller 11 is shown in FIG. 5B, while the particular outline view for propeller 85 is shown in FIG. 23.

The simple transversal cross-sections of the propeller, as those used in the illustrations presented here, are perpendicular to the propeller's longitudinal axis and therefore are more elongated or oval since the propelling angle or the cutting edge or the channel is at an angle to the longitudinal axis of the propeller, of even 45 degrees.

However, for design and manufacturing purposes, to better understand and to describe more accurately the flow inside the winglet or the channel, the transversal cross-section view of the winglet is preferred to be represented (also) in a true cross-section that is perpendicular to the propelling angle/helix or to the cutting edge.

Such a view is made from individual transversal cross-sections which are arranged together in one composite illustration—one for each winglet and then turned around to the illustration plane (for instance to 45 degrees where the angle of attack or the helix is at 45 degrees). Such a view represents more accurately the desired (or the real) shape and curvature of the winglet.

Figure 17B:
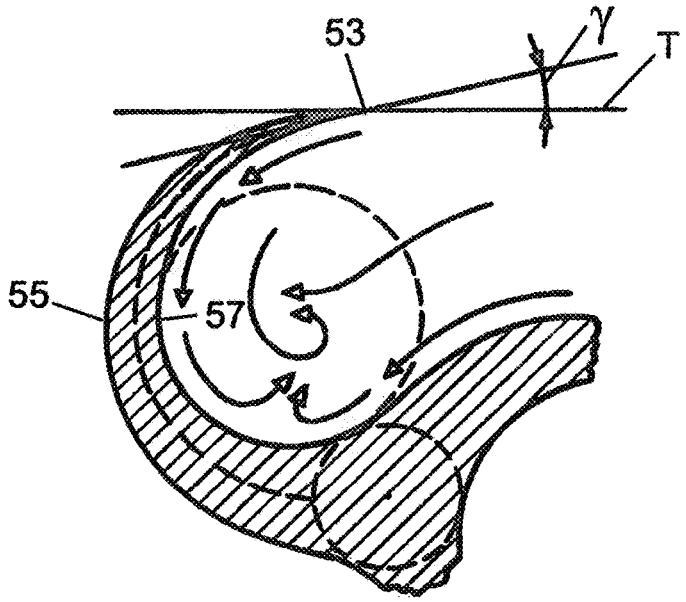
FIG. 17B and FIG. 17C are examples of cross-sections perpendicular to the angle of attack.

FIG. 17B represents such a cross-section which also shows how the flows combine and unite within the channel with the components already discussed in FIG. 17A, the sectioning being taken at the intake segment but very close to the retention segment.

Figure 17C:
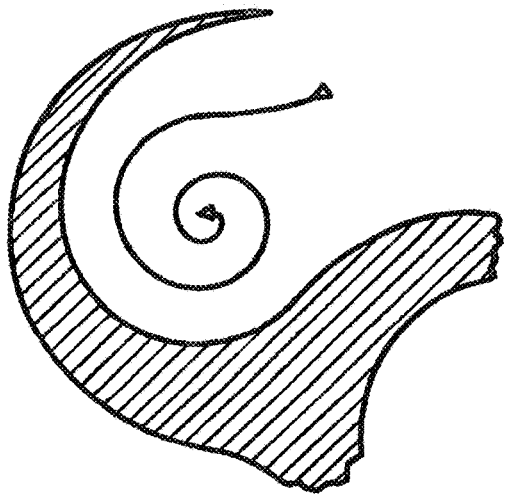

The purpose and aim of the ideal design is to create such a curvature, for the specific given task and conditions of the particular winglet or propeller, in which the resulting compound combination of the incoming flows (straight and diagonal) in their synchronization develops into a smooth single rotating flow that is the most efficient way of transporting water inside each channel, as shown in FIG. 17C. This flow at the same time is directed straight backwards.

Therefore it is desired that as the winglets begin to curve, starting at the segment B, and continuing in segment C, the inside wall of the channel is as rounded as possible at the root (where it is attached to the axle), when possible, as in the case of the three winglet designs. When the number of winglets increases there is less space at the root and therefore less roundness possible, Further on starting with segment D and then as the channel decreases in size, toward the exit it, is preferred that the interior roundness at the root (at the base) should change into a narrowed shape so that the individual twisting inside the channel is restricted and will cease with the result that the flow will be stabilized from rotating and sent straight backwards without any rotational movement. A major problem of propellers of the prior art is that they create conditions for cavitation, this being, first, peripheral cavitation at the tips of the of the blades, and, second, cavitation at the back of the blades, this due to the fact that the blades cut perpendicularly through the water in a sudden movement relative to the stationary fluid. The water experiences an abrupt effect or encounter, enhanced by the high peripheral speed of the propeller at its tips compared to the rest of the blade body. Cavitation restricts the maximum rotation rate of the propeller, because above a certain level of revolutions per minute, cavitation begins, resulting in noise, vibration, even chipping of the metal blades themselves and therefore potentially mechanical damages of the propeller.

The propeller here shown can be operated at rotational speeds of 30,000 rpm or higher without cavitation, which allows the propeller to have a relatively smaller longitudinal cross-section while still being able to produce a large amount of thrust to the vessel. It also results in a more energy efficient propulsion of the vessel. Additionally, in contrast to prior art propellers, the efficiency of the propeller of the design presented here actually increases with the increasing of the rotational speed.

Figure 18:
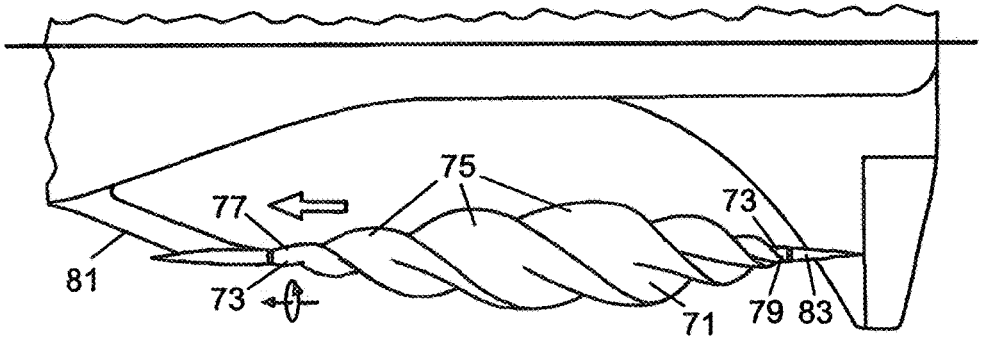
FIG. 18 is a side view of a floating vessel having a propeller of an alternate embodiment of the invention.

FIG. 18 shows an alternate embodiment of support for another very fast propeller according to the invention. In this embodiment, the propeller 71 has a central shaft 73 and winglets 75. The shaft 73 has both front end 77 and rear end 79 supported on respective pivoting support connections 81 and 83. The propeller 71 is rotated by a drive system similar to the drive seen in FIG. 1 connecting through one or both of these structures 81 and 83.

Figure 19:
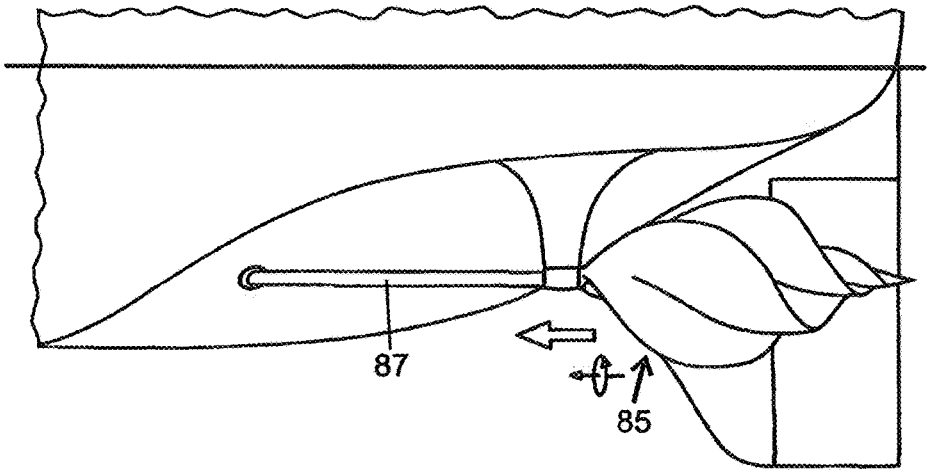
FIG. 19 is a side view of a floating vessel having a propeller of still another alternate embodiment of the invention.

FIG. 19 shows another alternate embodiment of propeller of the invention. Propeller 85 is fixedly mounted on the rear end of a drive shaft 87 connected to and rotated by the motor of the boat, not shown. The propeller 85 is driven so as to rotate clockwise when viewed looking forward.

This propeller 85 is configured for larger volume of fluid and the slower speeds of larger vessels, where usually energy efficiency is sought so as to economize fuel, or regular vessels, and it is shorter and wider than the previous embodiments shown.

This version can be used for fast and medium speed, with a diameter ratio to length higher than the version of the very fast speed propeller 11. While still a performance propeller (but less so than propeller 11) at smaller diameter and high rotational speeds, because of its diameter to length ratio it also allows for a larger diameter construction, and lower rotational speed, and therefore a larger volume of fluid to be propelled in the case of vessels of larger dimensions.

The most efficient propelling of fluid as far as energy or fuel consumption is concerned, is at slowest rotational speed and with the largest possible diameter, but also with the highest torque, when a large volume of fluid is moved slowly and with the least energy imparted, and therefore lost, to the exit flow. However, this very same design/embodiment but of reduced diameter is still capable of very efficient propelling at high and very high rotational speeds without cavitation.

Propeller 85 is of the very same design and principle as propeller 11, and there are just different proportions and ratios between its dimensions or features. Both are of very streamlined construction; however the first embodiment is the most streamlined, therefore capable of higher speed performance.

In the case of propeller 85, the benefits of using the design in a large size at slower speed are that it is very energy efficient, economical and extremely smooth in its forming of flow. Using this configuration of propeller in a smaller size, with a smaller diameter about its longitudinal axis and at a very fast speed, is that it is efficient in attaining very high vessel speeds while still avoiding the flaws of prior art propellers.

Because the propeller 85 is radially wider, the edges of the winglets are farther away and the actual speed of the edges of the blade when rotated is higher. For a prior-art propeller, the higher the speed of water flow, the greater is the possibility of cavitation, which is very undesirable in the propeller environment. Also the wider propeller may create more drag due to its larger external envelope. However, with the embodiment shown, even when constructed with a larger diameter and moving larger volumes of fluid at higher rotational speed of the edges, cavitation still does not occur.

For all top-performance boats that use gas turbines, which can run at around 20,000 rpms or higher, the propeller can be connected directly to a turbine without a need for reducing gears or other torque or speed reducers.

Figure 20:
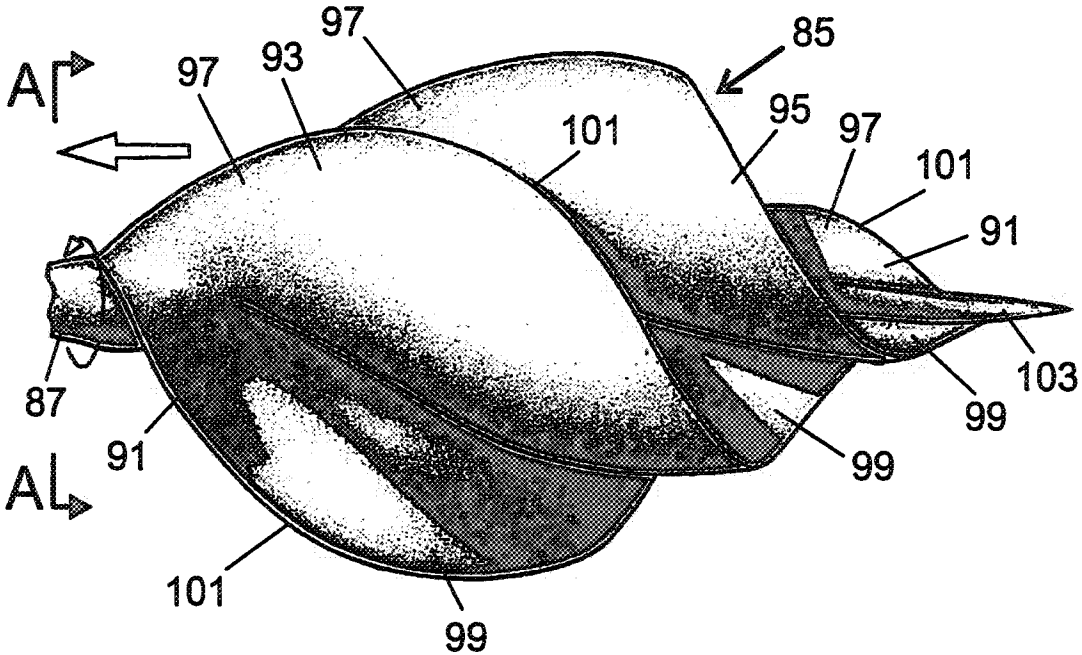
FIG. 20 is a detailed side view of the propeller of FIG. 19.
Figure 21:
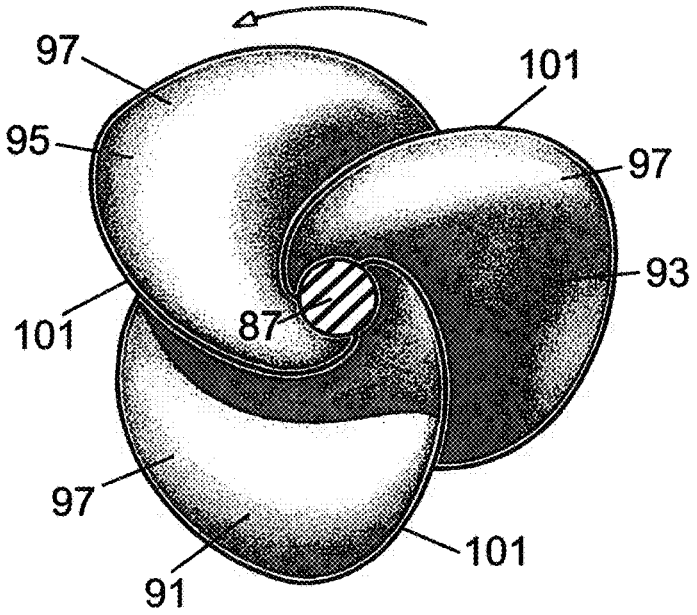
FIG. 21 is a detailed rearward-looking view taken from plane A-A of FIG. 20.
Figure 22:
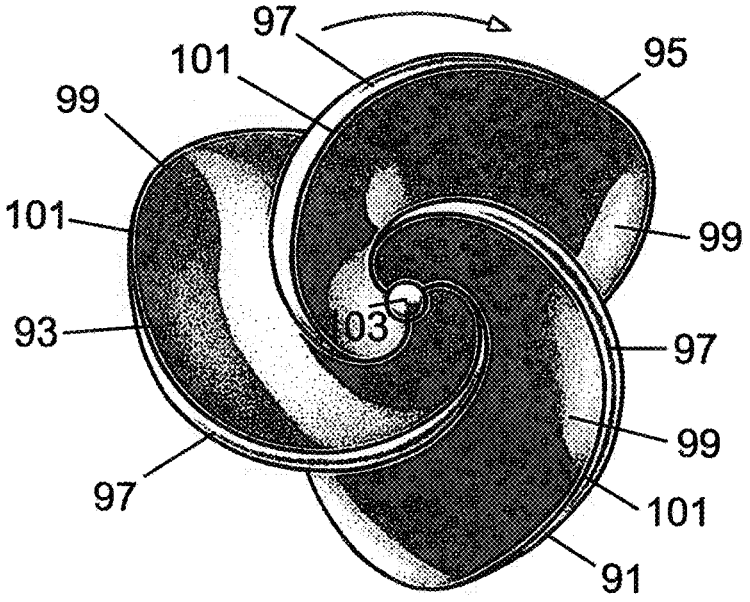
FIG. 22 is a detailed forward-looking rear view of the propeller of FIG. 19.

FIGS. 20 to 22 show the propeller 85 in greater detail. The propeller 85 is a unibody structure as defined above with central shaft 87 supporting three winglets or blade surfaces 91, 93 and 95 thereon, each rotatively staggered or distributed at 120 degrees of rotation about the central longitudinal axis. Each winglet has a respective forward facing surface 97 and a respective rearward facing surface 99 that meet at a generally spiraling edge 101. The winglet 91, 93 and 95 are similar to those of the previous embodiment in that the emerge from the shaft 87, widen radially, and then taper inwardly to merge into the shaft 87 at the rear of the propeller 85, which ends in a sharp longitudinal point 103, which reduces turbulence trailing behind the propeller 85.

Figure 24A:
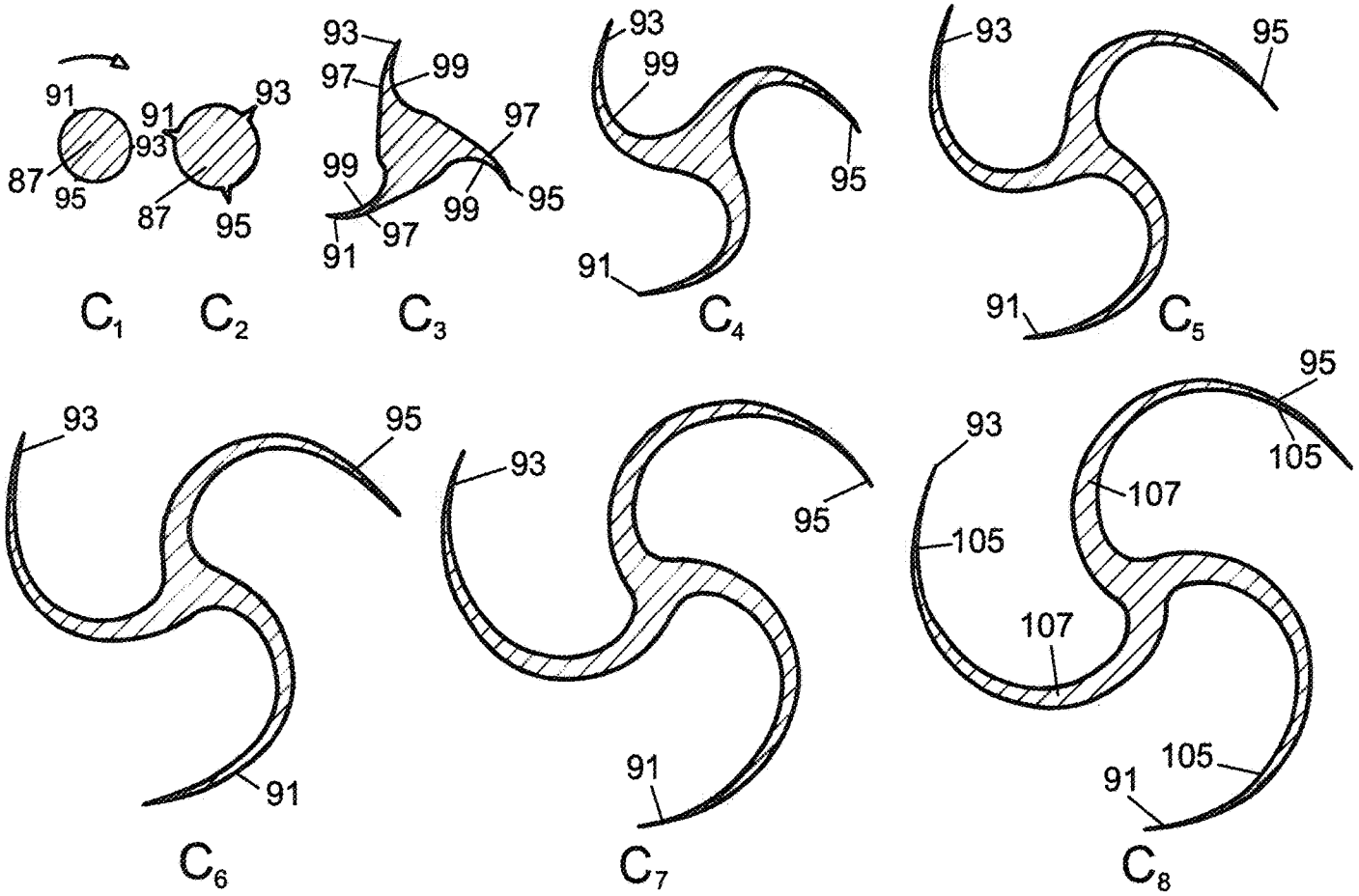
FIG. 24A and FIG. 24B are a series of cross-sections of the propeller of FIG. 23 taken at planes $C_1$ to $C_{17}$ perpendicular to the axis of rotation of the propeller.
Figure 24B:
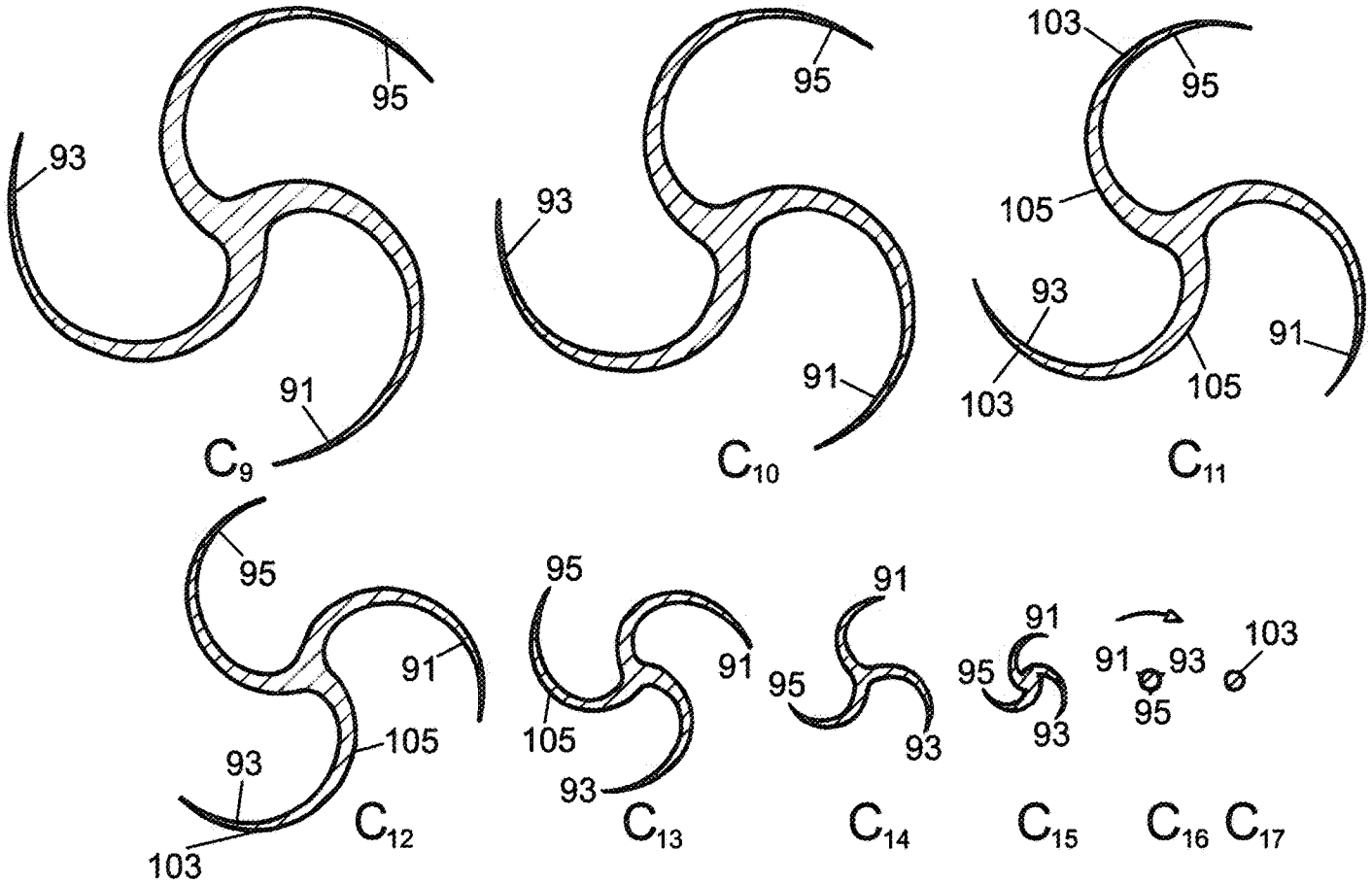

The configuration of the winglets 91, 93 and 95 is best shown in FIGS. 23, 24A and 24B. As with the previous embodiment, the winglets initially begin to extend radially outward and run longitudinally rearward in the forward portion B. As the winglets lengthen radially, they become concave and then begin to spiral in the direction away from their concavity, each defining a respective rear facing channel space.

As with the previous embodiment, rearward of the front portion starts an intake portion, from roughly cross-sections $C_3$ to $C_8$ in FIG. 23. In this intake portion, the winglets increase in length and the cutting angle of edge 101 relative to a tangent circle about the axis of rotation until the outer surface 97 at the edge 101 is tangent to a cylinder around the longitudinal axis. The winglet surfaces are at angles such that the flow of water on the front and rear surfaces 97 and 99 is a substantially cavitation-free conforming flow, with the flow of water passing into the channels and over the forward surfaces 97. The channel space enclosed by the winglets increases monotonically and continuously rearwardly throughout the intake portion.

The lengthening of the winglets continues through a retention portion at roughly sections $C_8$ to $C_9$ (rather to $C_{11}$), where the edge 101 goes from a cutting edge to a trailing edge with water flowing over it out of the channel. The channel remains the same configuration in terms of relative proportions, although the volume enclosed may increase as the length of the winglet and the diameter of the propeller increase. Due to the more abrupt inward tapering of the propeller 85 at its rear portion, the inside surface and even the outside surface at the trailing edge are angulated rearward and inward slightly, allowing exterior flow of water over surface 97 to be directed slightly inward radially at e.g., 5 or 10 degrees to longitudinal. Similarly, the inside surface 99 also directs the flow rearward and slightly inward.

The radially inward angle is only relative to the longitudinal direction. From the cross-section normal to the longitudinal axis at $C_8$ or $C_9$ in FIGS. 24A and 24B, it can readily be seen that adjacent the edge 101 ends with the transverse cross-section of the outer surface 97 at about 0 degrees to the tangent to a cylinder about the longitudinal axis at that point. This maintains conforming flow while the propeller rotates, and also retains the water in the channel against centrifugal loss in this retention portion. The winglets extend beyond an arc of 180 degrees to include an extended portion 105 that essentially has an arcuate curvature with a radius equal to the radial distance to the longitudinal axis of the propeller, instead of curving around a curve approximating an arc with a radius of the enclosed passage, as in the radially inward portion 107.

In the exhaust portion, seen in cross-sections $C_9$ to $C_{10}$, the radially outward distance to the edge 101 decreases, and the length of the larger-arc-shaped portion 107 of the winglets begins to shorten, reducing the volume in the channel, which propels the water therein rearward, as in the previous embodiment. The elongated larger-arc-shaped portion 107 diminishes with the radial size of the winglets until, at cross-section $C_{14}$, the winglet is simply the curvature of the channel passage, i.e., smaller-arc-shaped portion 107. Rearward of this, the winglets then taper down rapidly to just the shaft at its end 103.

Figure 25:
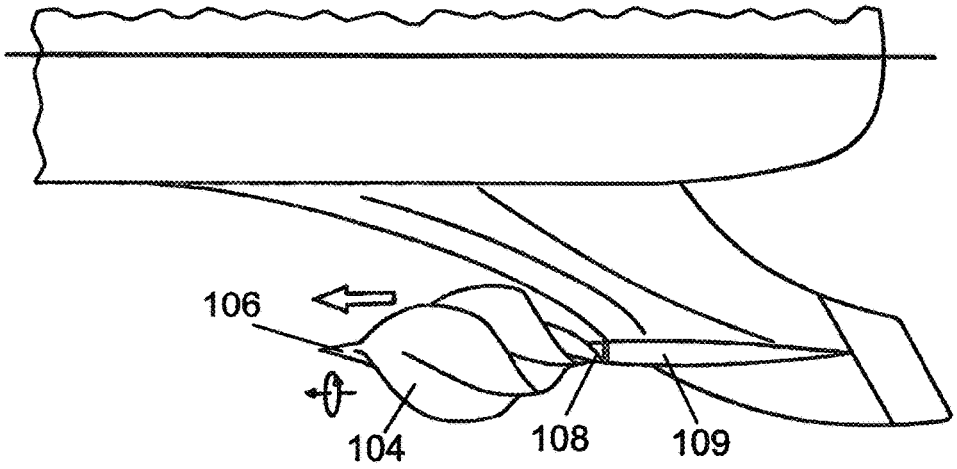
FIG. 25 is a side view of a floating vessel having a propeller of still a further alternate embodiment of the invention.

FIG. 25 shows a variant of the embodiment of FIG. 19, wherein the propeller 104 is supported by a rotating drive shaft structure 109 connected with the rear end of the central shaft 108, in a configuration similar in general to FIG. 1. The front end of the propeller 104 is provided in this embodiment with a pointed end 106, similar to end 23 of propeller 11, that pierces into the water without turbulence.

Figure 26:
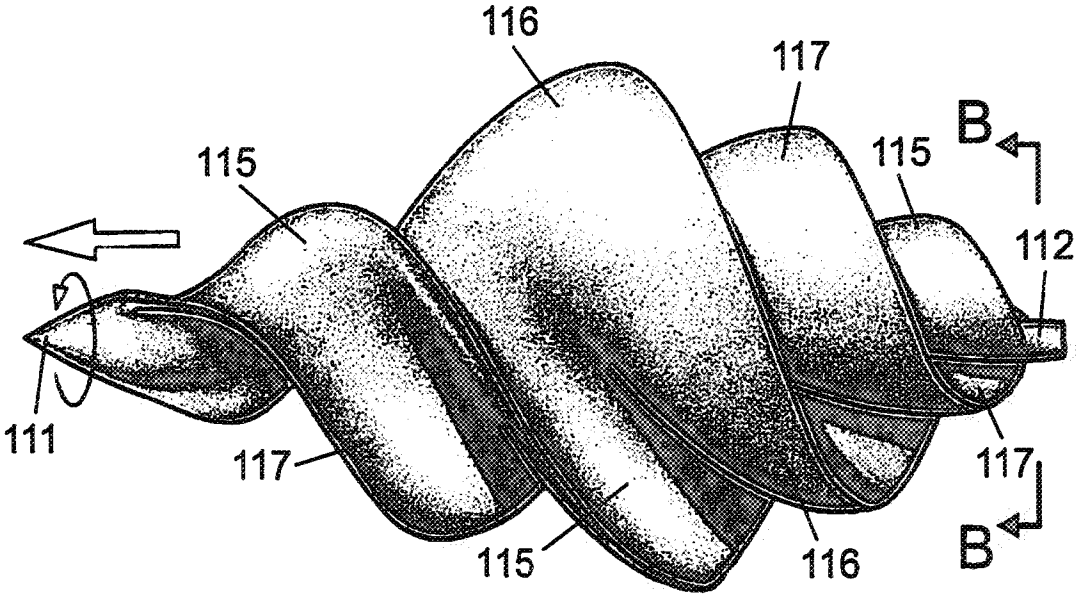
FIG. 26 is a side view of still another embodiment of propeller system according to the invention.
Figure 27:
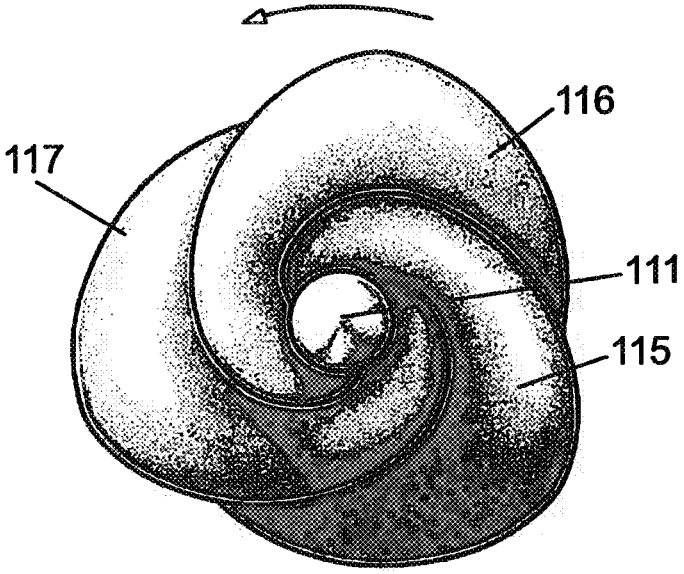
FIG. 27 is a rearward-looking front view of the propeller of FIG. 26.
Figure 28:
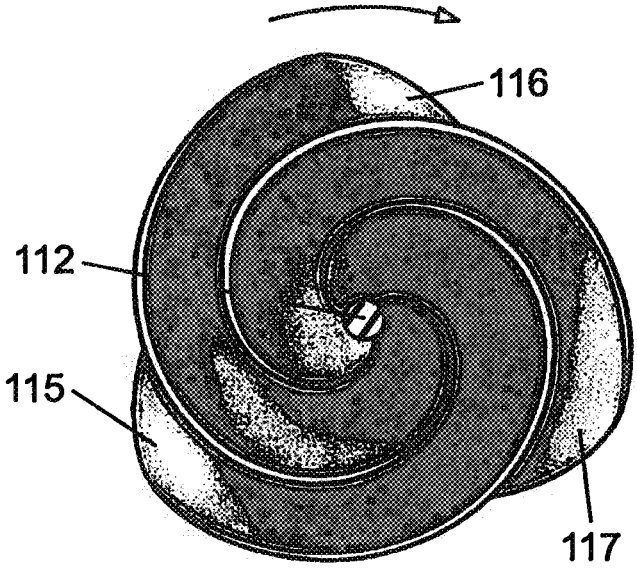
FIG. 28 is a forward-looking rear view of the propeller of FIG. 26 taken from plane B-B.
Figure 29:
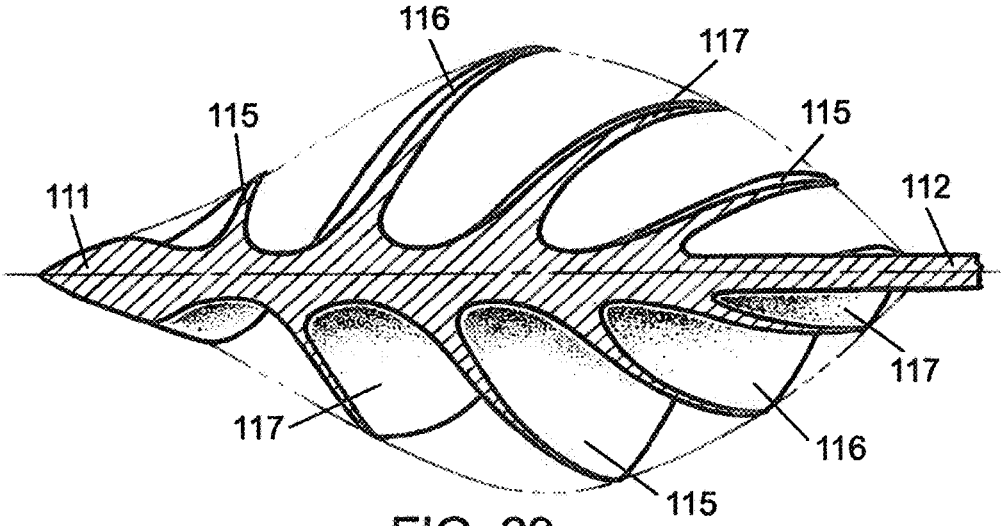
FIG. 29 is a cross-sectional view of the propeller of FIG. 26 along its longitudinal centerline.

FIG. 26 is a side view of still another embodiment of propeller system similar in many ways to propeller 85, with similar characteristics and performance. FIG. 27 is a front view and FIG. 28 is a forward-looking rear view taken from plane B-B of FIG. 26. FIG. 29 is a cross-sectional side view with an outline of propeller of FIG. 26 taken through a vertical plane extending through its axis of rotation.

Working similarly to propeller 85, the propeller 110 has a tip 111 that pierces the water at its front end, and winglets 115, 116 and 117, which are all supported on and driven by shaft 112, which is connected to a drive system (not shown). The propeller 110 is driven so as to rotate clockwise when viewed looking forward. The propeller 110 has an outward envelope contour that is more gradual than the previous embodiment.

Figure 31:
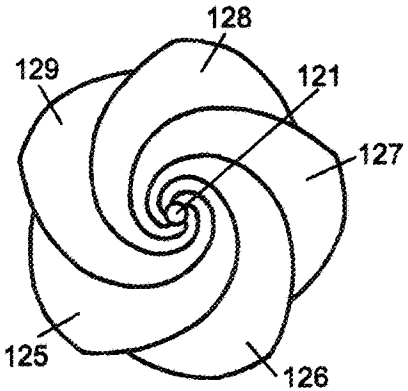
FIG. 31 is a front view of the propeller system shown in FIG. 30.
Figure 30:
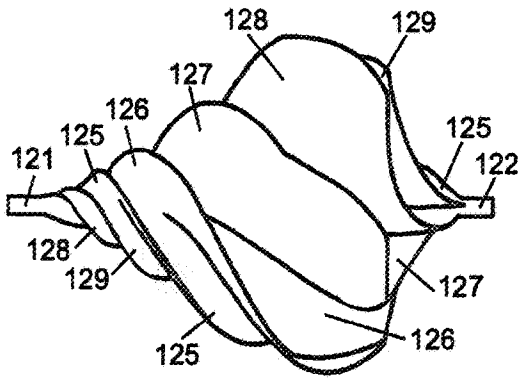
FIG. 30 is a side view of another embodiment of propeller system.
Figure 33:
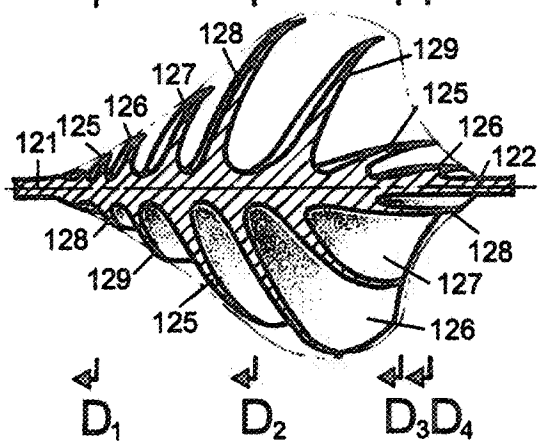
FIG. 33 is a cross-sectional view of the propeller system of FIG. 30 along its longitudinal centerline.
Figure 32:
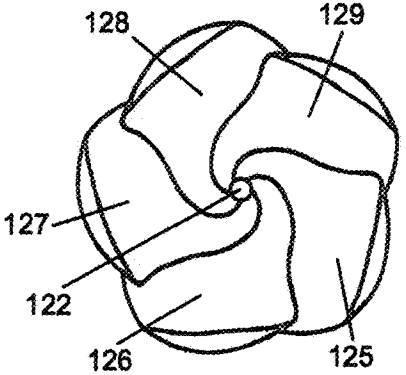
FIG. 32 is the rear view of the propeller system shown in FIG. 30.
Figure 34:
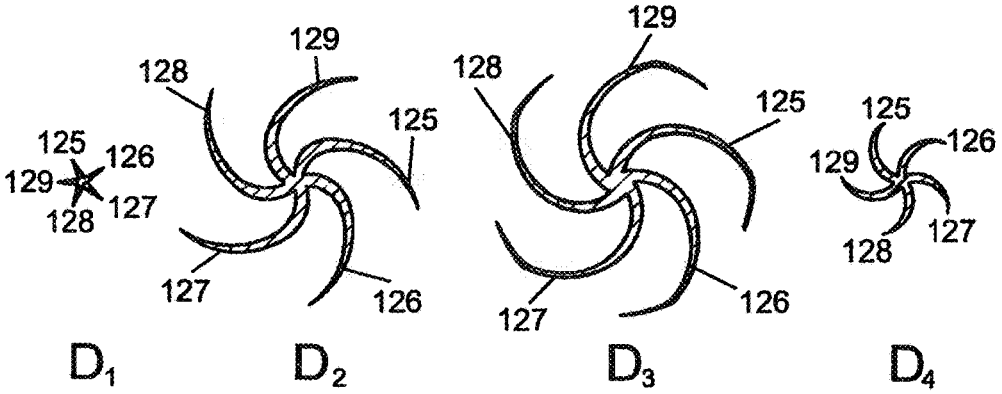
FIG. 34 is a series of cross-sections $D_1$-$D_4$ of the propeller system of FIGS. 30 to 33.

FIG. 30 is a side view of another embodiment, a five winglet propeller with a conical entry portion that slopes outward at approximately 45 degrees. The propeller has a larger diameter and a more abrupt outline (or penetration and ending angle). This propeller is a medium speed version that can be used for heavy work, with a larger diameter and a shorter length than the previous embodiments, configured less for speed than for high torque. FIG. 31 is a front view and FIG. 32 is a rear view of the embodiment. FIG. 33 is a cross-sectional side view with outline taken through a vertical plane extending through its axis of rotation. FIG. 34 shows cross-sections at planes $D_1$-$D_4$ of the propeller. Working on principles similar to those of propeller 85, this embodiment has a shaft 121 at the front of which the winglets 125, 126, 127, 128 and 129 are all supported the rear shaft 122. Any of these shafts can be connected to the drive system and the propeller is driven so as to rotate clockwise when viewed looking forward.

Figure 35:
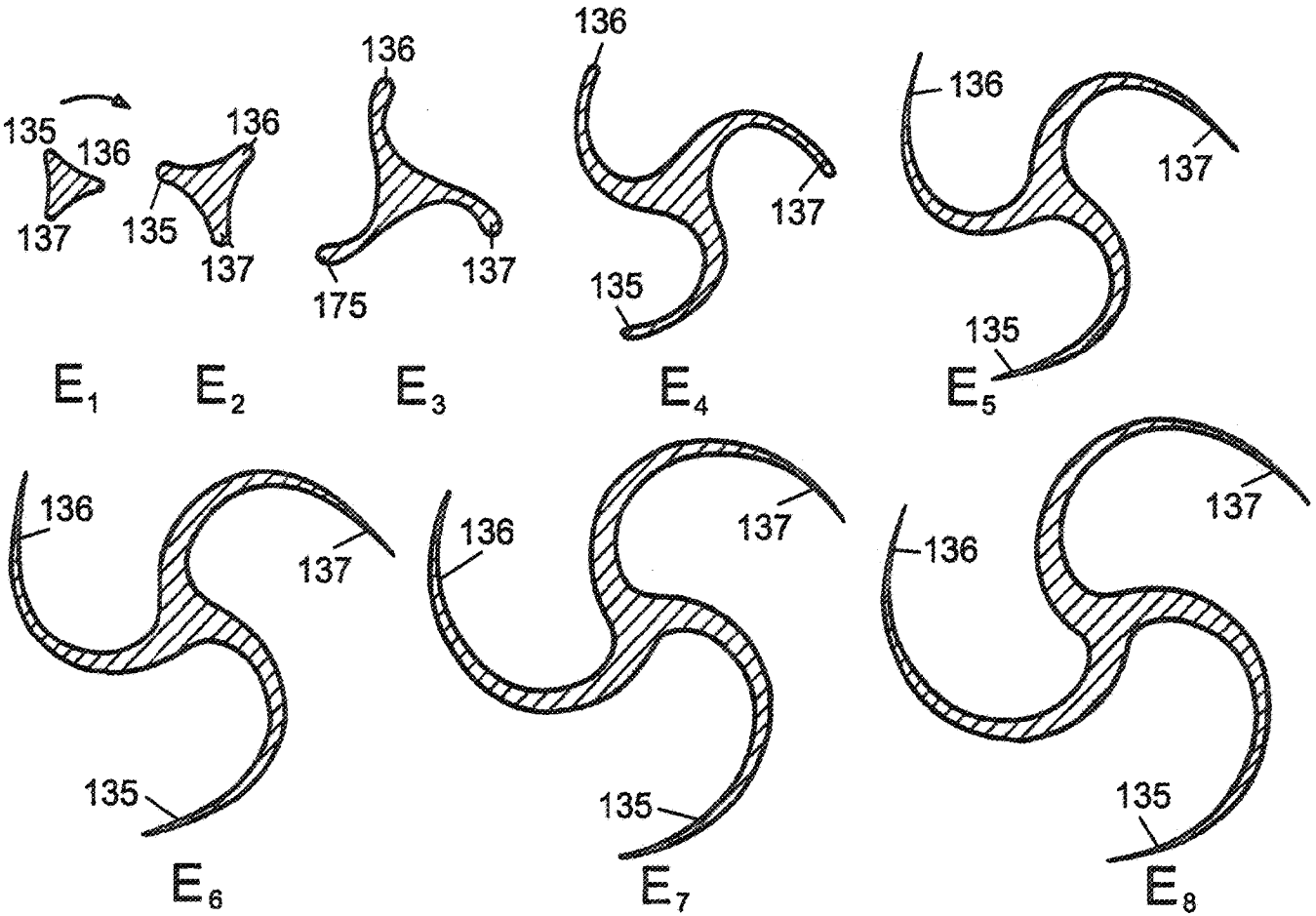
FIG. 35 is a series of cross-sections $E_1$-$E_8$ of another embodiment of propeller with thickened walls of the winglet at its forward end.

FIG. 35 shows the cross-sections in planes $E_1$-$E_8$ of another embodiment that is a structural variant of propeller 85. All parts and dimensions of the embodiment are substantially the same as in propeller 85, for purposes mainly of better equalization of the fluid and pressure there is a slight bulging of the wall at its outer edge. The cross-sections $E_1$-$E_4$ show the evolution of the wall thickening for winglets 135, 136 and 137. From cross-section $E_5$ rearward, the wall structure has essentially the same structure as propeller 85. The propeller is driven so as to rotate clockwise when viewed looking forward.

Figure 36:
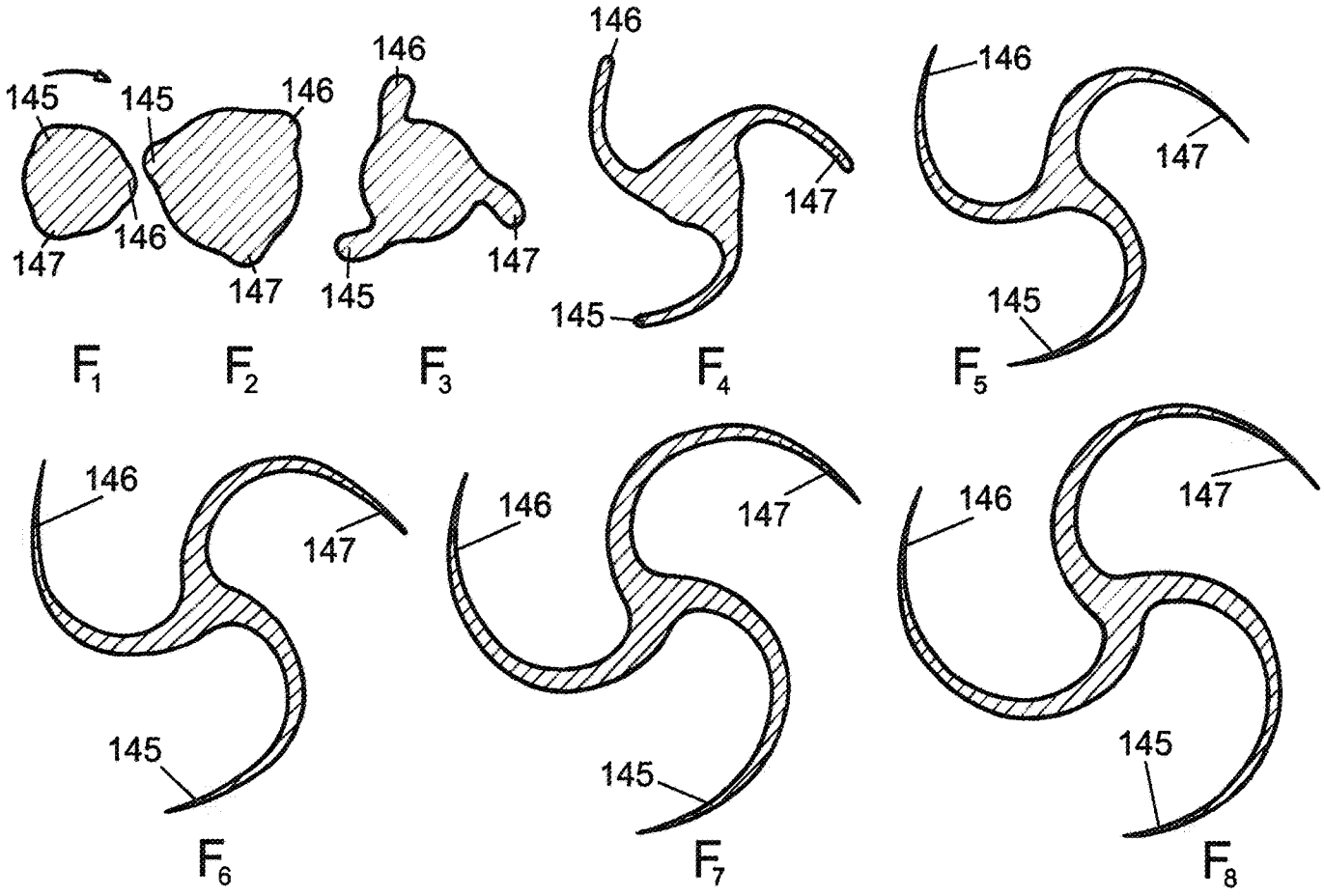
FIG. 36 is a series of cross-sections $F_1$-$F_8$ of still another embodiment of propeller, also with thickened walls of the winglet at its forward end.

FIG. 36 shows the cross-sections $F_1$-$F_8$ of still another variant of propeller 85. Everything is similar to the configuration of propeller 85, but the winglet wall is configured to be thicker at its start as shown in the cross-sections. For purposes of equalization of fluid pressure there is a bulging of the wall at its beginning, as seen in cross-sections $F_1$-$F_4$ show the evolution of the wall thickening for winglets 145, 146 and 147. From cross-section $F_5$ rearward, the propeller structure winglets are similar to propeller 85, with relatively sharp trailing edges.

Figure 37:
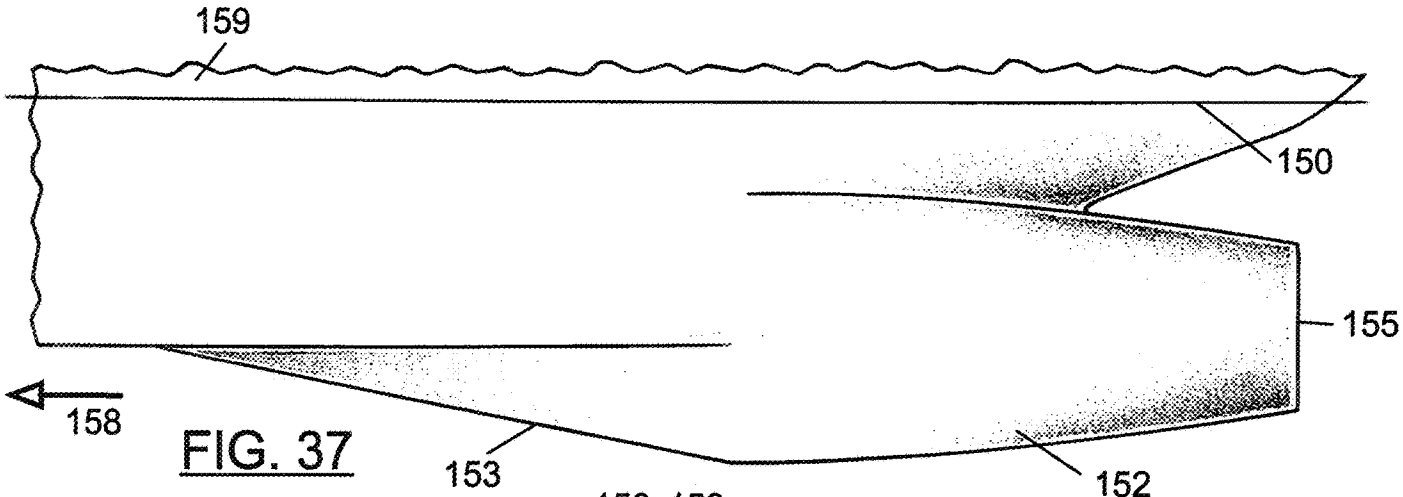
FIG. 37 shows a side view of another embodiment of propeller system with a propeller in a waterjet configuration.

FIG. 37 is the side view of still another embodiment of propeller system for a propeller configured similarly to propeller 11, housed in a waterjet configuration for high speed or general purpose. This environment houses a three winglet propeller such as propeller 11, with the main propelling angle at 45 degrees. The structural housing for the propeller has all the components of a typical waterjet set up, i.e., an intake opening, built-in construction and aft stabilizing or correcting blades or vanes, among others, all in the proper adaptation for a propeller configured like propeller 11, with a longer profile and for use at higher rotational and advancing speeds.

Figure 39:
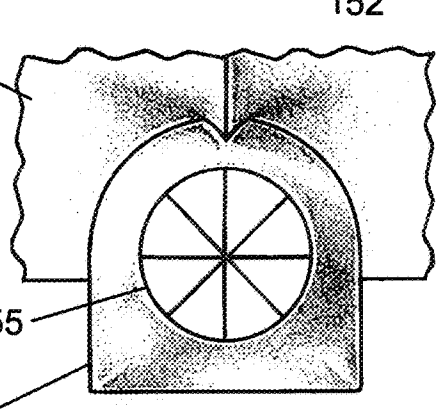
FIG. 39 is a rear view of the propeller system shown in FIG. 37.
Figure 38:
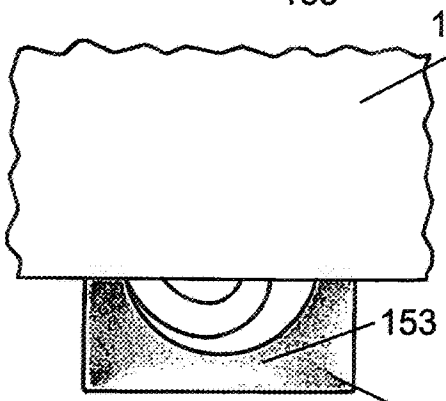
FIG. 38 is a front view of the propeller system shown in FIG. 37.
Figure 40:
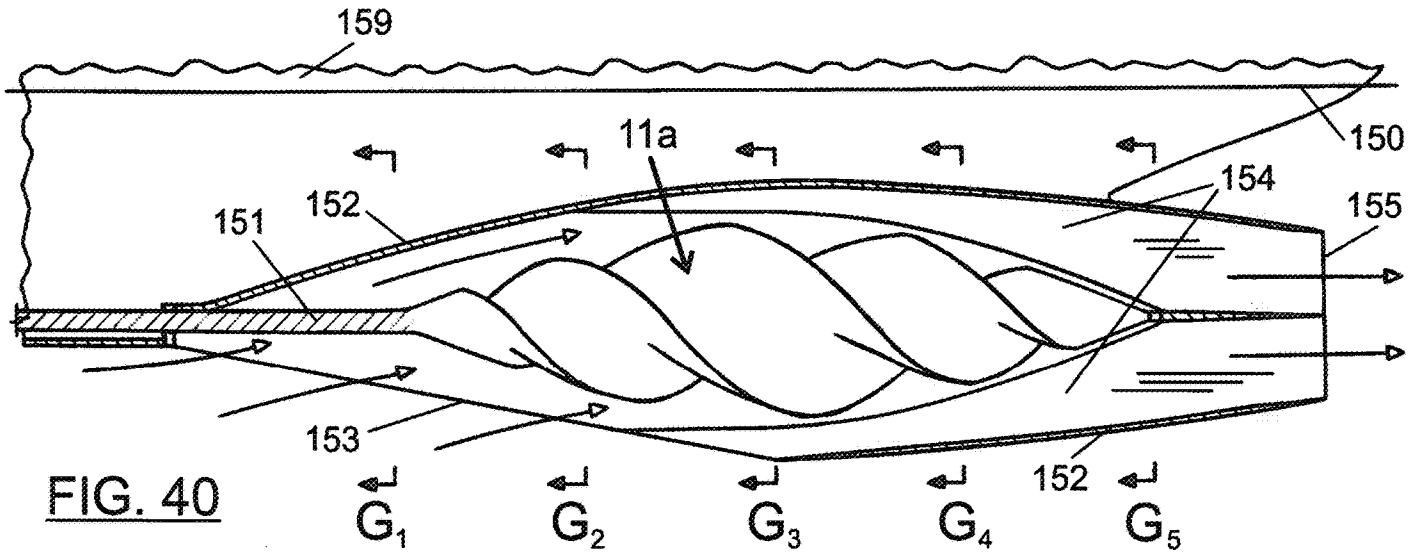
FIG. 40 is a cross-sectional view of the propeller of FIG. 37 along its longitudinal centerline.
Figure 41:
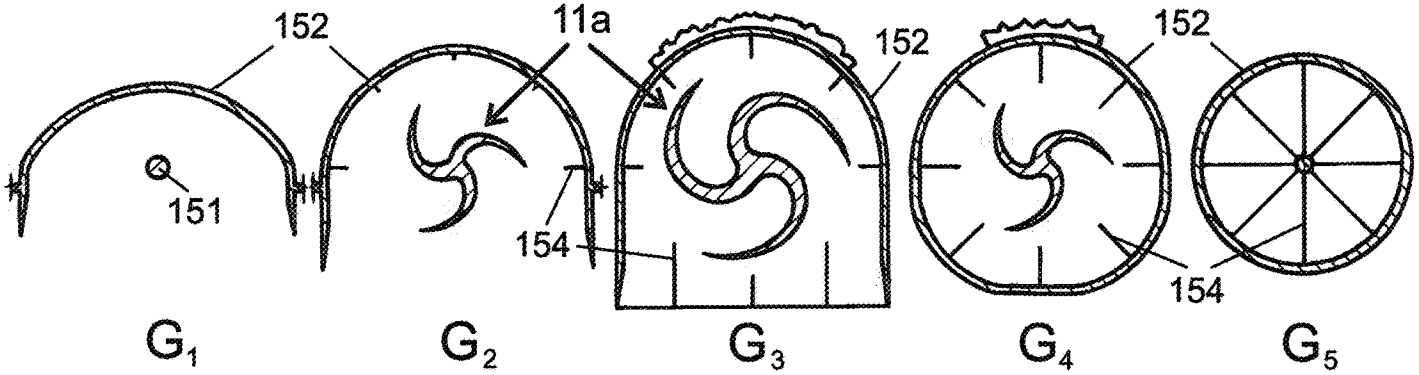
FIG. 41 is a series of cross-sections $G_1$-$G_5$ of the propeller of FIG. 37.

FIG. 38 is a front view and FIG. 39 is a rear view of the embodiment of FIG. 37 showing the inside of the generally tubular interior passage of the water jet structure. FIG. 40 is a cross-sectional view taken through a vertical plane extending through the axis of rotation of the propeller. FIG. 41 shows cross-sections of the propeller and surrounding structure of FIG. 37 at the planes $G_1$-$G_5$ perpendicular to the rotational axis of the propeller, as shown in FIG. 40.

As best seen in FIGS. 37 and 40, a vessel 159 floating in water 150 to move in direction 158 has a waterjet enclosure 152, with intake opening 153 at its front and exit outlet 155 at its rear end. Within enclosure 152, the structure of the waterjet system comprises propeller 11*a*, which differs from the propeller 11 (see FIG. 1) in that it is supported rotatively at both its front and rear ends, and does not have a point at its front end, but is connected to shaft 151 and through it also to a drive system positioned ahead of the propulsion compartment. The rear end of the propeller 11*a* is supported for free rotation in the rear portion of the waterjet enclosure 152. The propeller 11*a* is driven so as to rotate clockwise when viewed looking forward.

Water is absorbed through the intake 153 by the propeller 11*a* by its rotation and is stabilized by the eight stabilizing vanes 154, which at the end also direct the exiting flow rearwardly, which is propelled through the exit outlet 155 and propelled straight to the back.

Figure 42:
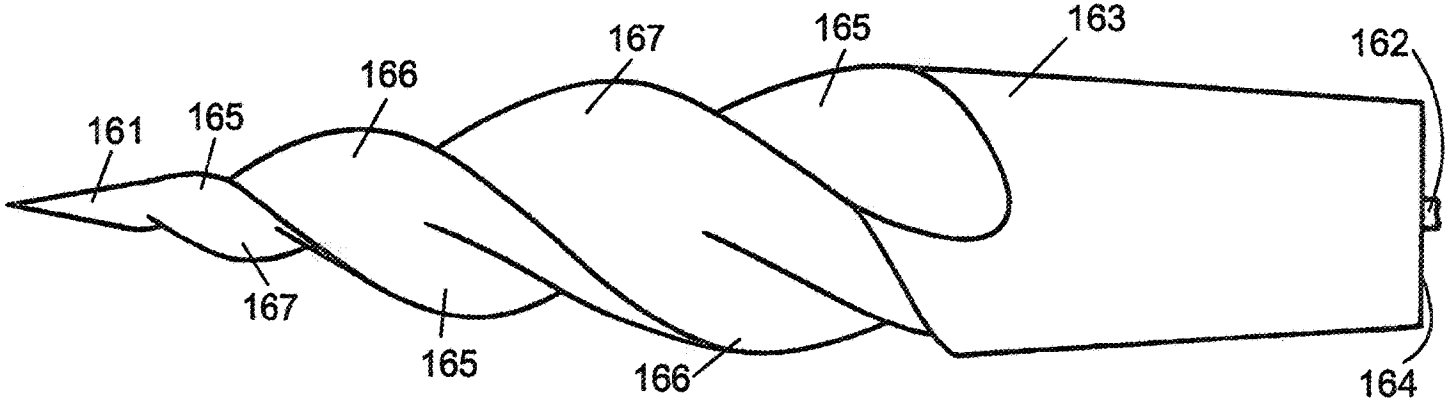
FIG. 42 is a side view of still another high speed embodiment of propeller, with an intubation.

FIG. 42 is the side view of another embodiment of propeller, which is a very high speed or ultra-high speed variant of a three winglet propeller similar to propeller 11 of FIG. 1, with a main propelling angle at 45 degrees, but with an intubation 163.

The propeller of FIG. 42 is structurally similar to propeller 11, but at its rear portion intubation 163 is attached, starting at the approximately the point of the largest diameter of the winglets 165, 166 and 167 and rearward therefrom so as to aid in directing the rearward expulsion of water from the propeller. The intubation is a rearwardly tapering truncated cone that forms a round channel or tapering conical inner passage in which all the individual flows from the winglets are combined. The intubation structure 163 at the same time maximizes the concentration of the exit flow to the smallest cross-section possible through the exit outlet 164. The outer surface shape of a tapering truncated cone also reduces even more any drag, making the impelpropeller structure even more streamlined and therefore maximizing the overall performance of the propeller 11.

Intubation 163 has a gradual intake opening defined by a sharp leading edge. The intubation conforms and adapts to the shape of the winglets, this in order to create less resistance at the intake openings, and has confirming water flow over the leading edges defining the intake openings. This design is best adapted for very high speeds.

Figure 44:
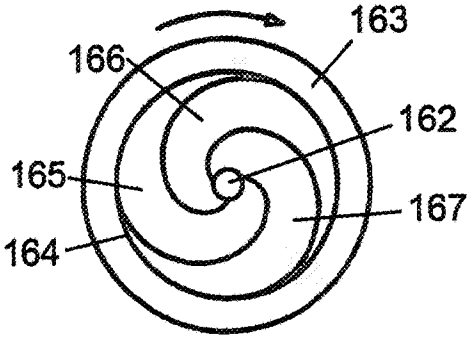
FIG. 44 is a rear view of the propeller of FIG. 42.
Figure 43:
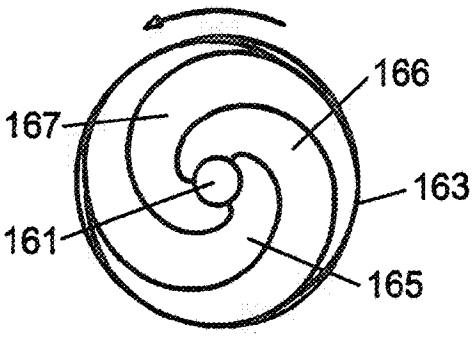
FIG. 43 is a front view of the propeller of FIG. 42.
Figure 45:
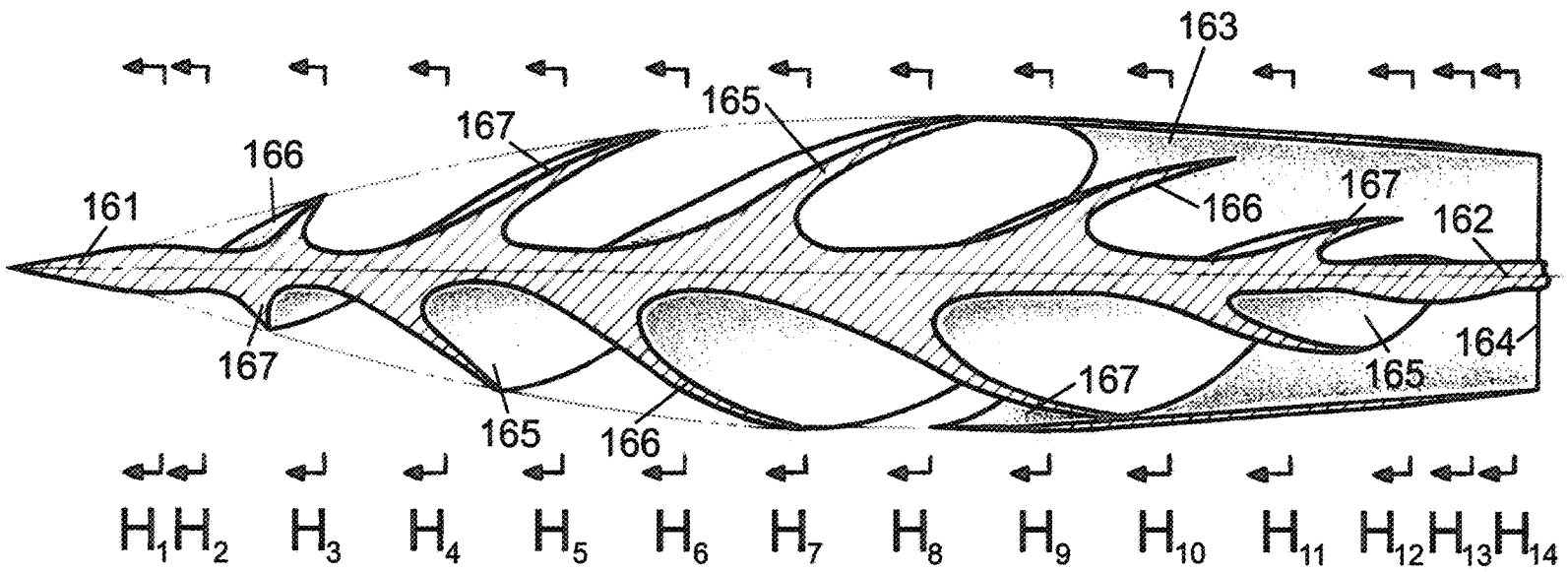
FIG. 45 is a cross-sectional view of the propeller of FIG. 42 along its longitudinal centerline.
Figure 46:
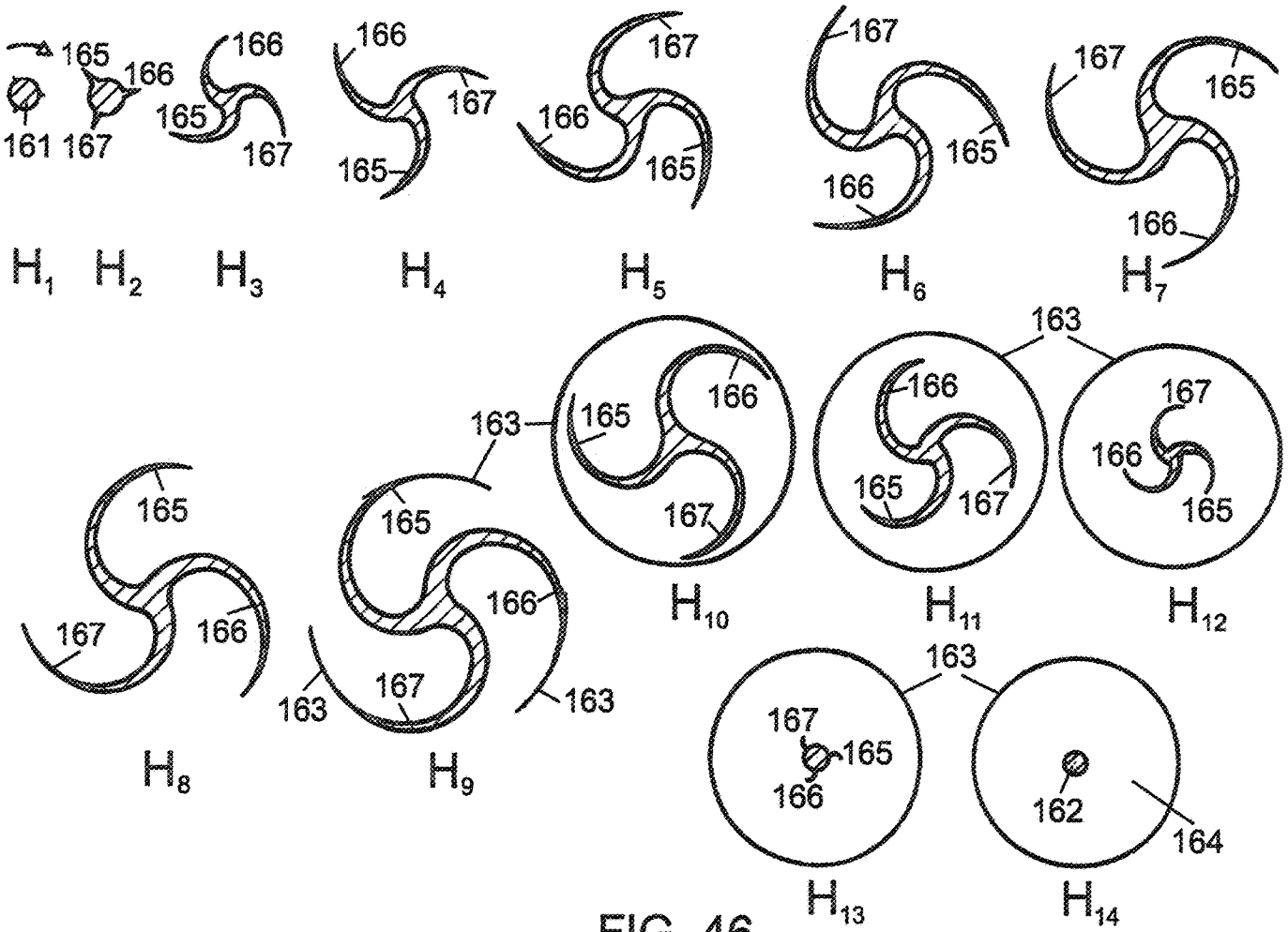
FIG. 46 is a series of cross-sections of the propeller of FIG. 42 at the planes $H_1$-$H_{14}$ in FIG. 45.

FIG. 43 is the front view and FIG. 44 is the rear view of the same embodiment. FIG. 45A is a cross-sectional view with outline taken through a vertical plane extending through its axis of rotation. FIG. 46 shows cross-sections $H_1$-$H_{14}$ which are the same as for propeller 11 but with the addition of the intubation 163. Based on the same structure as propeller 11 of FIG. 1, this embodiment has the front tip 161 and the winglets 165, 166 and 167 which are all being supported by the rear shaft 162 which is connected to the drive system. The propeller is driven so as to rotate clockwise when viewed looking forward.

Figure 47:
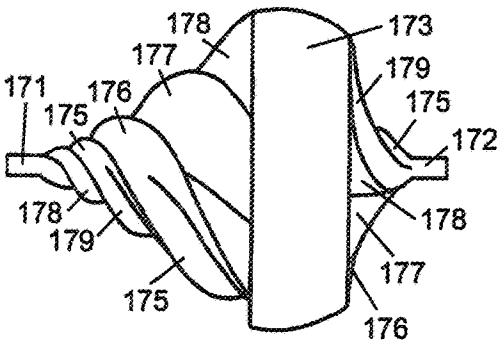
FIG. 47 is a side view of still another embodiment of propeller system that is similar to the propeller of FIG. 30 but with intubation.

FIG. 47 is the side view of still another propeller embodiment similar to the propeller of FIG. 30. It is an example of a five-winglet propeller with a propelling segment angle of 45 degrees, of a larger diameter and with a more abrupt or less acute envelope outline penetration and ending angle, but with a short intubation 173 instead of elongation, of equal length to the elongation of the propeller of FIG. 30. The propeller of FIG. 47 can be used for same duties, and it has a performance similar to that of the propeller of FIG. 30.

Figure 48:
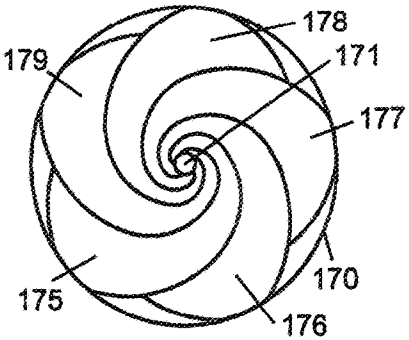
FIG. 48 is a front view of the propeller system shown in FIG. 47.
Figure 50:
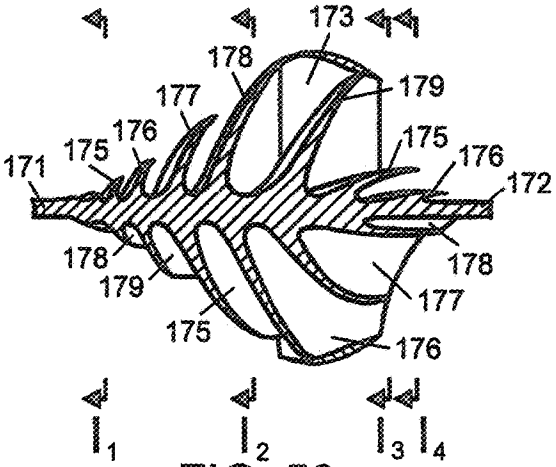
FIG. 50 is a cross-sectional view of the propeller of FIG. 47 along its longitudinal centerline.
Figure 49:
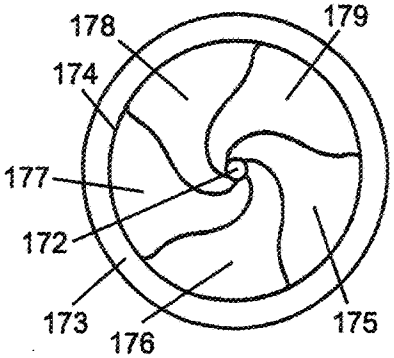
FIG. 49 is the rear view of the propeller system shown in FIG. 47.
Figure 51:
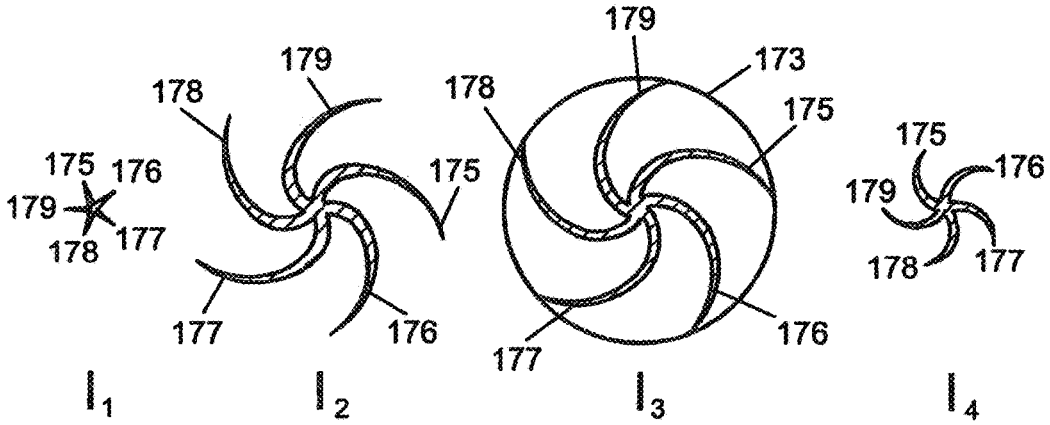
FIG. 51 is a series of cross-sections taken at planes $I_1$-$I_4$ of the propeller of FIG.

FIG. 48 is a front view and FIG. 49 is a rear view of the propeller of FIG. 47. FIG. 50 is a cross-sectional view with an outline taken through a vertical plane extending through its axis of rotation. FIG. 51 shows cross-sections $I_1$-$I_4$ perpendicular to the axis of rotation of the propeller of FIG. 47. The intubation 173 has a round intake opening at its front with a sharp leading edge around it, as well as a round exit outlet at the back 174 with a sharp trailing edge around it. The outer and inner surfaces of the intubation are curved and generally follow the curvature of the outer envelope of the propeller.

Working on the similar principles to those of propeller 85, this embodiment has a front shaft 171 extending through the propeller to the rear shaft 172, on which winglets 175, 176, 177, 178 and 179 are all supported. Either or both of the shafts 171 and 172 are connected to the drive system, and the propeller is driven so as to rotate clockwise when viewed looking forward from the rear.

Figure 52:
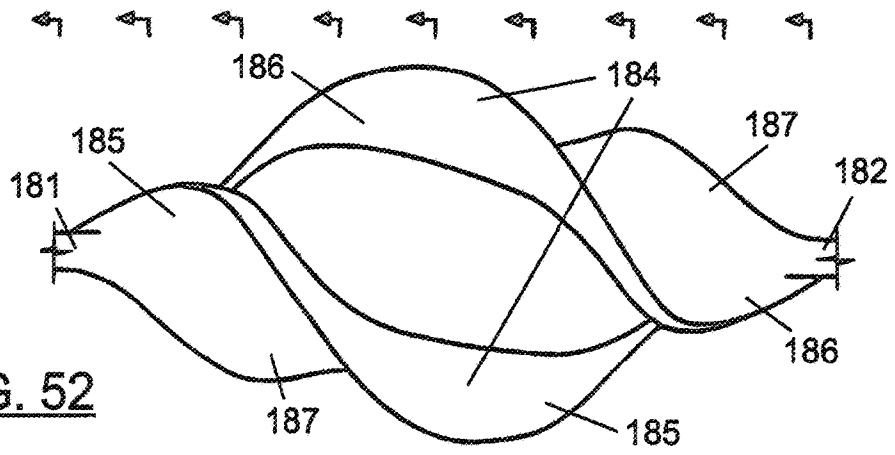
FIG. 52 is a side view of a further alternate embodiment of propeller system that is a reversible embodiment with a 1-section of the winglet edge.

FIG. 52 is a side view of a backwardly and forwardly symmetrical, reversible embodiment of propeller, with a T-section of the winglet edges. This embodiment can be used to drive a vessel in either direction, forward or rearward, and it is designed for either high or regular speed. Since it is rear/forward symmetrical, its efficiency is the same in either direction.

Figure 54:
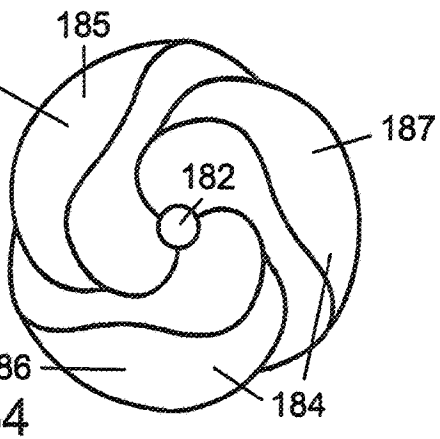
FIG. 54 is a rear view of the propeller of FIG. 52.
Figure 53:
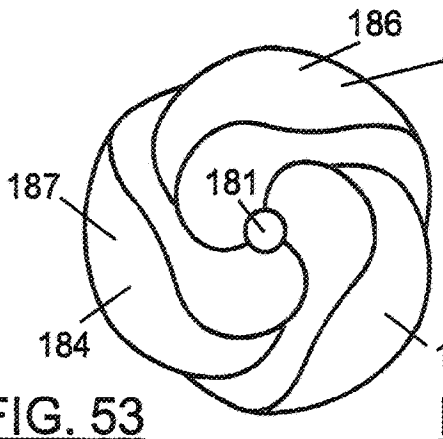
FIG. 53 is a front view of the propeller of FIG. 52.
Figure 55:
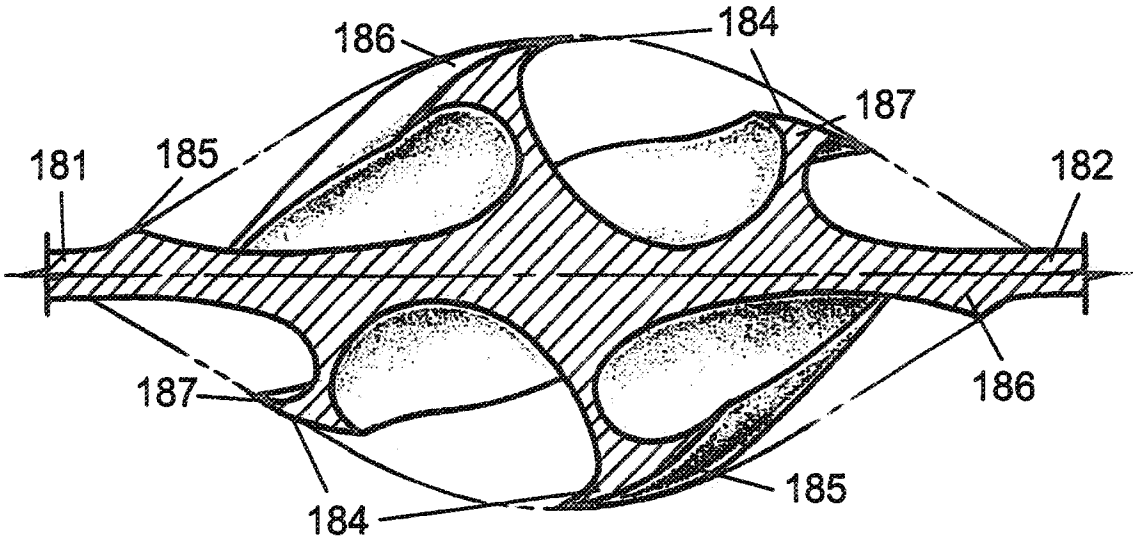
FIG. 55 is a cross-sectional view of the propeller of FIG. 52 along its longitudinal centerline.
Figure 56:
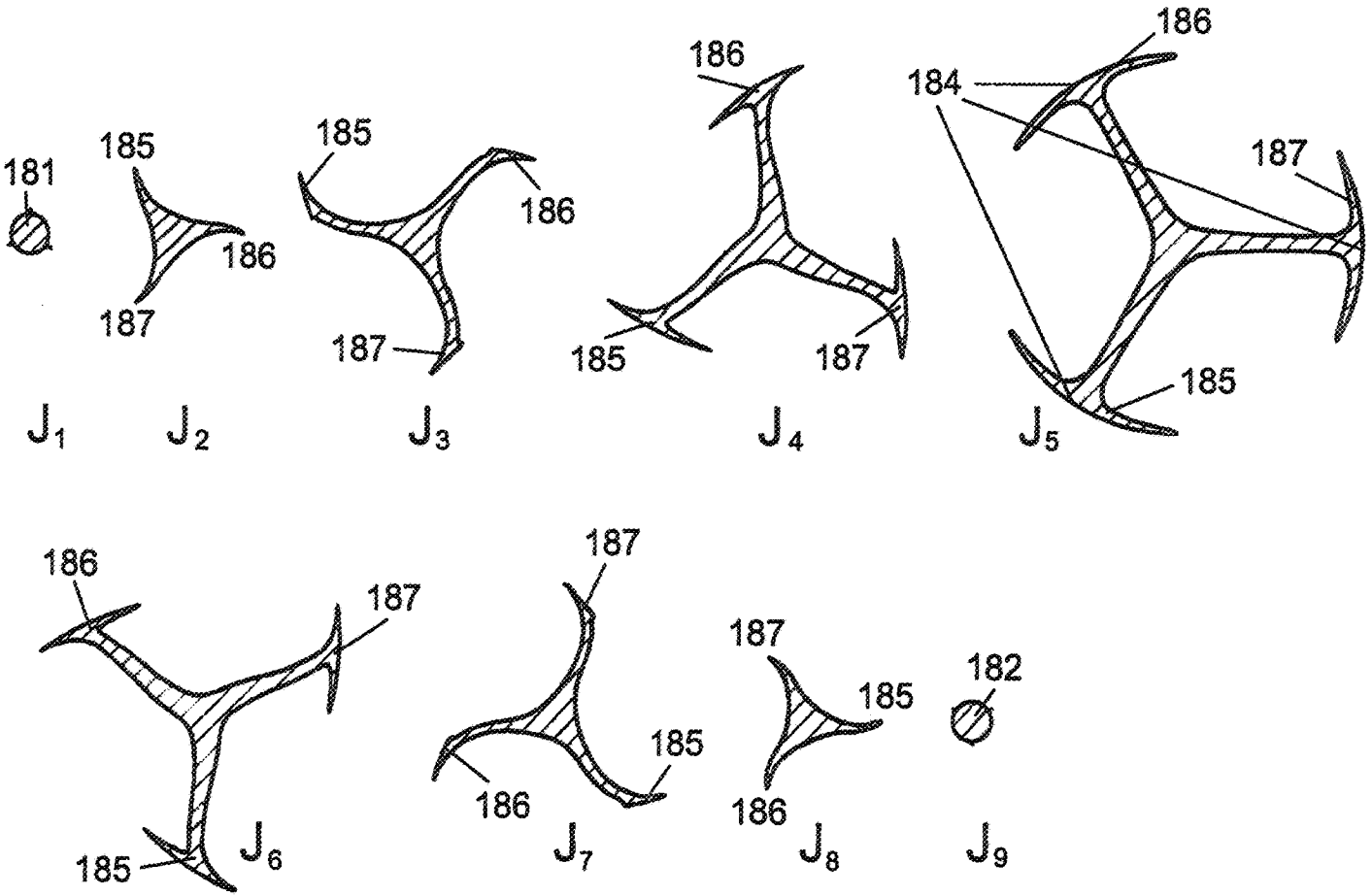
FIG. 56 shows cross-sections of the propeller of FIG. 52 at planes $J_1$-$J_9$.

FIG. 53 is a front view and FIG. 54 is a rear view of the propeller of FIG. 52. FIG. 55 is a cross-sectional view, with the envelope of the rotating propeller as an outline, taken through a vertical plane extending through its axis of rotation. FIG. 56 shows cross-sections $J_1$-$J_9$ perpendicular to the axis of rotation of propeller of FIG. 52.

Winglets 185, 186 and 187 are structured in such way that either half can be directed forward or rearward, and each half is a reflection of the other half. Because the elongation runs (longitudinally) on both sides of the cutting edge, at the center the cutting edge forms a T-section cross-section 184, as best seen in cross-section $H_5$ of FIG. 56, or in the longitudinal cross-section of FIG. 55. The winglets are attached at one end to the shaft 181 and to the shaft 182 at the other, and either shaft can be connected to a drive system.

Rotation can be both ways. For the configuration of winglet structure shown, the advancing (front) end is given by the clockwise rotation of the propeller as looked forward from the other end, and this configuration may be described as a right-hand propeller.

Figure 57:
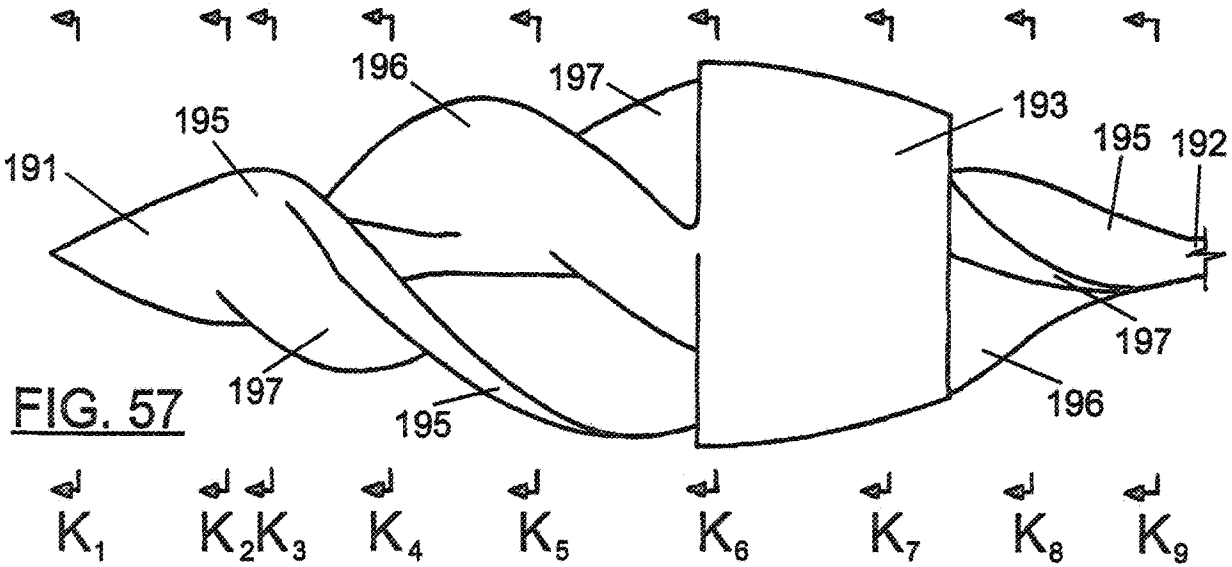
FIG. 57 is a side view of another embodiment of propeller system with a bulbous nose and intubation.

FIG. 57 is the side view of still another embodiment of propeller, a general purpose propeller with a bulbous nose and small intubation, which replaces the elongation of the propeller. This propeller is suited for use at high or regular speed.

Figure 59:
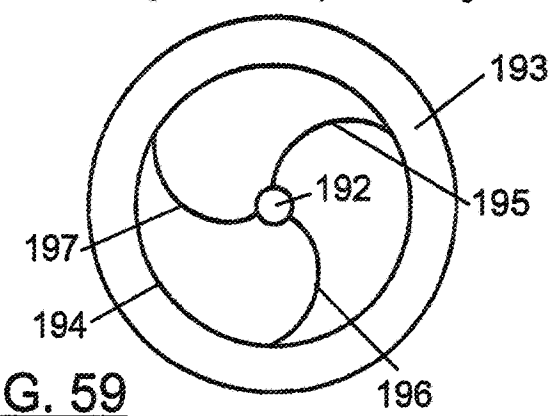
FIG. 59 is a rear view of the propeller of FIG. 57.
Figure 58:
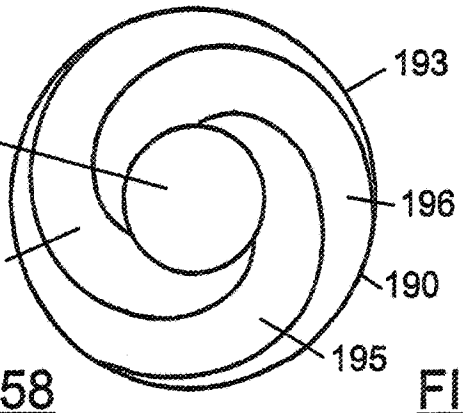
FIG. 58 is a front view of the propeller of FIG. 57.
Figure 60:
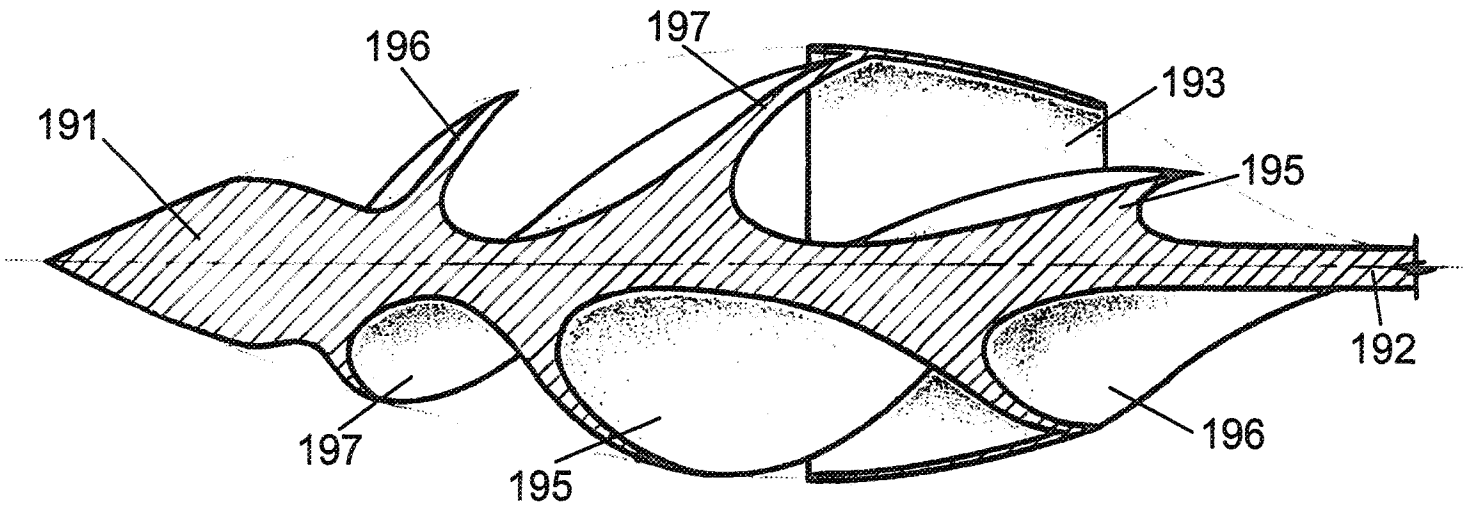
FIG. 60 is a cross-sectional view of the propeller of FIG. 57 along its longitudinal centerline.
Figure 61:
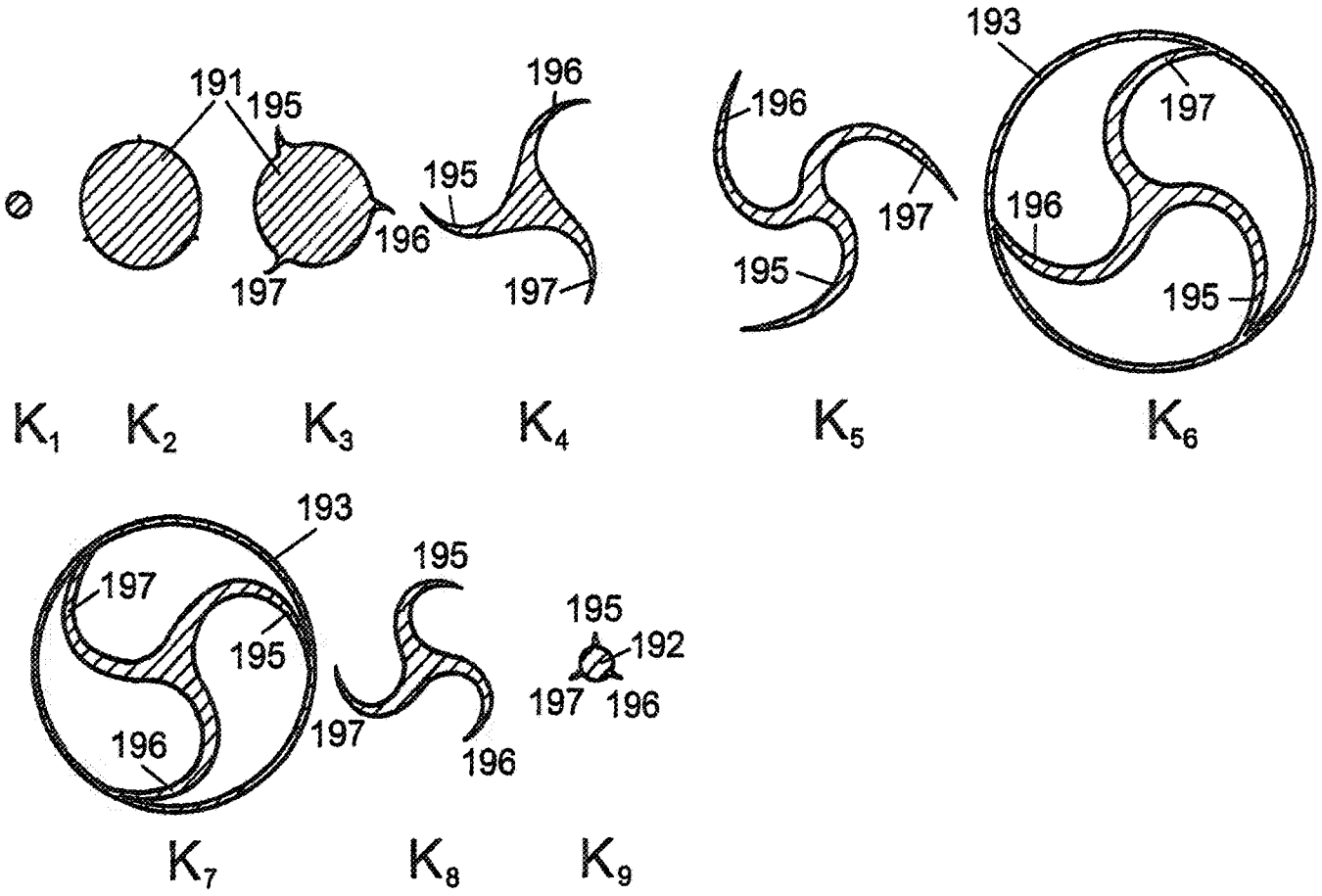
FIG. 61 is a series of cross-sections of the propeller of FIG. 60 at planes $K_1$-$K_9$.
Figure 62:
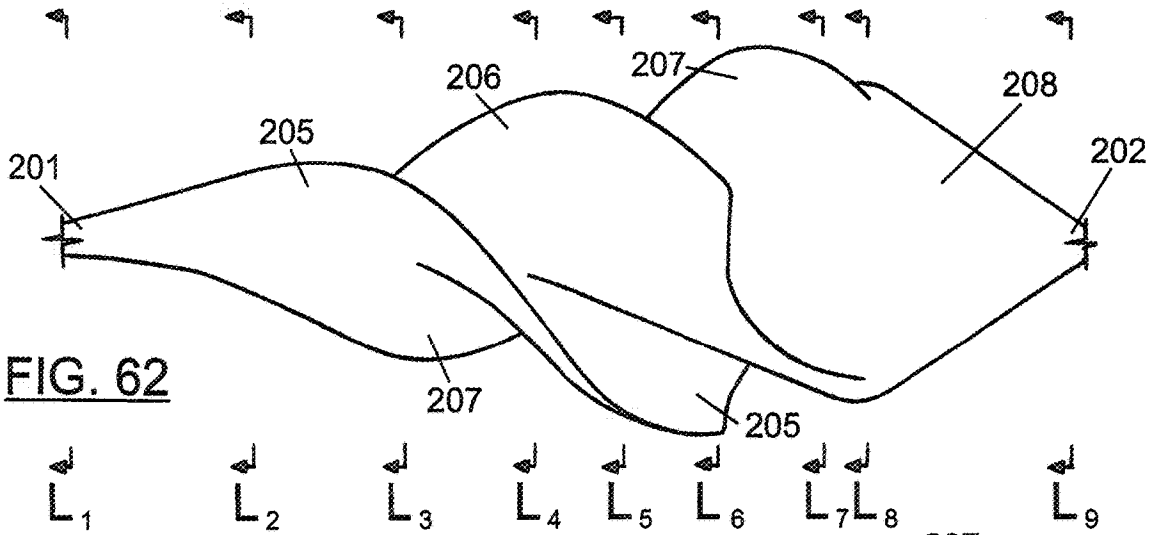
FIG. 62 is a side view of another embodiment of propeller system that has winglets around a solid shape.

FIG. 58 is a front view and FIG. 59 is a rear view of the embodiment of FIG. 57. FIG. 60 is a cross-sectional view with the rotational envelope shown as phantom outline, and taken through a vertical plane extending through the axis of rotation. FIG. 61 shows perpendicular cross-sections $K_1$-$K_9$ of the propeller of FIG. 57. As seen in FIGS. 57 and 60, a somewhat bulbous nose 191 is in the front part from which winglets 195, 196 and 197 start. The winglets 195, 196 and 197 are connected at their largest diameter with the small intubation 193, which has an round intake opening 190 and a round exit outlet 194, with intervening structure with an outer surface and an inner passageway surface that generally follows the rotational envelope contour of the propeller. The entire structure is supported and connected by the shaft 192 to a drive system, and driven so as to rotate clockwise when viewed looking forward. FIG. 62 is a side view of another embodiment with winglets attached around a shaft that is a solid shape that tapers radially wider at the exhaust portion of the propeller, and then tapers inwardly rearward of that, as best shown by FIGS. 62 to 66. The exit outlet of the winglet channels is wide, being at the periphery of the widest part of the solid shape. The propeller is a three winglet propeller with a propelling segment angle of 45 degrees, with elongation. The wider exit outlet produces greater acceleration because the exit flow is expanded laterally. This embodiment is suited for high or regular speed and performance.

Figure 64:
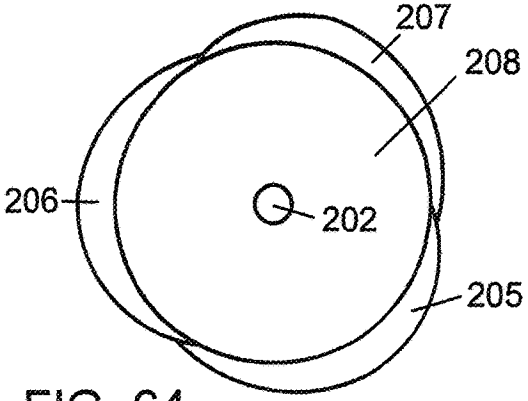
FIG. 64 shows a rear view of the propeller of FIG. 62.
Figure 63:
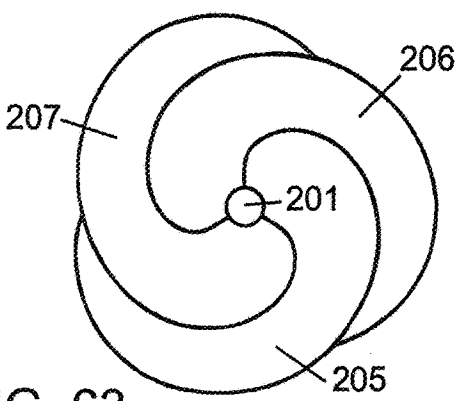
FIG. 63 shows a front view of the propeller of FIG. 62.
Figure 65:
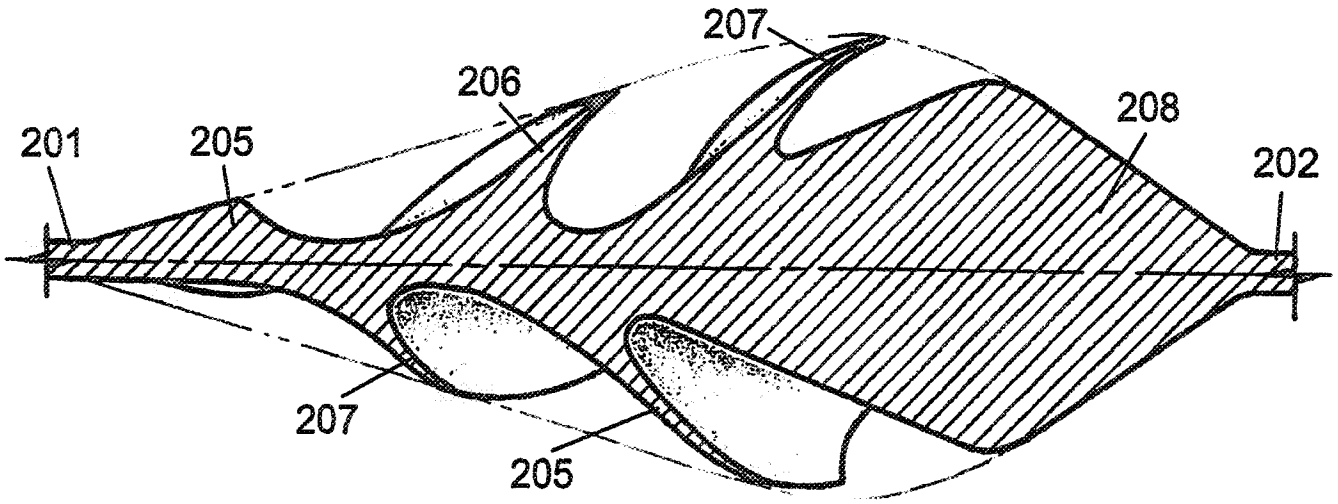
FIG. 65 is a cross-sectional view of the propeller of FIG. 62 along its longitudinal centerline.
Figure 66:
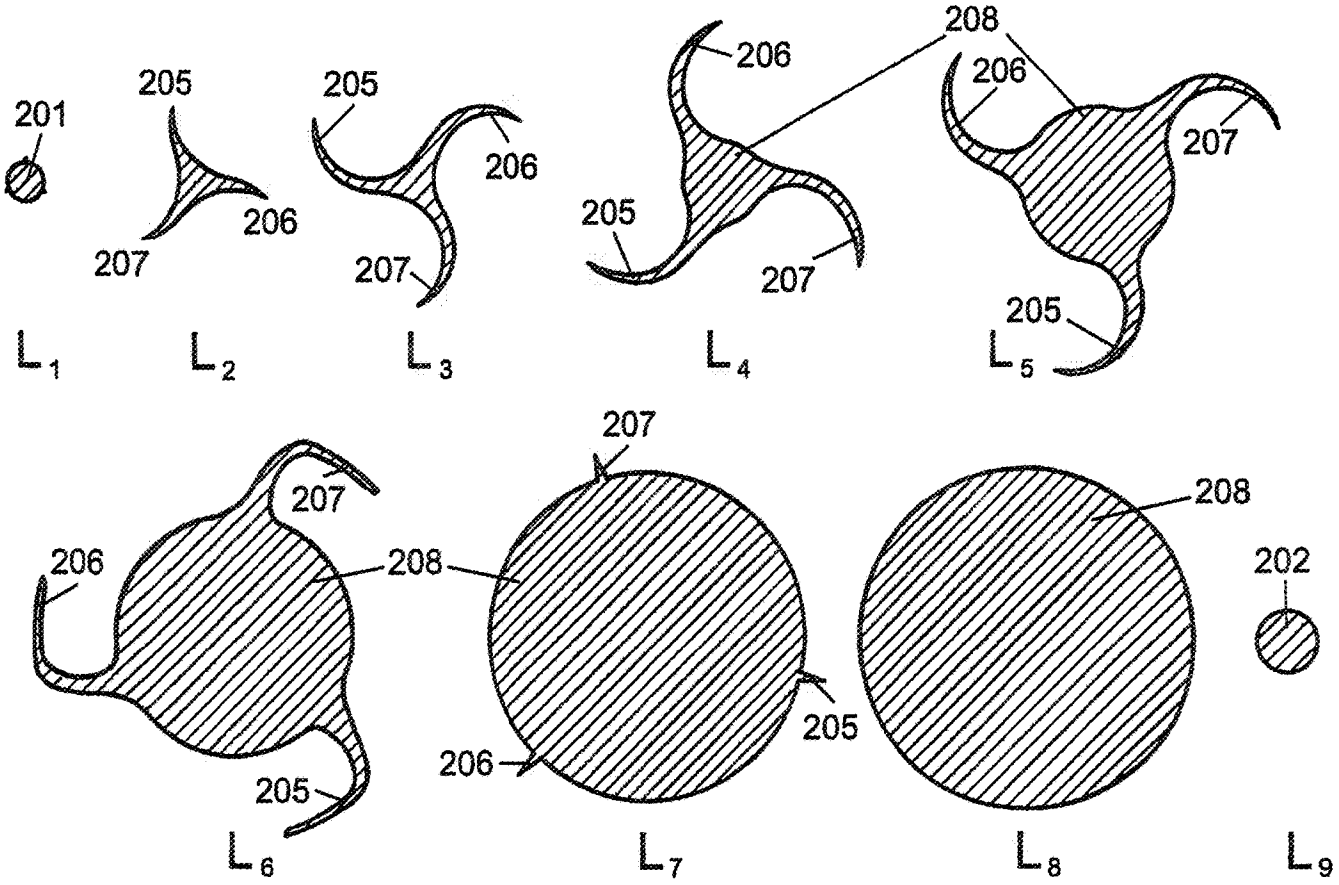
FIG. 66 shows cross-sections of the propeller of FIG. 62 in planes $L_1$-$L_9$.

FIG. 63 shows a front view and FIG. 64 is a rear view of the propeller. FIG. 65 is a cross-sectional view with a rotational envelope outline and taken through a vertical plane extending through its axis of rotation. FIG. 66 shows perpendicular cross-sections $L_1$-$L_9$. Winglets 205, 206 and 207 start at the front shaft 201 at the front and are then attached to the solid shape 208, which tapers radially outward and then inward, where it ends at shaft 202. Either of the shafts 201 or 202 may be connected to a drive system. The fluid is propelled backwards, but also slightly laterally outward at approximately the location of the $L_6$ cross-section. The propeller is driven so as to rotate clockwise when viewed looking forward.

Figure 67:
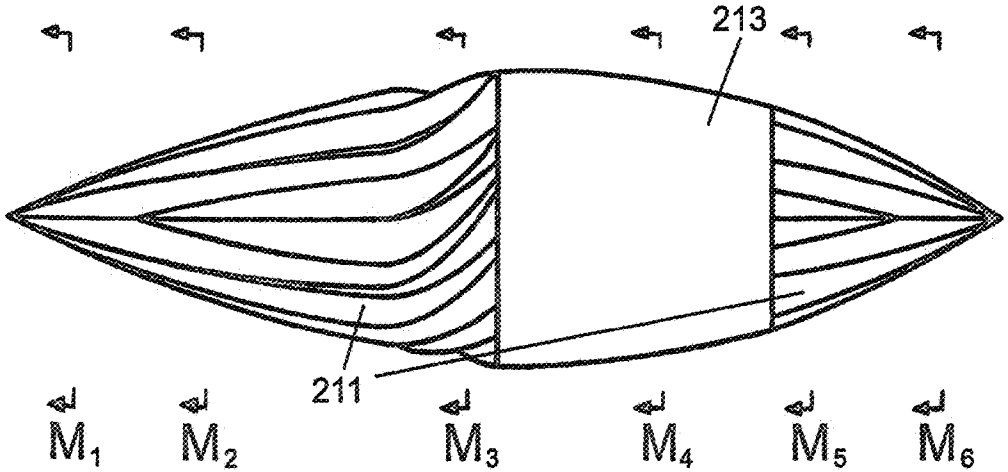
FIG. 67 shows a side view of another embodiment of propeller system that is enclosed within a fixed, non-rotating frame or wine.

FIG. 67 shows a side view of a version of a propeller similar to propeller 11 but enclosed and rotatingly attached at both its ends within a fixed, non-rotating frame or grille 211. The front or rear ends of the propeller are connected with a shaft extending through the frame to a drive system that rotates the propeller inside the frame. The frame stabilizes the flow inside and outside of the enclosed propeller.

The fixed frame 211 in this version has vanes that start straight and parallel to the longitudinal axis, but then, in the middle section, are oriented at a counter angle to the rotation of the rotating propeller 11. Before the rearward end, the vanes become straight again. There is an intubation 213 at the middle of the frame on the outside which also consolidates the frame 211. The embodiment with such a frame can be attached to a vessel at its ends or at the intubation 213.

The frame 211 maintains a straight incoming flow towards and around the intake outlets and at the end it corrects the flow at its exit outlets, while the intubation 213 at the middle keeps the flow inside and maintains the streamlines around its body. It also protects the rotating propeller within it. This system is suitable for either high or regular speeds.

Alternatively, the entire vane structure of the frame may be straight and parallel to the longitudinal axis of the propeller.

Figure 68:
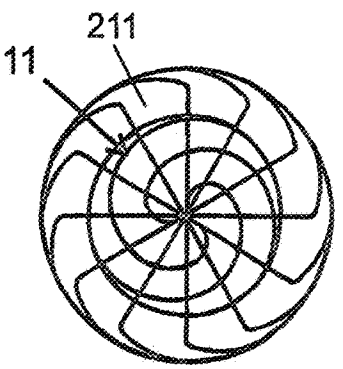
FIG. 68 is a front view of the propeller of FIG. 67.
Figure 70:
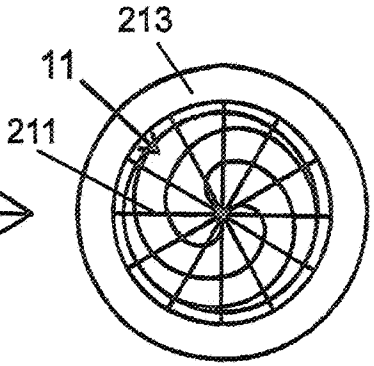
FIG. 70 shows a rear view of the propeller of FIG. 67.
Figure 69:
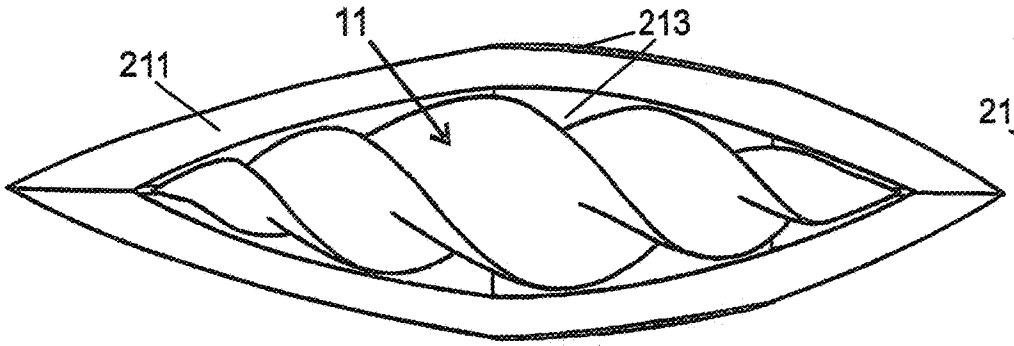
FIG. 69 shows the propeller mounted within the frame, which is sectioned along the longitudinal centerline of the propeller.

FIG. 68 is a front view of the propeller of FIG. 67. FIG. 69 shows the propeller mounted within the frame 211, which is sectioned along its longitudinal centerline, and FIG. 70 shows a rear view of the propeller system of FIG. 67.

Figure 71:
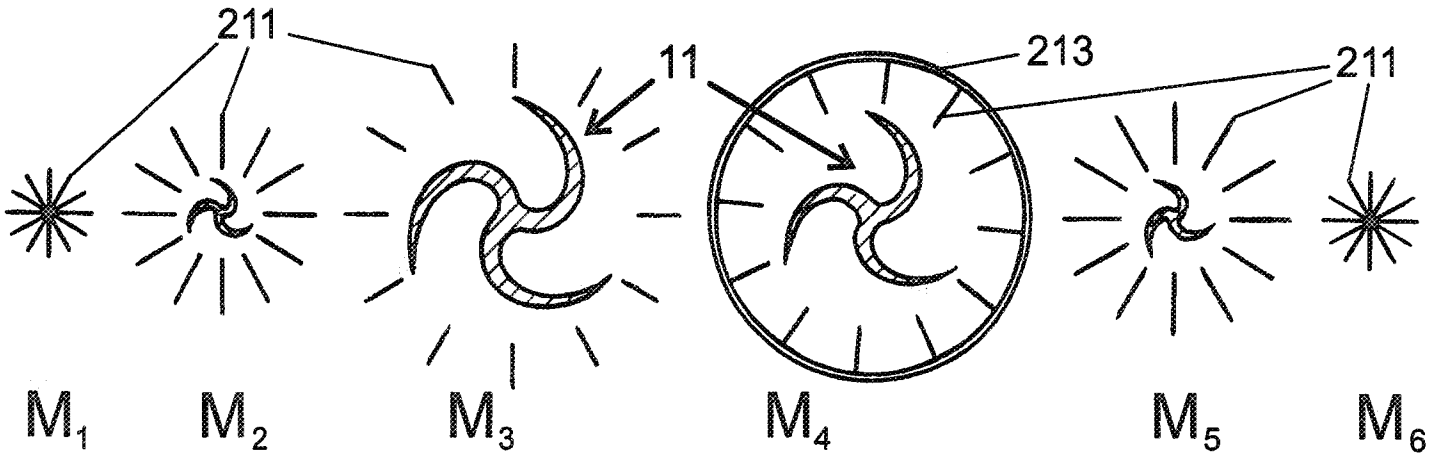
FIG. 71 shows cross-sections of the propeller of FIG. 67 at planes $M_1$-$M_6$.

FIG. 71 shows perpendicular cross-sections $M_1$-$M_6$ of the propeller of FIG. 67. The rotation of the propeller within the frame is clockwise as viewed from the rear.

Figure 72:
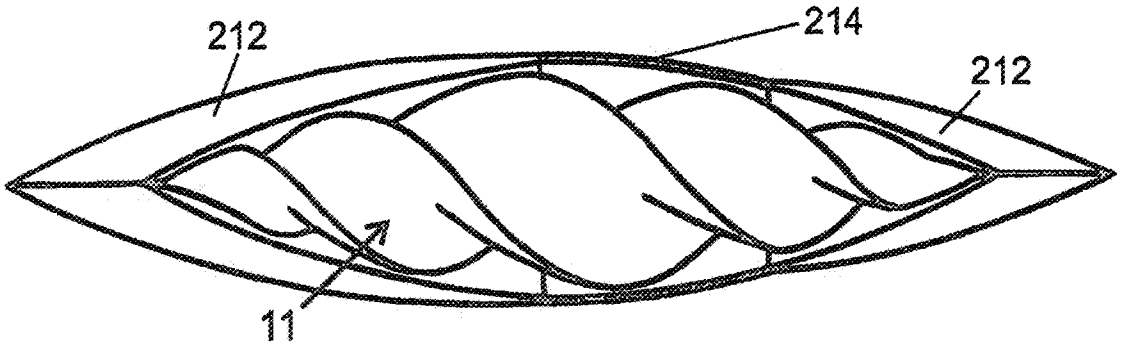
FIG. 72 shows another longitudinal cross-sectional view of a variant of the propeller of FIG. 67.
Figure 73:
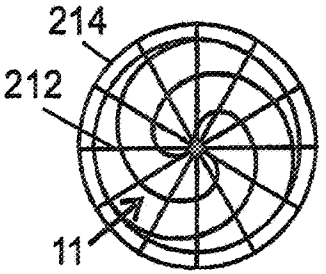
FIG. 73 shows a front view of the propeller of FIG. 72
Figure 74:
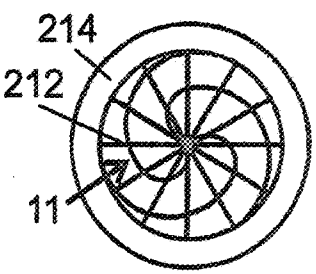
FIG. 74 shows a rear view of the propeller of FIG. 72.

FIG. 72 shows another embodiment of propeller system similar to that of FIGS. 67 to 71 in a longitudinal cross-sectional view. FIG. 73 shows a front view and FIG. 74 shows a rear view of the propeller system of FIG. 72. The vanes of the first half of the frame 212 ends where the intubation 214 starts, and vanes of a second half of the frame continue rearwardly from where the intubation 214 ends. The intubation 214 is positioned closer to propeller 11 than in the embodiment of FIG. 67. The rotation of the axial impelpropeller 11 within the frame is clockwise as viewed from the rear.

Figures 75, 76, 77:
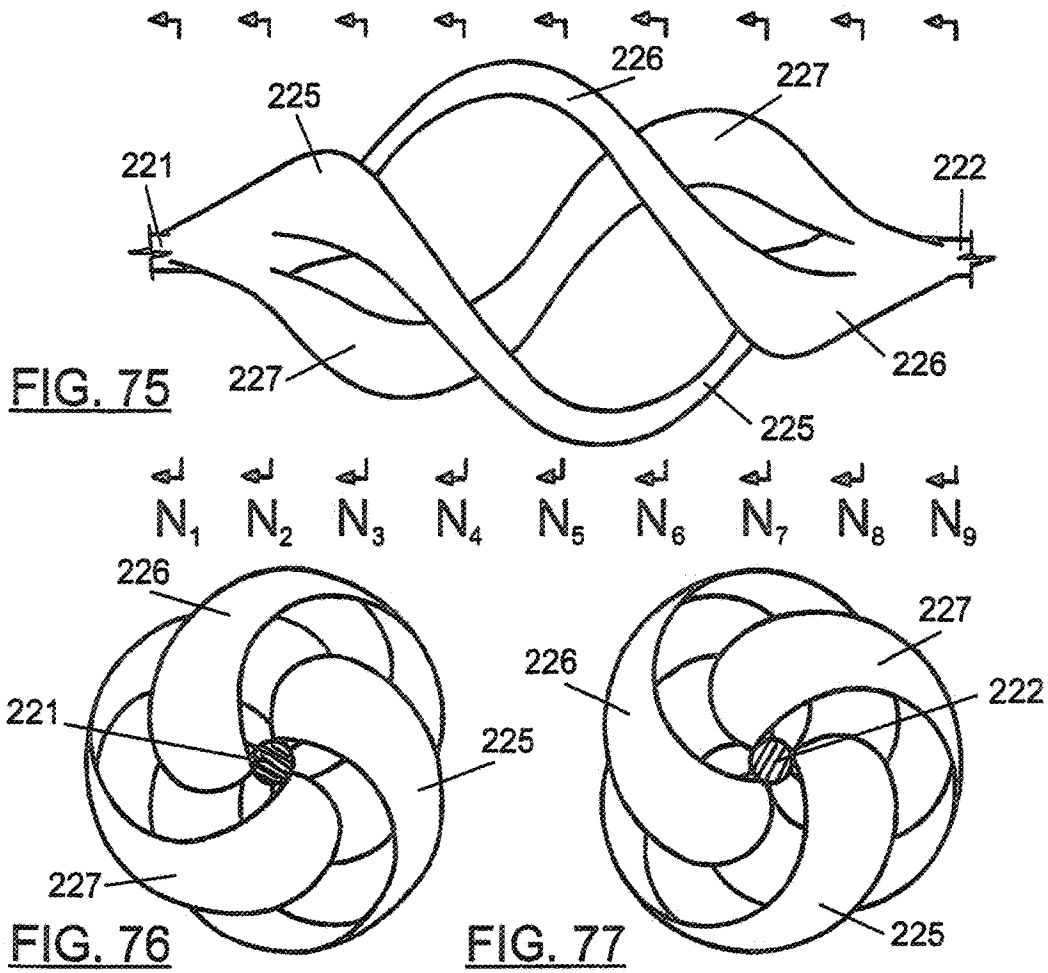
FIG. 75 shows a side view of another embodiment of propeller system having a reversible, symmetrical, careless propeller.
FIG. 76 shows a front view of the propeller of FIG. 75.
FIG. 77 shows a rear view of the propeller of FIG. 75.

FIG. 75 shows a side view of a reversible, symmetrical, coreless propeller embodiment that has hollowed-out winglets at the center, the propeller being attached at its ends to rotating shafts 221 and 222. It is a three winglet propeller with a propelling segment with an angle of attack of 45 degree, with a slight elongation. Because the propeller is reversible and symmetrical, it can run in both directions with the same efficiency and can be used for high or regular speed and performance.

FIG. 76 shows a front view and FIG. 77 shows a rear view of the propeller of FIG. 75.

Figure 78:
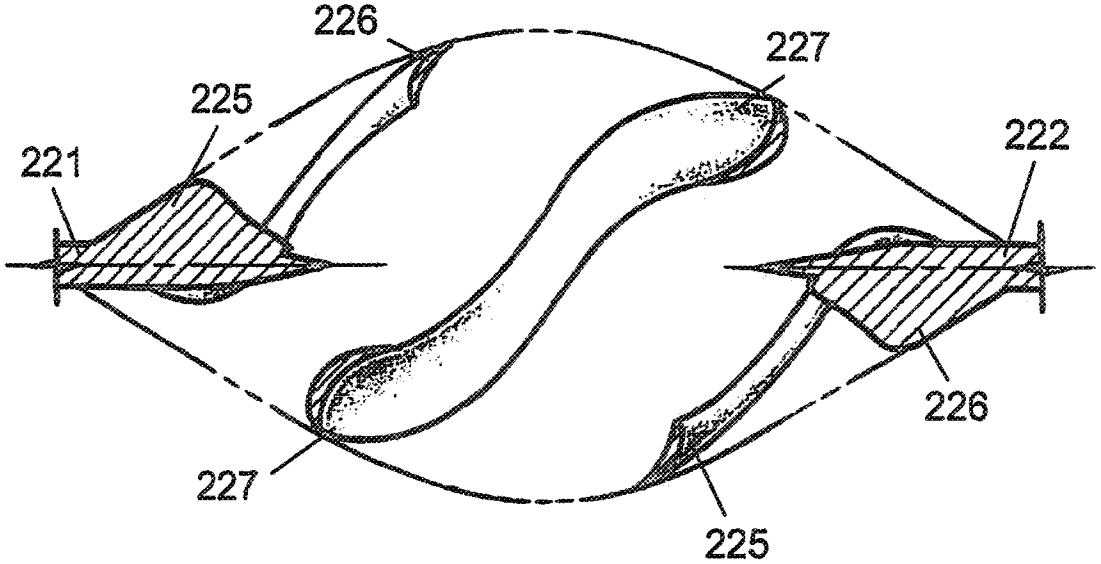
FIG. 78 is a cross-sectional view of the propeller of FIG. 75 at its longitudinal centerline.
Figure 79:
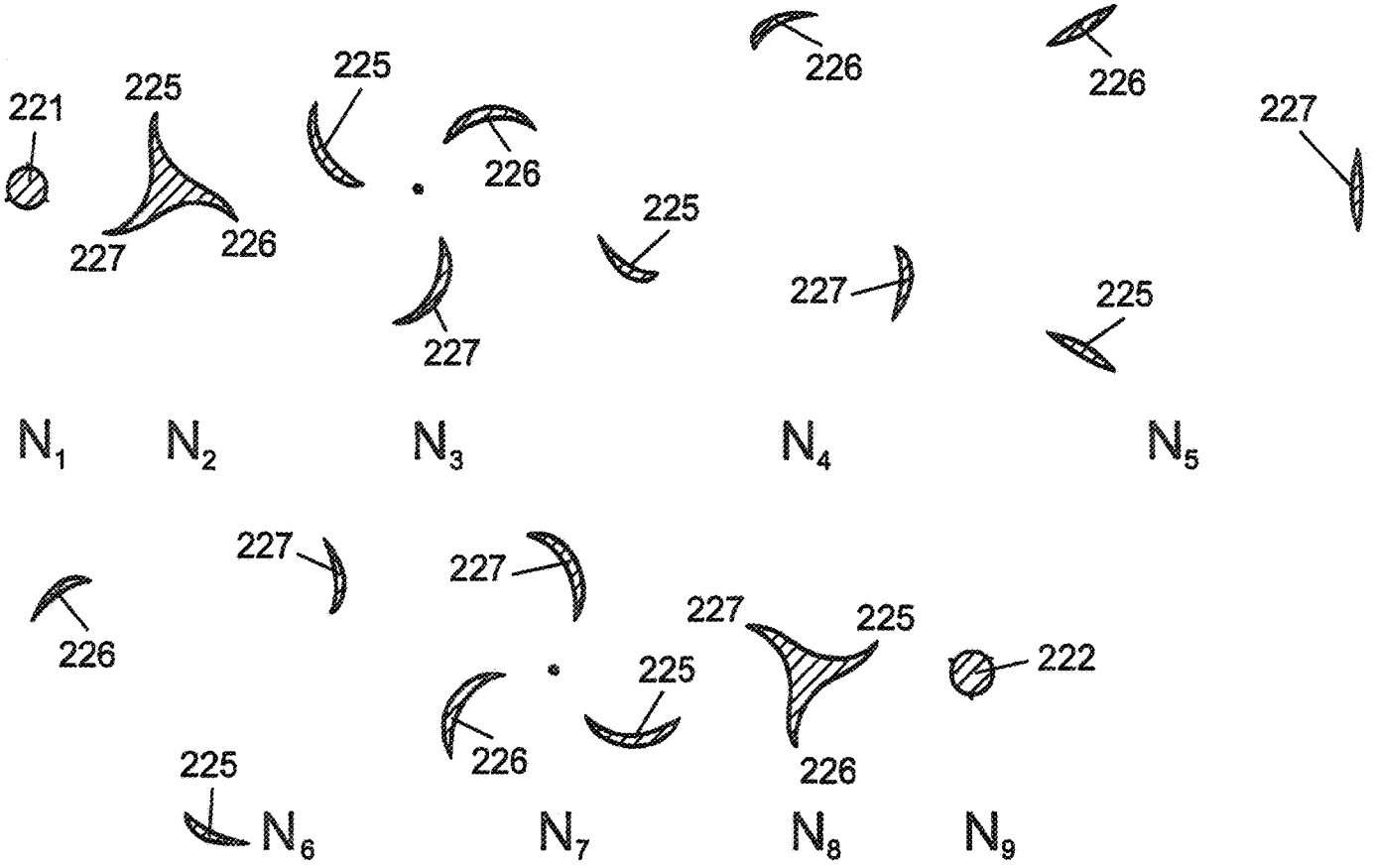
FIG. 79 shows a series of cross-sections of the propeller of FIG. 75 at planes $N_1$-$N_9$.

FIG. 78 is a longitudinal cross-sectional view with rotational envelope outline of the propeller of FIG. 75 taken through a vertical plane extending through its axis of rotation. FIG. 79 shows perpendicular planar cross-sections $N_1$-$N_9$ of the propeller. The winglets 225, 226 and 227 are structured so that either half can be directed forward or rearward, and each half is a reflection of the other half. At the longitudinal center, the cutting edge of the winglets 225, 226 and 227 forms a flat section with double-edges in cross-section, as best seen in the cross-section $N_5$ of FIG. 79. Because the winglets are reversible they do not have an elongation. The winglets 225, 226 and 227 are attached at one end to the shaft 221 and to the shaft 222 at the other, and either shaft can be connected to the drive system. Rotation can be either clockwise or counterclockwise. For the configuration of winglet structure shown, the advancing (front) end is given by the clockwise rotation of the propeller as looked forward from the other end, and this embodiment can be described as a right-hand propeller.

Figure 80:
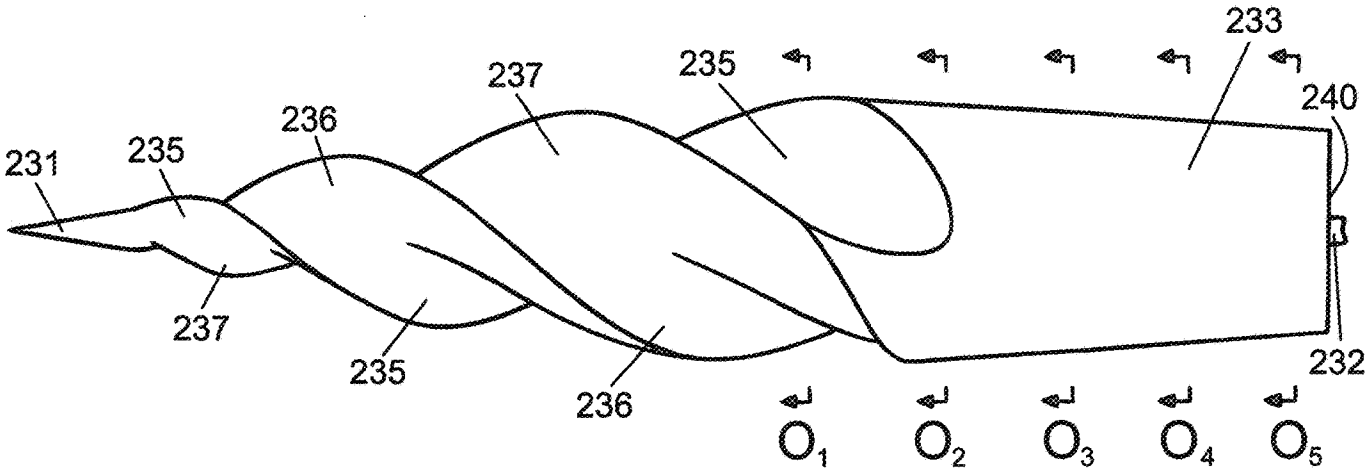
FIG. 80 is a side view of another embodiment of propeller system configured for use at a very high or ultra-high speed.

FIG. 80 is a side view of still another embodiment of propeller, for use at a very high speed or ultra-high speed. The propeller shown is a modification of propeller 11 (see FIG. 1), with the rear half being intubated, which replaces the elongation, similar to propeller of FIG. 42. A difference of this embodiment is that there is no tapering of the second half of the winglets outline at its rear end, as there is no concern to control or correct the exit vortex flow.

Rather, the winglets continue to the end at the same 45 degree angle of attack all the way to the end, in order to maximize the propulsion. The embodiment shown is particularly suited for performance and speed. The intubation concentrates the exit flow and at the same time streamlines the outside flow forming around its body for faster advancing speed.

Figure 81:
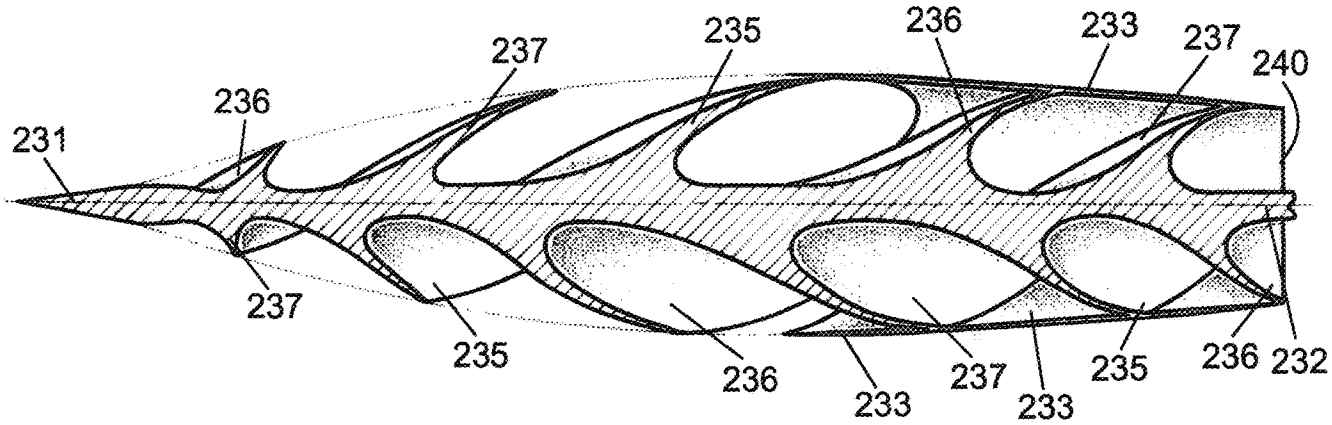
FIG. 81 is a cross-sectional view of the propeller of FIG. 80 along its longitudinal centerline.
Figure 82:
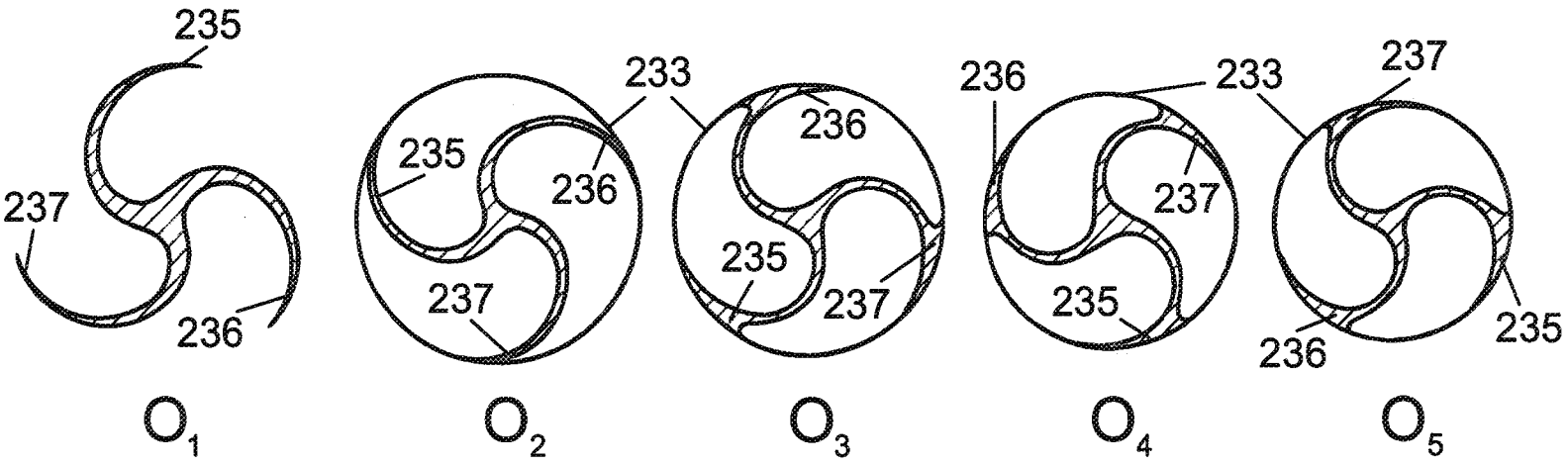
FIG. 82 shows a series of cross-sections of the propeller of FIG. 80 at planes $O_1$-$O_5$.

The front view of this embodiment is the same as that shown in FIG. 43 of the propeller of FIG. 42. FIG. 82 shows cross-sections $O_1$-$O_5$ of the propeller of FIG. 80 perpendicular to its axis of rotation. FIG. 81 is a longitudinal cross-sectional view with outline of the propeller of FIG. 80 taken through a vertical plane extending through its axis of rotation. The first half (to the start of the intubation is the substantially the same as propeller 11 of FIG. 1. The winglets 235, 236 and 237 start at the front tip 231 and end at the shaft 232, which is connected to a drive system. The intubation 233 maximizes the concentration of the exit flow to the smallest cross-section possible, with the exit outlet 240, thus reducing even more any drag, making its structure even more streamlined and therefore maximizing the overall performance of the propeller 11.

Intubation 233 has a gradual intake which conforms to the shape of the winglets, in order to create less resistance. This design is suited particularly for very high performance and super-high speeds. The propeller is driven so as to rotate clockwise when viewed looking forward.

Other structures may be envisioned that employ winglets with intake and exhaust portions, with a retention portion therebetween where appropriate. Also other purposes may be achieved by the fluid propelling designs of the present invention other than moving vessels on water, such as accelerating fluids in containers in the chemical industry context, or other environments where efficient movement of liquids is desirable.

As pumps are essentially enclosed propellers, a variety of axial pumps can be designed based on the principles and designs presented here, with the inclusion of all the necessary additional parts such as the pump housing, enclosure or chambers, directional or correcting vanes, etc.

The foregoing description is illustrative of the present invention and should not be considered as limiting, and the terms of this disclosure should be seen to be terms of description rather than limitation, as modifications and changes to the invention should be readily apparent to those having ordinary skill in the art with this disclosure before them, which modifications would not depart from the spirit and scope of the invention.

What is claimed is:

1. A propeller supported on a floating body so as to be completely submerged in water and rotatable about a longitudinal axis of rotation for propelling the floating body in said water, said propeller comprising:

a shaft rotatably supported on the floating body, said shaft having a forward front end and a rearward back end, and said shaft being driven so as to rotate about the longitudinal axis; and at least three propulsion structures each supported on and extending in a respective spiral path about said shaft and rotationally staggered with respect to one another;

each of said propulsion structures having a fluid contact surface with a surface width measured along the fluid contact surface from a radially inward end portion to a radially outward edge portion;

said fluid contact surfaces each have a respective rearwardly-concave forward engaging portion, a respective intermediate fluid entraining portion, and a respective rearwardly-concave rearward exhaust portion;

the surface widths of the fluid contact surface increasing from the engaging portion to the intermediate fluid entraining portion, and decreasing from the intermediate fluid entraining portion to the exhaust portion;

the fluid contact surfaces in the intermediate fluid entraining portion being concave and being disposed radially inwardly and in the rearward direction so as to radially inwardly enclose a spiral fluid flow volume, with said fluid contact surfaces in the intermediate fluid entraining portion each being shaped such that cross-sections thereof, taken in a respective plane in which the longitudinal axis lies, extend curvingly rearward a distance that is greater than or equal to a radially outward extension distance of the fluid contact surfaces.

2. The invention according to claim 1, wherein the spiral path of the propulsion structures increases in pitch from the intermediate entraining portion to the exhaust portion.

3. The invention according to claim 1, wherein the propulsion structures are rotatively staggered by 120 degrees of rotation about the axis of rotation relative to one other.

4. The invention according to claim 1, wherein the surface width of the fluid contact surfaces increases from the forward engagement portion of the propulsion structure to a maximal surface width in the intermediate entraining portion at a point that is 0.6 to 0.8 L from the forward front end of the propulsion structures, where L is an overall longitudinal length of the propulsion structures.

5. The invention according to claim 4, wherein the surface width of the fluid contact surfaces taperingly decreases from said maximal surface width to zero at the rearward ends of the propulsion structures.

6. The invention according to claim 1, wherein said fluid contact surfaces are shaped such that cross-sections thereof in a plane perpendicular to the longitudinal axis extend curvingly circumferentially a distance greater than the radially outward extension distances of the fluid contact surfaces.

7. The invention according to claim 1, wherein each of the propulsion structures in a cross section in a plane perpendicular to the longitudinal axis in the respective intermediate fluid entraining portion has a radially distal outward end, and the intermediate fluid entraining portions form an inward angle to a tangent to a circle about the longitudinal axis of 0 to 5 degrees.

* * * * *